US006556214B1

(12) United States Patent
Yamada et al.

(10) Patent No.: US 6,556,214 B1
(45) Date of Patent: Apr. 29, 2003

(54) MULTILEVEL IMAGE DISPLAY METHOD

(75) Inventors: Kazuhiro Yamada, Takatsuki (JP); Isao Kawahara, Toyono-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/401,149

(22) Filed: Sep. 22, 1999

(30) Foreign Application Priority Data

Sep. 22, 1998 (JP) ..... 10-267896

(51) Int. Cl.[7] ..... G09G 5/10
(52) U.S. Cl. ..... 345/616; 345/589; 382/252
(58) Field of Search ..... 345/60, 581, 589, 345/616; 358/1.9, 447, 448, 3.03, 465; 382/252, 234, 304; 714/704

(56) References Cited

U.S. PATENT DOCUMENTS 4,890,167 A 12/1989 Nakazato et al.
5,519,791 A 5/1996 Webb et al.
5,585,818 A * 12/1996 Shibamiya ..... 345/581
5,642,204 A * 6/1997 Wang ..... 358/3.03
5,835,687 A * 11/1998 Brown et al. ..... 358/1.9
5,931,960 A * 8/1999 Kletter et al. ..... 714/704
6,002,804 A * 12/1999 Bhaskar et al. ..... 382/252
6,297,788 B1 10/2001 Shigeta et al.

FOREIGN PATENT DOCUMENTS

| | | |
|---|---|---|
| EP | 507061 | 10/1992 |
| EP | 706165 | 4/1996 |
| EP | 973147 | 1/2000 |
| FR | 2740253 | 4/1997 |
| JP | 6301364 | 10/1994 |
| JP | 7064505 | 3/1995 |
| JP | 11073157 | 3/1999 |
| WO | 9844479 | 10/1998 |

* cited by examiner

*Primary Examiner*—Dennis-Doon Chow

(57) ABSTRACT

A multilevel image display method performs error diffusion processing on data that is inputted as multiphase data. The display error of a target pixel is diffused into pixels included in data blocks that are inputted after the data block that includes the target pixel.

41 Claims, 50 Drawing Sheets

FIG. 12A

CALCULATION UNIT 32

| OUTPUT VALUE OF PATTERN SWITCHING UNIT | 0 | 1 |
|---|---|---|
| DELAY UNIT 306 | H | H |
| DELAY UNIT 307 | H | H |
| DELAY UNIT 308 | H+D | H+D |
| DELAY UNIT 309 | H+D | H+D |
| MULTIPLICATION UNIT 310 | 6/16 | 3/16 |
| MULTIPLICATION UNIT 311 | 6/16 | 2/16 |
| MULTIPLICATION UNIT 312 | 5/16 | 2/16 |
| MULTIPLICATION UNIT 313 | 6/16 | 2/16 |

FIG. 12C

CALCULATION UNIT 34

| OUTPUT VALUE OF PATTERN SWITCHING UNIT | 0 | 1 |
|---|---|---|
| DELAY UNIT 306 | H | H |
| DELAY UNIT 307 | H | H |
| DELAY UNIT 308 | H | H |
| DELAY UNIT 309 | H | H |
| MULTIPLICATION UNIT 310 | 5/16 | 2/16 |
| MULTIPLICATION UNIT 311 | 6/16 | 2/16 |
| MULTIPLICATION UNIT 312 | 6/16 | 2/16 |
| MULTIPLICATION UNIT 313 | 6/16 | 3/16 |

FIG. 12B

CALCULATION UNIT 33

| | 0 | 1 |
|---|---|---|
| DELAY UNIT 306 | H | H |
| DELAY UNIT 307 | H | H |
| DELAY UNIT 308 | H | H |
| DELAY UNIT 309 | H+D | H+D |
| MULTIPLICATION UNIT 310 | 2/16 | 6/16 |
| MULTIPLICATION UNIT 311 | 2/16 | 6/16 |
| MULTIPLICATION UNIT 312 | 3/16 | 6/16 |
| MULTIPLICATION UNIT 313 | 2/16 | 5/16 |

FIG. 12D

CALCULATION UNIT 35

| | 0 | 1 |
|---|---|---|
| DELAY UNIT 306 | H−D | H−D |
| DELAY UNIT 307 | H | H |
| DELAY UNIT 308 | H | H |
| DELAY UNIT 309 | H | H |
| MULTIPLICATION UNIT 310 | 3/16 | 6/16 |
| MULTIPLICATION UNIT 311 | 2/16 | 5/16 |
| MULTIPLICATION UNIT 312 | 2/16 | 6/16 |
| MULTIPLICATION UNIT 313 | 2/16 | 6/16 |

PATTERN C

PATTERN D

PATTERN E

PATTERN F

PATTERN I

PATTERN J

PATTERN K

PATTERN L

FIG. 37

OUTPUT SOURCES OF INPUT SIGNALS

| CALCULATION UNIT 402 | CALCULATION UNIT 403 | CALCULATION UNIT 404 | CALCULATION UNIT 405 |
|---|---|---|---|
| INPUT IMAGE SIGNALOF PHASE 1 | INPUT IMAGE SIGNALOF PHASE 2 | INPUT IMAGE SIGNALOF PHASE 3 | INPUT IMAGE SIGNALOF PHASE 4 |
| DISPLAY ERROR OF CALCULATION UNIT 403 | DISPLAY ERROR OF CALCULATION UNIT 402 | DISPLAY ERROR OF CALCULATION UNIT 402 | DISPLAY ERROR OF CALCULATION UNIT 402 |
| DISPLAY ERROR OF CALCULATION UNIT 404 | DISPLAY ERROR OF CALCULATION UNIT 404 | DISPLAY ERROR OF CALCULATION UNIT 403 | DISPLAY ERROR OF CALCULATION UNIT 403 |
| DISPLAY ERROR OF CALCULATION UNIT 405 | DISPLAY ERROR OF CALCULATION UNIT 405 | DISPLAY ERROR OF CALCULATION UNIT 405 | DISPLAY ERROR OF CALCULATION UNIT 404 |

FIG. 39

CALCULATION UNIT 402

| | TARGET PIXEL AND LINE ABOVE ARE I | TARGET PIXEL IS I: LINE ABOVE IS J | TARGET PIXEL IS J: LINE ABOVE IS I | TARGET PIXEL AND LINE ABOVE ARE J |
|---|---|---|---|---|
| DELAY UNIT 801 | H | H | H | H |
| DELAY UNIT 802 | ① H | H | ② H | H |
| DELAY UNIT 803 | H+D | H+D | H+D | H+D |
| DELAY UNIT 804 | H+D | H+D | H+D | H+D |
| DELAY UNIT 805 | D | D | D | D |
| MULTIPLICATION UNIT 806 | ×6/16 | ×2/16 | ×6/16 | ×2/16 |
| MULTIPLICATION UNIT 807 | ×6/16 | ×3/16 | ×6/16 | ×3/16 |
| MULTIPLICATION UNIT 808 | ×5/16 | ×2/16 | ×5/16 | ×2/16 |
| MULTIPLICATION UNIT 809 | ×1/16 | ×6/16 | ×1/16 | ×6/16 |
| MULTIPLICATION UNIT 810 | ×7/16 | ×7/16 | ×1/16 | ×1/16 |

FIG. 40

CALCULATION UNIT 403

| | TARGET PIXEL AND LINE ABOVE ARE I | TARGET PIXEL IS I: LINE ABOVE IS J | TARGET PIXEL IS J: LINE ABOVE IS I | TARGET PIXEL AND LINE ABOVE ARE J |
|---|---|---|---|---|
| DELAY UNIT 801 | H | H | H | H |
| DELAY UNIT 802 | H | ② H | H | ① H |
| DELAY UNIT 803 | H | H | H | H |
| DELAY UNIT 804 | UNNECESSARY | UNNECESSARY | UNNECESSARY | UNNECESSARY |
| DELAY UNIT 805 | UNNECESSARY | UNNECESSARY | UNNECESSARY | UNNECESSARY |
| MULTIPLICATION UNIT 806 | ×6/16 | ×2/16 | ×6/16 | ×2/16 |
| MULTIPLICATION UNIT 807 | ×6/16 | ×2/16 | ×6/16 | ×2/16 |
| MULTIPLICATION UNIT 808 | ×6/16 | ×3/16 | ×6/16 | ×3/16 |
| MULTIPLICATION UNIT 809 | UNNECESSARY | UNNECESSARY | UNNECESSARY | UNNECESSARY |
| MULTIPLICATION UNIT 810 | UNNECESSARY | UNNECESSARY | UNNECESSARY | UNNECESSARY |

FIG. 41

CALCULATION UNIT 404

| | TARGET PIXEL AND LINE ABOVE ARE I | TARGET PIXEL IS I: LINE ABOVE IS J | TARGET PIXEL IS J: LINE ABOVE IS I | TARGET PIXEL AND LINE ABOVE ARE J |
|---|---|---|---|---|
| DELAY UNIT 801 | H | H | H | H |
| DELAY UNIT 802 | ① H | H | ② H | H |
| DELAY UNIT 803 | H | H | H | H |
| DELAY UNIT 804 | H | H | H | H |
| DELAY UNIT 805 | UNNECESSARY | UNNECESSARY | UNNECESSARY | UNNECESSARY |
| MULTIPLICATION UNIT 806 | ×6/16 | ×2/16 | ×6/16 | ×2/16 |
| MULTIPLICATION UNIT 807 | ×5/16 | ×2/16 | ×5/16 | ×2/16 |
| MULTIPLICATION UNIT 808 | ×6/16 | ×2/16 | ×6/16 | ×2/16 |
| MULTIPLICATION UNIT 809 | ×6/16 | ×2/16 | ×6/16 | ×2/16 |
| MULTIPLICATION UNIT 810 | UNNECESSARY | UNNECESSARY | UNNECESSARY | UNNECESSARY |

FIG. 42

CALCULATION UNIT 405

| | TARGET PIXEL AND LINE ABOVE ARE K | TARGET PIXEL IS K: LINE ABOVE IS L | TARGET PIXEL IS L: LINE ABOVE IS K | TARGET PIXEL AND LINE ABOVE ARE L |
|---|---|---|---|---|
| DELAY UNIT 801 | H | H | H | H |
| DELAY UNIT 802 | ① H−D | H−D | ② H−D | H−D |
| DELAY UNIT 803 | H | H | H | H |
| DELAY UNIT 804 | H | H | H | H |
| DELAY UNIT 805 | UNNECESSARY | UNNECESSARY | UNNECESSARY | UNNECESSARY |
| MULTIPLICATION UNIT 806 | ×2/16 | ×7/16 | ×2/16 | ×7/16 |
| MULTIPLICATION UNIT 807 | ×3/16 | ×6/16 | ×3/16 | ×6/16 |
| MULTIPLICATION UNIT 808 | ×2/16 | ×5/16 | ×2/16 | ×5/16 |
| MULTIPLICATION UNIT 809 | ×2/16 | ×6/16 | ×2/16 | ×6/16 |
| MULTIPLICATION UNIT 810 | UNNECESSARY | UNNECESSARY | UNNECESSARY | UNNECESSARY |

ARRANGEMENT ②

MULTILEVEL IMAGE DISPLAY METHOD

This application is based on an application No. H10-267896 filed in Japan, the content of which is hereby incorporated by reference.

BACKGROUND OF THE INVENTION

1. Field of the Invention

The present invention relates to a display method for displaying a multilevel image based on a digital image input signal, and reduces the deterioration that occurs in image quality where there are insufficient display levels.

2. Description of the Prior Art

When displaying a multilevel image using a digital display apparatus such as a PDP (Plasma Display Panel), limitations on the number of colors that can be displayed by the display apparatus mean that smooth gradations between light and dark parts of an image cannot be displayed. As a result, brightness changes in steps, creating patterns composed of lines of equal brightness that spoil the displayed image.

One method for preventing such decreases in image quality is called error diffusion. In this method, limitations in the ability to display certain shades are compensated for by diffusion the difference ("display error") between a value in the image signal that should be reproduced and the actual color used to display this value among the pixel values of the surrounding pixels. As one example, when an 8-bit (256-color) display is used to display an image expressed using 12 bits (4096 colors) per pixel, the lower four bits of each pixel value is set as the display error. As shown in FIG. 49, 7/16 of this display error is added to the pixel on the right, 3/16 of this display error is added to the pixel below and to the left, 5/16 of this display error is added to the pixel below, and 1/16 of this display error is added to the pixel below and to the right. The color used to display each pixel is then calculated according to the total of the input image signal that corresponds to the pixel and display errors that are added to this pixel due to the surrounding pixels.

This calculation is performed using the circuit shown in FIG. 50. Numeral 2001 in FIG. 50 represents the 12-bit input image signal, numeral 2002 represents the upper 8 bits of the output of the adder 2012, numeral 2003 represents the lower 4 bits of the output of the adder 2012, numerals 2004–2007 are multiplication units that multiply the display errors by the stipulated weightings, and numerals 2008–2011 are delay units for appropriately delaying the inputted display errors so that the display errors are diffused into the surrounding pixels. The adder 2012 adds the various values produced by the multiplication units 2004–2007 to the input image signal.

In this error diffusion process, the illustrated circuit calculates the sum of the original digital data (the input image signal) and the errors for four of the surrounding pixels that are inputted into the adder 2012 by the multiplication units 2004–2007. The upper 8 bits of this sum are outputted to the display apparatus and the lower 4 bits are diffused into the pixel values of the surrounding pixels.

In recent years, however, improvements in the performance of display apparatuses have led to increases in the frequency of image signals, so that the above calculation method is not fast enough to perform error diffusion processing for a modern display apparatus.

One potential solution to this problem would be to reduce the display frequency by using a shift register or the like to convert a serial input image signal into a multiphase signal so that digital data corresponding to a plurality of pixels that are adjacent in the scanning direction is input in parallel. Conventional error diffusion methods diffuse the display error of the pixel to the left of the target pixel into the pixel value of the target pixel. With such method, however, there is the drawback that several data cycles (a data cycle being the time taken to input the input image signal for one pixel into the circuits that perform the processing) would be required to determine the pixel values that should be displayed for all of the pixels in one set of multiphase data. This means that it would not be possible to output data as multiphase data (not that the concept of "multiphase data" is explained in detail in the Embodiments section of this specification).

SUMMARY OF THE INVENTION

The present invention was developed after an extension review of the problems stated above and has an object of providing a multilevel image display method that can perform error diffusion even when data is inputted as multiphase data.

The stated object is achieved by a multilevel image display method for a multilevel image display apparatus, the multilevel image display apparatus processing digital values corresponding to a plurality of pixels, which are adjacent in a scanning direction, in parallel as a data block and converting the digital values corresponding to each pixel in a data block into multilevel values that are used when displaying an image, the multilevel image display method including: an error calculation process for calculating a display error from a digital value that corresponds to a target pixel; and an error diffusion process for diffusing the display error calculated for the target pixel into digital values corresponding to pixels included in at least one data block that follows a data block including the target pixel.

With the stated construction, an image with what appear to be a large number of colors can be displayed due to error diffusion even when digital image data is inputted as multiphase data where pixel values for a plurality of pixels that are adjacent in the scanning direction are inputted in parallel. While the conventional method basically only diffuses the display error of the target pixel into a digital value of a pixel that is adjacent to the target pixel on the same scanning line, the present invention diffuses the display error of the target pixel into digital values of pixels in data blocks that are inputted after the data block that includes the target pixel. While conventional methods are incapable of diffusing errors for all pixels when data is inputted as multiphase data, the present invention is capable of such processing. In short, amended data can be outputted with the same number of phases as the input multiphase data. The diffusion of errors into digital values corresponding to pixels in data blocks that are inputted after the data block including the target pixel can be performed according to the techniques described below.

Here, the error diffusion process may diffuse the calculated display error into digital values corresponding to pixels that lie on scanning lines which are below a scanning line that includes the target pixel.

With the above technique, more time is available for the calculations for error diffusion that needed to be performed within one data cycle in conventional error diffusion methods. This means that the error diffusion processing can be performed by relatively low-speed circuitry.

Here, the error diffusion process may diffuse the calculated display error into digital values of pixels in data blocks that come after the data block including the target pixel, said pixels having a same position (hereafter, "phase") in a data block as the target pixel.

With the above technique, error diffusion processing is performed separately for the data in each phase of the multiphase input signal, so that the construction of the circuitry can be simplified.

Here, when error diffusion process diffuses the calculated display error into digital values of pixels on a same scanning line as the target pixel, the display error may be diffused into pixels that have a same phase within a data block as the target pixel, and when the error diffusion process diffuses the calculated display error into digital values of pixels on a lower scanning line, the display error may be diffused into pixels that are adjacent to the target pixel.

If display errors are only diffused into digital values of pixels with the same phase, the pixels that are affected by a target pixel will be spatially separated from the target pixel, which can mean that there will be little correlation between such pixels and that the positive effects on image quality due to the diffusion of errors will be weakened. However, with the above technique, display errors are also diffused into the digital values of neighboring pixels that have a high correlation with the target pixel, so that the positive effects on image quality due to the diffusion of errors can be maintained. Also, by diffusing a display error into a digital value of a pixel that is spatially separated from the target pixel but is present on the same line as the target pixel, the effects of the display error can be spread out over a wider area, which means that an image of a similar high standard to conventional error diffusion methods can be obtained.

Here, when a digital value corresponding to a pixel that is adjacent to the target pixel on a same scanning line will be processed at least one data cycle after the digital value of the target pixel, the error diffusion process may diffuse the calculated display error into the digital value corresponding to the pixel that is adjacent to the target pixel on the same scanning line, and in all other cases, the error diffusion process may diffuse the calculated display error into other pixels whose digital values will be processed at least one data cycle after the digital value of the target pixel.

With the above technique, display errors are diffused in a wide, fan-shaped pattern around the target pixel. By doing so, pixel values can be averaged over a wide area, so that smoother color gradations can be produced. By additionally diffusion the display error in the scanning direction, the display error of the target pixel can be diffused in a neighboring pixel that can have the highest correlation with the target pixel, which means that an image of a similar high standard to conventional error diffusion methods can be obtained.

As described above, the display error of a target pixel is diffused into digital values of pixels in data blocks that come after the data block including the target pixel.

Here, the display errors calculated by the error calculation process may include positive and negative values.

The above technique produces an image with a higher quality than techniques that only use positive values as display errors.

The error diffusion process may select one out of a plurality of patterns that are prepared in advance, each pattern diffusing the display error calculated for a target pixel into digital values of other pixels.

Here, the error diffusion process may use four patterns, the four patterns including: two patterns which diffuse the calculated display error into digital values corresponding to four consecutive pixels that are near the target pixel on a scanning line that is immediately below a scanning line including the target pixel, one of said two patterns diffusing the calculated display error into the digital values with weightings that are in a small, large, small, large arrangement along a scanning direction and another of said two patterns diffusing the calculated display error into digital values with weightings that are in a large, small, large, small arrangement along the scanning direction; and two patterns which diffuse the calculated display error into (1) a digital value of one pixel that is adjacent to the target pixel on a same scanning line as the target pixel, and (2) digital values of three consecutive pixels that are near the target pixel on a scanning line that is immediately below the scanning line including the target pixel, one of said two patterns diffusing the calculated display error into the four digital values with weightings that are in a small, large, large, small arrangement for a given order of the four digital values and another of said two patterns diffusing the calculated display error into the four digital values with weightings that are in a large, small, small, large arrangement that is opposite to the given order.

By suitably combining the plurality of error diffusion patterns, the above technique can perform a variety of processes that prevent deterioration in image quality due to a regular distribution of bright pixels across images, and so can output high-quality images. Note that it is preferable for the total weighting of display errors that are diffused into heavily affected pixels to be 1.5–3 times the total weighting of display errors diffused into light affected pixels. This distribution is used since a certain difference needs to be maintained between the total display error diffused into heavily affected and lightly affected pixels to prevent the creation of consecutive bright pixels. However, if this difference is too big, heavily affected pixels will definitely become bright, so that an undesirable pattern that reflects the arrangement of the error diffusion patterns will be observed in the display image.

From the above perspective, it is preferable for the two patterns which diffuse the calculated display error into digital values corresponding to four consecutive pixels that are near the target pixel on a scanning line that is immediately below the scanning line including the target pixel to respectively use (1) 3/16, 6/16, 2/16, 5/16 and (2) 6/16, 2/16, 6/16, 2/16 as the arrangements of weightings, and for the other two patterns to be (i) a pattern that diffuses 7/16 of the calculated display error into the digital value of the pixel on the same scanning line as the target pixel and 6/16, 2/16, and 1/16 of the calculated display error respectively into the digital values of the pixels on the scanning line that is immediately below the scanning line including the target pixel and (ii) a pattern that diffuses 1/16 of the calculated display error into the digital value of the pixel on the same scanning line as the target pixel and 2/16, 7/16, and 6/16 of the calculated display error respectively into the digital values of the pixels on the scanning line that is immediately below the scanning line including the target pixel.

Here, the error diffusion process may use two patterns which diffuse the calculated display error into digital values corresponding to four consecutive pixels that are near the target pixel on a scanning line that is immediately below a scanning line including the target pixel, one of said two patterns diffusing the calculated display error into the pixels with weightings that are in a small, large, small, large arrangement along a scanning direction and another of said two patterns diffusing the calculated display error into the pixels with weightings that are in a large, small, large, small arrangement along the scanning direction.

By suitably combining the plurality of error diffusion patterns, the above technique can perform a variety of processes that prevent deterioration in image quality due to a regular distribution of bright pixels across images, and so can output high-quality images. Note that it is preferable for the total weighting of display errors that are diffused into heavily affected pixels to be 1.5–3 times the total weighting of display errors diffused into lightly affected pixels. This distribution is used since a certain difference needs to be maintained between the total display error diffused into heavily affected and lightly affected pixels to prevent the creation of consecutive bright pixels. However, if this difference is too big, heavily affected pixels will definitely become bright, so that an undesirable pattern that reflects the arrangement of the error diffusion patterns will be observed in the display image.

From the above perspective, it is preferable for the two patterns to respectively use (1) 3/16, 6/16, 2/16, 5/16 and (2) 6/16, 2/16, 6/16, 2/16 as the arrangements of weightings along the scanning direction.

Here, the error diffusion process may use two patterns, a first of the two patterns diffusing the calculated display error into digital values of three pixels composed of a first pixel at a position that is on a same scanning line as the target pixel but is separated from the target pixel by several pixels in a first direction, a second pixel that is adjacent to the target pixel and lies on a scanning line that is immediately below the scanning line including the target pixel, and a third pixel that lies on a same scanning line as the second pixel and is separated from the target pixel by several pixels in the first direction, and a second of the two patterns diffusing the calculated display error into digital values of three pixels composed of a fourth pixel at a position that is on a same scanning line as the target pixel but is separated from the target pixel by several pixels in the first direction, a fifth pixel that is adjacent to the target pixel and lies on a scanning line that is immediately below the scanning line including the target pixel, and a sixth pixel that lies on a same scanning line as the fifth pixel and is separated from the target pixel by several pixels in a different direction from the first direction.

By suitable combining the plurality of error diffusion patterns, the above technique can prevent deterioration in image quality due to a regular distribution of bright pixels across images. Since display errors are diffused into digital values for three pixels with the same phase as the target pixel only, the number of multiplication units can be decreased and separate error diffusion processing can be performed for each phase. This simplifies the circuit construction. Note that it is preferable for the distribution (weightings) of the display errors diffused from the target pixel in each pattern to be similar. This distribution is used since a certain difference needs to be maintained between the total display error diffused into heavily affected and lightly affected pixels to prevent the creation of consecutive bright pixels. However, if this difference is too big, heavily affected pixels will definitely become bright, so that an undesirable pattern that reflects the arrangement of the error diffusion patterns will be observed in the display image.

From the above perspective, it is preferable for the first pattern to diffuse the calculate display error with a weighting of 5/16 into the digital value of the first pixel, with a weighting of 7/16 into the digital value of the second pixel, and with a weighting of 4/16 into the digital value of the third pixel, and for the second pattern to diffuse the calculated display error with a weighting of 7/16 into the digital value of the fourth pixel, with a weighting of 5/16 into the digital value of the fifth pixel, and with a weighting of 4/16 into the digital value of the sixth pixel.

Here, the error diffusion process may use two patterns, both patterns diffusing the calculated display error into digital values of four pixels composed of a first pixel at a position that is on a same scanning line as the target pixel but is separated from the target pixel by several pixels in a first direction, a second pixel that is adjacent to the target pixel and lies on a scanning line that is immediately below the scanning line including the target pixel, a third pixel that lies on a same scanning line as the second pixel and is separated from the target pixel by several pixels in the first direction, and a fourth pixel that lies on a same scanning line as the second pixel and is separated from the target pixel by several pixels in a second direction that differs from the first direction, the two patterns including different weightings for diffusing the calculated display errors into the digital data of the four pixels.

By suitably combining the plurality of error diffusion patterns, the above technique can prevent deterioration in image quality due to a regular distribution of bright pixels across images. Since display errors are diffused into digital values for three pixels with the same phase as the target pixel only, the number of multiplication units can be decreased and separate error diffusion processing can be performed for each phase. This simplifies the circuit construction.

Note that it is preferable to diffuse around 5/16 –7/16 of the display error into the digital values of a pixel on the same scanning line as the target pixel at a distance of several pixels from the target pixel in the first direction, around 1/16–3/16 of the display error into the digital values of a pixel on the next scanning line as the target pixel at a distance of several pixels from the target pixel in the first direction, and the rest of the display error into the digital values of (1) a pixel on the next line that is adjacent to the target pixel and (2) a pixel on the next line at a distance of several pixels from the target pixel in the second direction. This distribution is used since to prevent the creation of consecutive bright pixels, a certain difference needs to be maintained between the total display error diffused into heavily affected and lightly affected pixels. However, if this difference is too big, heavily affected pixels will definitely become bright, so that an undesirable pattern that reflects the arrangement of the error diffusion patterns will be observed in the display image.

From the above perspective, it is preferable for a first of the two patterns to diffuse 7/16 of the calculated display error into the digital value of the first pixel, 1/16 of the calculated display error into the digital value of the third pixel, 5/16 of the calculated display error into the digital value of the second pixel, and 3/16 of the calculated display error into the digital value of the fourth pixel, and for a second of the two patterns to diffuse 1/16 of the calculated display error into the digital value of the first pixel, 7/16 of the calculated display error into the digital value of the third pixel, 3/16 of the calculated display error into the digital value of the second pixel, and 5/16 of the calculated display error into the digital value of the fourth pixel.

Here, the error diffusion process may use two patterns, both patterns diffusing the calculated display error into digital values of four pixels composed of a first pixel at a position that is on a same scanning line as the target pixel but is separated from the target pixel by several pixels in a first direction, and three consecutive pixels that are near the target pixel and lie on a scanning line that is immediately below the scanning line including the target pixel, the two patterns including different weightings for diffusing the calculated display errors into the four pixels.

By suitably combining the plurality of error diffusion patterns, the above technique can prevent deterioration in image quality due to a regular distribution of bright pixels across images. By diffusing the display error in the scanning direction as in conventional error diffusion methods, the display error of the target pixel can be diffused in a neighboring pixel that can have high correlation with the target pixel. Diffusing the display error into a pixel on the same scanning line also means that display errors are diffused over a wider area, which means that an image of a similar high standard to conventional error diffusion methods can be obtained.

Note that it is preferable to diffuse around 5/16–8/16 of the display error into the digital values of a pixel on the same scanning line as the target pixel at a distance of several pixels from the target pixel in the first direction, and the rest of the display error roughly equally into the digital values of the other two pixels. This distribution is used since to prevent the creation of consecutive bright pixels, a certain different needs to be maintained between the total display error diffused into heavily affected and lightly affected pixels. However, if this difference is too big, heavily affected pixels will definitely become bright, so that an undesirable pattern that reflects the arrangement of the error diffusion patterns will be observed in the display image.

From the above perspective, it is preferable for a first of the two patterns to diffuse 8/16 of the calculated display error into the digital value of the pixel that is on the same scanning line as the target pixel and 2/16, 5/16 and 1/16 of the calculated display error in order along a scanning direction respectively into the digital values of the three consecutive pixels that lie on a scanning line that is immediately below the scanning line including the target pixel, and for a second of the two patterns to diffuse 2/16 of the calculated display error into the digital value of the pixel that is on the same scanning line as the target pixel and 7/16, 1/16 and 6/16 of the calculated display error in order along the scanning direction respectively into the digital values of the three consecutive pixels that lie on a scanning line that is immediately below the scanning line including the target pixel.

Note that when the display error of a target pixel is diffused into the digital value of a pixel on a scanning line that is directly below the scanning line including the target pixel, it is assumed that the number of phases in the multiphase digital data is no greater than the number of pixels in one scanning line.

When diffusing the display error into the digital values of nearby pixels, a plurality of patterns may be interchanged along the scanning direction according to a cyclical arrangement for a number of pixels, so that a same pattern is not used for pixels that are adjacent in the scanning direction.

With the above technique, it is possible to avoid the cyclical appearance of bright pixels in the scanning direction which would lower image quality and would occur if the patterns were not interchanged.

The interchanging of patterns along the scanning direction according to a cyclical arrangement may be such that the total weighting of display errors added to adjacent pixels in the scanning direction alternates between large and small values.

With the above technique, it is possible to avoid the cyclical appearance of consecutive bright or dark pixels in the scanning direction which would lower image quality.

When diffusing the display error into the digital values of nearby pixels, a plurality of patterns may be interchanged for each scanning line, so that a same pattern is not used for pixels that are adjacent in the scanning direction or for pixels that are adjacent in a direction perpendicular to the scanning direction.

With the above technique, it is possible to avoid the cyclical appearance of bright pixels in the direction perpendicular to the scanning direction which would lower image quality and would occur if the patterns were not interchanged for each scanning line.

The interchanging of patterns for each scanning line may be such that the total weighting of display errors added to adjacent pixels in the direction perpendicular to the scanning direction alternates between large and small values.

With the above technique, it is possible to avoid the cyclical appearance of consecutive bright or dark pixels in the direction perpendicular to the scanning direction which would lower image quality.

When diffusing the display error into nearby pixels, the patterns may be changed for each TV field, so that a same pattern is not used for a same target pixel in consecutive TV fields.

With the above technique, it is possible to avoid the appearance of fixed bright and dark areas on the screen which would lower image quality and would occur if the patterns were not interchanged for each scanning line.

The interchanging of patterns for each field may be performed so that the total weighting of display errors added to a same pixel alternates between large and small values.

The above technique averages the display time of light pixels and dark pixels and so enables intermediate color to be displayed.

The interchanging of patterns for consecutive scanning lines and for a same scanning line in different TV fields may be random.

By doing so, it is possible to prevent the occurrence of undesirable patterns of regularly appearing bright or dark pixels that may be observed in a moving image.

A motion detection unit may also be used and the switching of patterns may be controlled in accordance with whether motion has been detected by the motion detection unit.

With the above technique, optimal switching of patterns can be achieved for both moving and still images.

In parts of an input image where the motion detection unit detects no motion, the patterns may be cyclically interchanged so that a same pattern is not used for pixels that are adjacent in the scanning direction, for pixels that are adjacent in a direction perpendicular to the scanning direction, and for a same pixel in different TV fields.

With the above technique, bright pixels and dark pixels can be averaged both spatially and over time, so that smooth color gradations can be displayed, with the additional suppression of noise which would occur if the patterns were interchanged at random.

In parts of an input image where the motion detection unit detects motion, the patterns may be cyclically interchanged so that a same pattern is not used for pixels that are adjacent in the scanning direction, and patterns may be randomly interchanged for pixels that are adjacent in a direction perpendicular to the scanning direction and for a same pixel in different TV fields.

If patterns are interchanged in moving parts of an image, checkerboard patterns may be observed as the viewer's eyes follow the moving image. However, if patterns are randomly interchanged for pixels that are adjacent in a direction perpendicular to the scanning direction and for a same pixel in different TV fields, such phenomenon can be avoided.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIGS. 12A–12D show the values that should be used by the multiplication units and delay units in each calculation unit;

FIG. 37 is a table showing the combinations of signals inputted into a calculation unit;

FIG. 39 shows the values that should be used by the multiplication units and delay units in each calculation unit;

FIG. 40 shows the values that should be used by the multiplication units and delay units in each calculation unit;

FIG. 41 shows the values that should be used by the multiplication units and delay units in each calculation unit;

FIG. 42 shows the values that should be used by the multiplication units and delay units in each calculation unit;

DESCRIPTION OF THE PREFERRED EMBODIMENTS

First Embodiment

The following is a detailed description of a multilevel image display method that is a first embodiment of the present invention. This description refers to the attached drawings.

Figure 1:
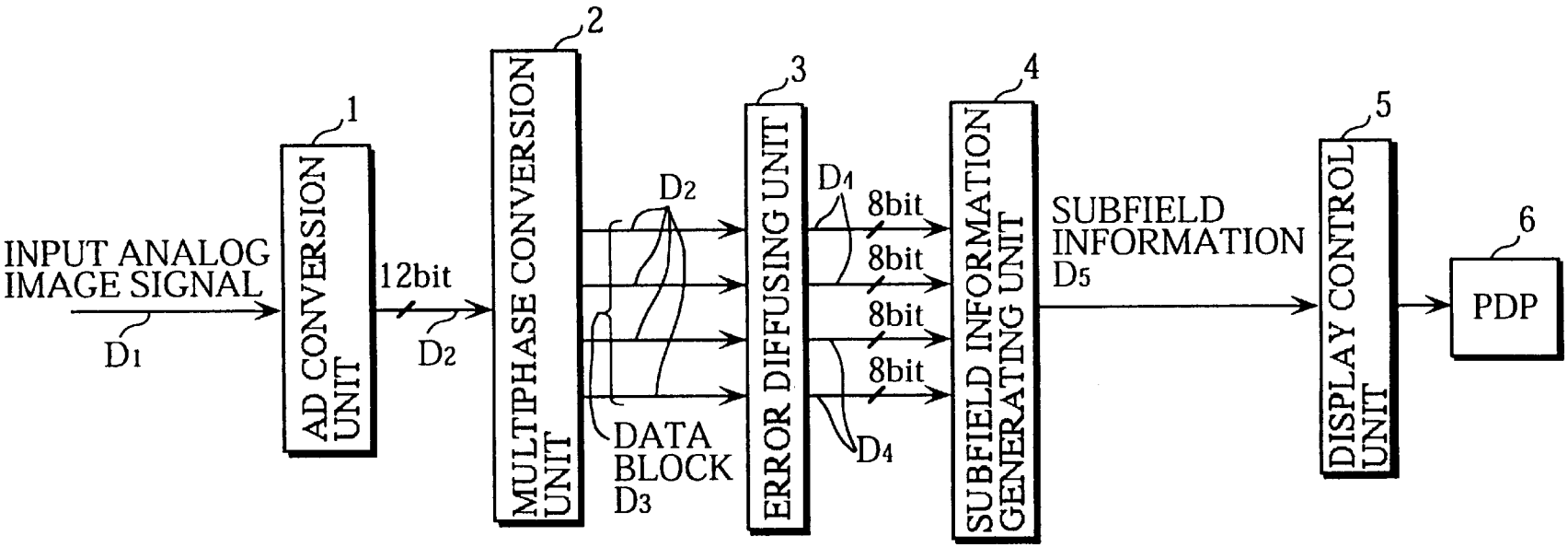
FIG. 1 is a block diagram showing the construction of a multilevel image display apparatus that uses the display method of this first embodiment.

FIG. 1 is a block diagram showing the construction of a multilevel image display apparatus that uses the display method of this first embodiment.

As shown in FIG. 1, this multilevel image display apparatus includes an AD (analog-digital) conversion unit 1, a multiphase conversion unit 2, an error diffusing unit 3, a subfield information generating unit 4, a display control unit 5, and a PDP 6 as one example of a display panel.

Figure 2:
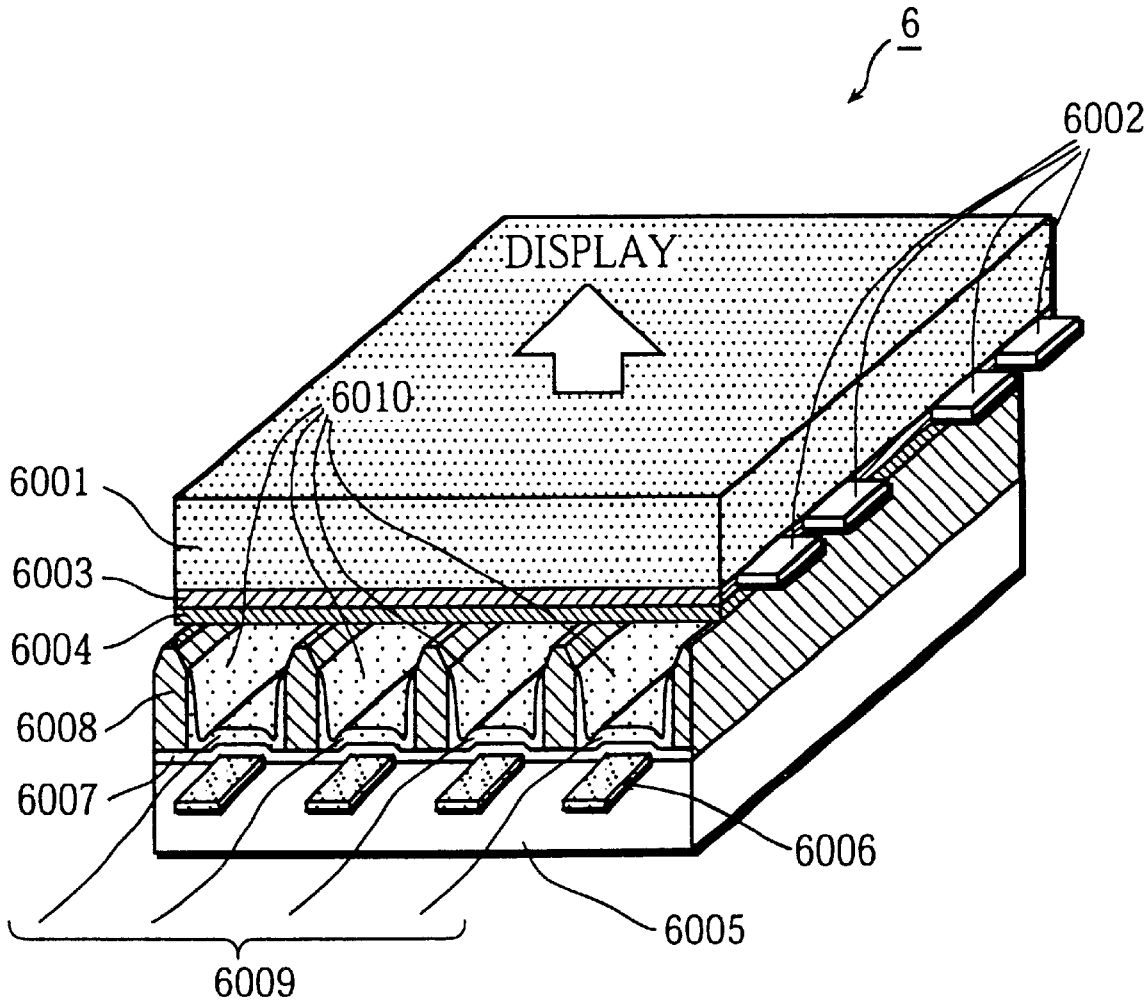
FIG. 2 is a perspective drawing showing the construction of the PDP used by the present multilevel image display apparatus.

FIG. 2 is a perspective drawing showing the construction of the PDP 6 used by the present multilevel image display apparatus.

As shown in FIG. 2, scanning discharge maintaining electrode pairs 6002 are formed on the front glass panel 6001 that is manufactured from borosilicate glass according to a float method. A dielectric glass layer 6003 that acts as a capacitor is then formed on the front glass panel 6001 and scanning discharge maintaining electrode pairs 6002 and is itself covered with a magnesium oxide (MgO) protective layer 6004. Address electrodes 6006 and a dielectric glass layer 6007 are formed on the rear glass plate 6005. Partition walls 6008 and a phosphor layer 6009 are then formed on top of these, and discharge gas is sealed into the spaces between the partition walls 6008 to form discharge spaces 6010. To simply matters, a monochrome display is described in the present embodiment, although a PDP that displays a color image using the three colors red (R), green (G), and blue (B) may be used in the same way.

The AD conversion unit 1 is a circuit for converting the input analog image signal D1, which is serially inputted, into serial digital data D2 that expresses each pixel value uses a predetermined number of bits, such as 12 bits. Note that the analog image signal D1 is assumed here to be a CRT (cathode ray tube) signal that has a $\gamma$ component (where $\gamma$=2.2) with respect to the original image signal. Accordingly, a $\gamma$ correction circuit for correcting the input analog image signal D1 so that the display signal and the original input signal have a linear ($\gamma$=1) input-output relation is provided on the input side of the AD conversion unit 1. Note that the input analog image signal D1 refers to the signal that is outputted by this $\gamma$ correction circuit.

The multiphase conversion unit 2 gathers together a certain number of consecutive (pixel) values in the digital data D2 outputted by the AD conversion unit 1 to produce data blocks (data blocks D3, a data block being the name given to the data resulting from the multiphase conversion of a certain number of consecutive values) and outputs the digital values in each data block in parallel. This multiphase conversion unit 2 will usually be composed of a shift register that performs a serial-to-parallel conversion. The plurality of digital values that are outputted in parallel are respectively called the phase 1 data, the phase 2 data, the phase 3 data, the phase 4 data . . . . The speed at which the digital values need to be processed falls in proportion with the number of digital values inserted into each data block by this multiphase conversion unit 2. As one example, when each data block includes four digital values, the data processing can be performed at one quarter of the normal speed.

Figure 3:
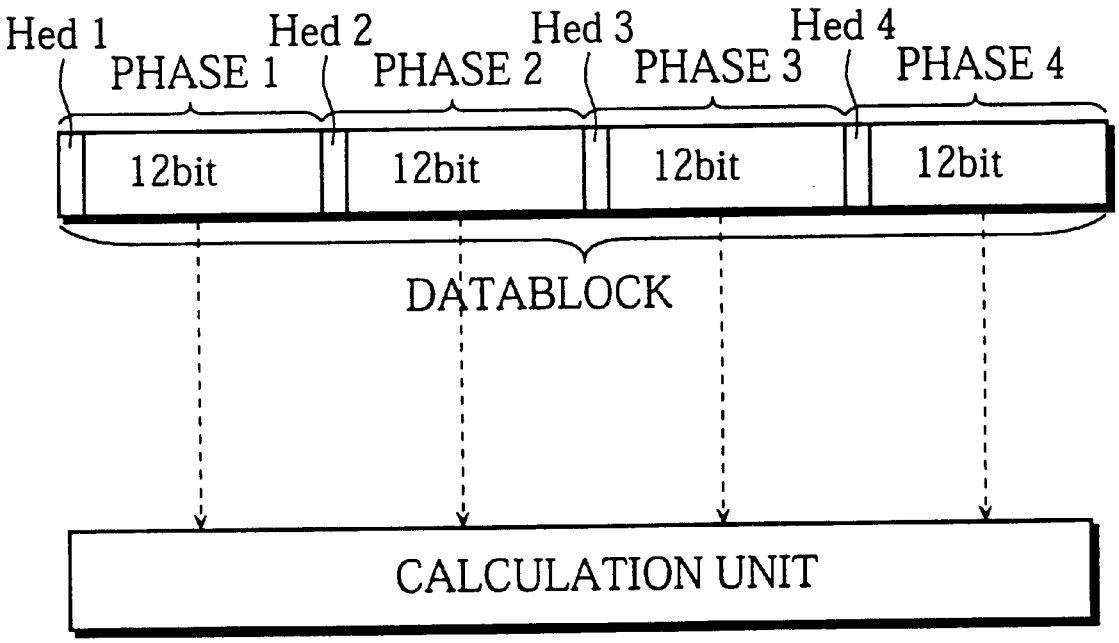
FIG. 3 shows the data construction of a data block.

As shown in FIG. 3, the position ("phase") of each digital value in a data block is indicated by the addition of the headers Hed1 (phase 1), Hed2 (phase 2), Hed3 (phase 3), and Hed4 (phase 4) to the digital values. Here, the error diffusing unit 3 uses a convention where the digital values are assigned ascending phase values in the order in which they are inputted.

The construction and operation of the error diffusing unit 3 are described in detail later in this specification. In short, the error diffusing unit 3 performs processing in units of one TV field to diffuse a display error for each 12-bit digital value D2 in a data block D3 into surrounding pixels. Here, the switching between the calculations for single TV fields is performed based on the vertical synch signal. This error diffusing unit 3 outputs the 8-bit pixel values D4.

Figure 4:
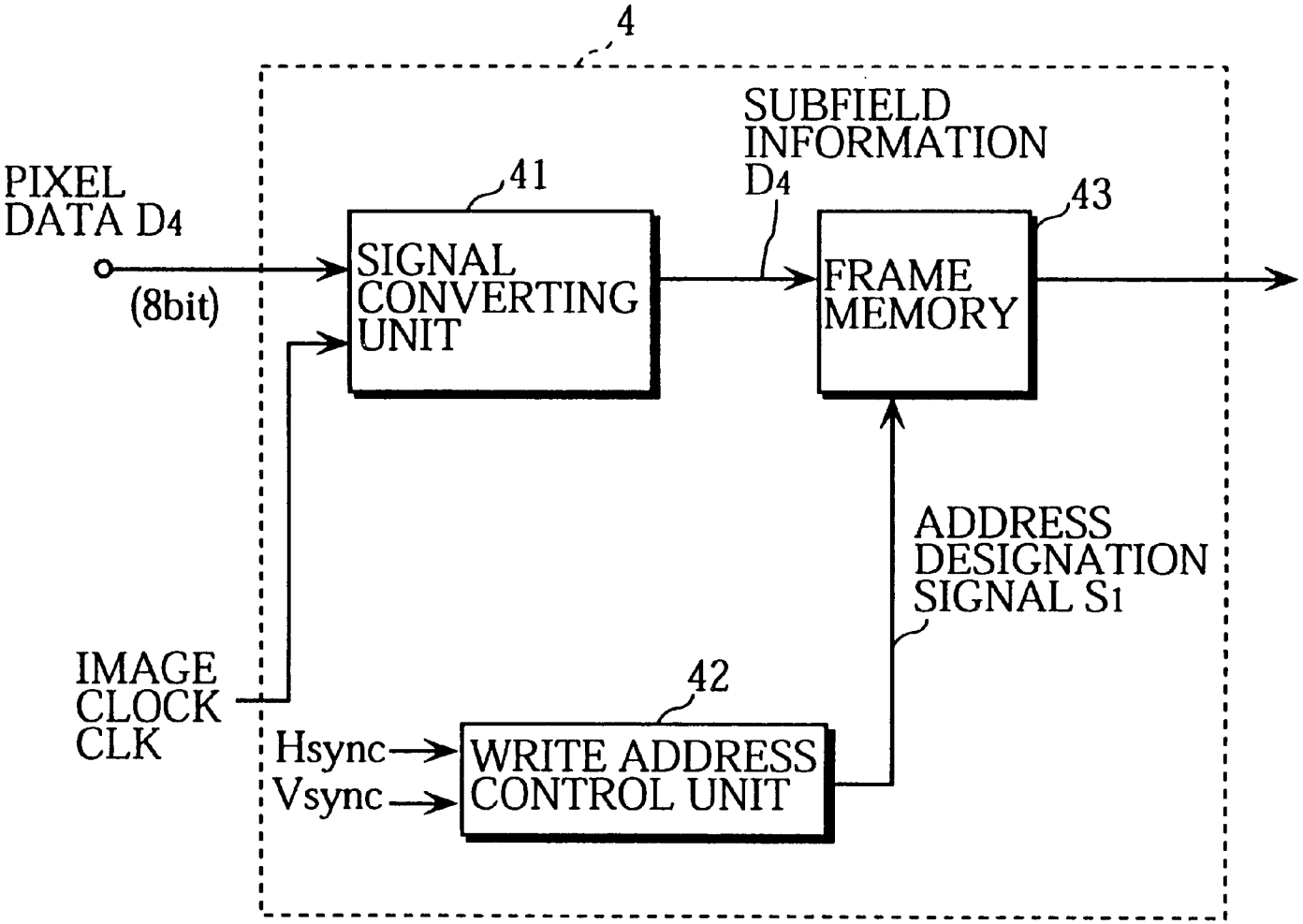
FIG. 4 is a block diagram showing the construction of the subfield information generating unit in the present multilevel image display apparatus.

FIG. 4 is a block diagram showing the construction of the subfield information generating unit 4.

As shown in FIG. 4, the subfield information generating unit 4 is composed of a signal converting unit 41, a write address control unit 42, and a frame memory 43.

The write address control unit 42 generates the address designation signal S1 for designating the write address for the frame memory 43 based on the horizontal synch signal Hsync and the vertical synch signal Vsync that have been separated from the input analog image signal D1.

The signal converting unit 41 converts the pixel values D4 outputted by the error diffusing unit 3 into the subfield information D5 (in this example, 8-bit data) that has predetermined luminance weightings. the signal converting unit 41 performs this conversion using a look up table (LUT) that associates each potential pixel value D4 with the appropriate subfield information D5. Note that since the data is outputted from the error diffusing unit 3 in units of data blocks, the conversion for each pixel value requires that each entire image is temporarily stored in a memory (not illustrated), with the conversion being performed by reading one pixel at a time from this memory.

The subfield information D5 is a collection of single bits that show whether each time zone in a TV field (i.e., each subfield) should be on or off. The subfield information generating process for one pixel value is performed in synchronization with a pixel clock CLK generated by a PLL (phase locked loop) circuit (not illustrated). The subfield information that is generated for each pixel value is written into the address in the frame memory 43 that is designated by the address designating signal S1 outputted by the write address control unit 42. Here, data is written for each line, pixel, subfield, and frame (TV field).

Figure 5:
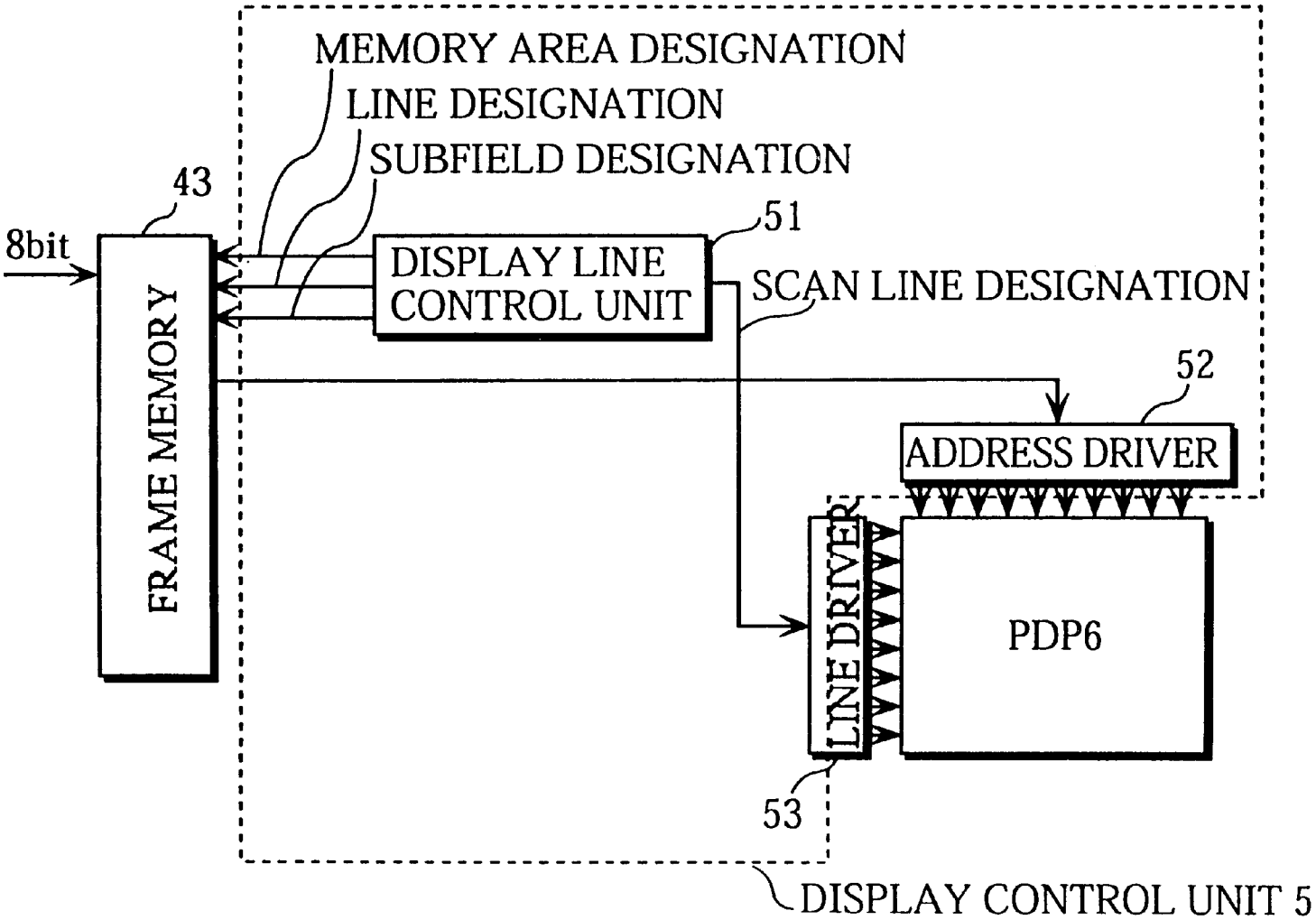
FIG. 5 is a block diagram showing the construction of the display control unit of the present multilevel image display apparatus.

As shown in FIG. 5, the display control unit 5 is composed of a display line control unit 51, an address driver 52, and a line driver 53.

The display line control unit 51 informs the frame memory 43 of the memory area, line, and subfield that should be read out to the PDP 6 and informs the PDP 6 of the line which should be scanned.

The address driver 52 converts the subfield information for each line into address pulses, based on the designations of the memory area, read line, and subfield given by the display line control unit 51. The address driver 52 then outputs the resulting address pulses.

The line driver 53 uses scan pulses to designate the line of the PDP 6 onto which the subfield information should be written.

Figure 6:
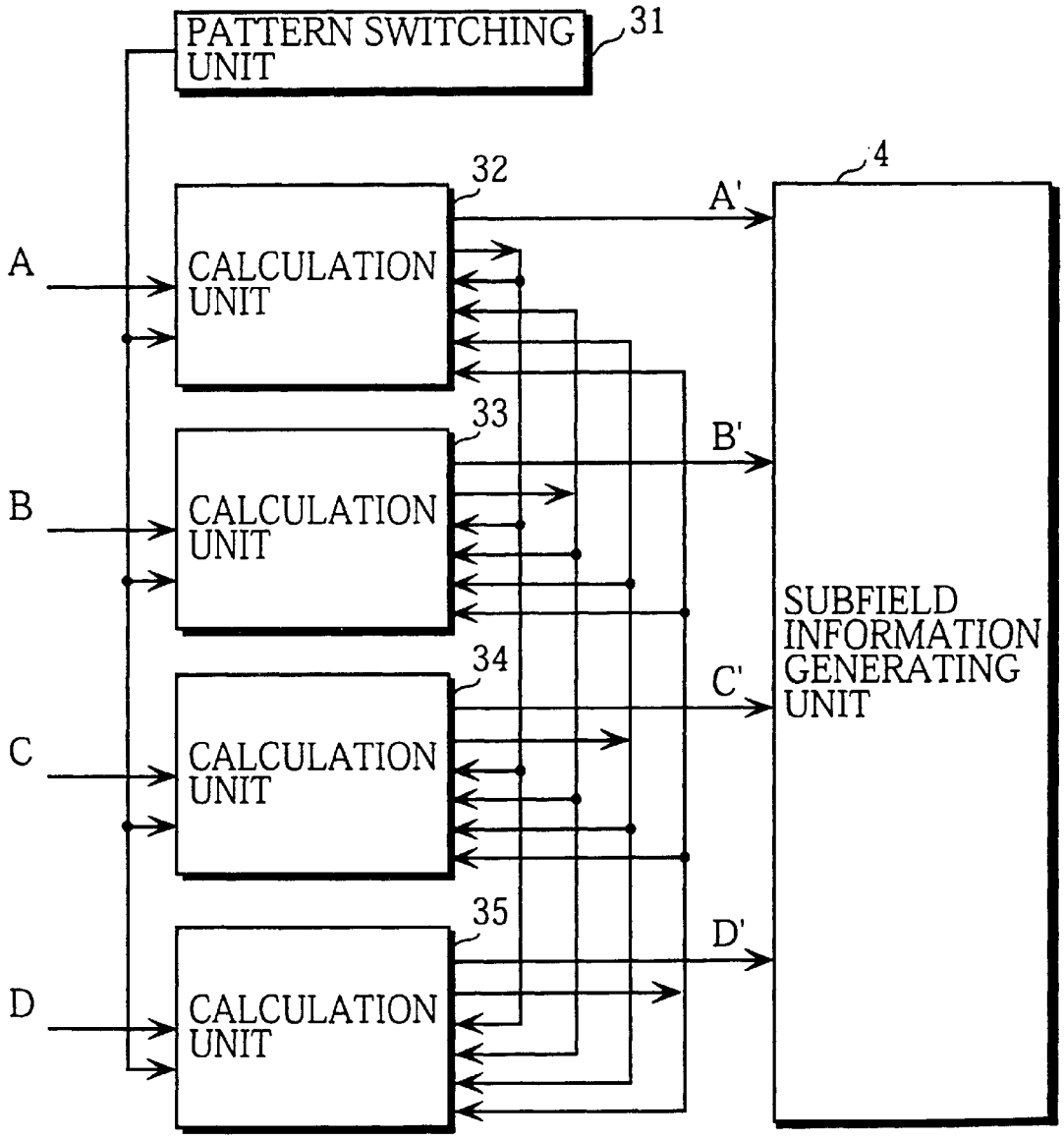
FIG. 6 is a block diagram showing the construction of the error diffusing unit of the present multilevel image display apparatus.

FIG. 6 is a block diagram showing the construction of the error diffusing unit 3. Note that the present explanation deals with the case where the pixel values are converted into 4-phase data. Accordingly, lines A, B, C, and D in FIG. 6 show the pixel data of phase 1, phase 2, phase 3, and phase 4 in that order.

As shown in FIG. 6, the error diffusing unit 3 includes the pattern switching unit 31 and the calculation units 32–35.

The pattern switching unit 31 is a circuit for switching between two error diffusion patterns for each line with appropriate timing. This switching for each line can be performed by counting horizontal synch signals or by counting a certain number of pixels.

The calculation units 32–35 each receive one of the phase 1, phase 2, phase 3, and phase 4 data, perform an error diffusion calculation for the corresponding phase and output the respective 8-bit data A', B', C', D', to the subfield information generating unit 4. Here, two error diffusion patterns (described later) are alternately used for each pixel in the horizontal (scanning) direction. Note that the inputting of the pixel values A, B, C, and D (that equate to the phases) into the calculation units 32–35 is performed by a data distributing unit (not illustrated). This data distributing unit refers to the header data of each pixel value to determine the phase of each pixel value and inputs each pixel value into the appropriate calculation unit out of the calculation units 32–35.

FIG. 7 shows the two error diffusion patterns mentioned above. The cells in this drawing represent pixels on the PDP 6.

As shown in FIG. 7, the error diffusion patterns A and B are both patterns that diffuse the display error of the target pixel into four pixels. In pattern A, the display error of the target pixel Pa is diffused into the pixel (Pa1) directly below the target pixel Pa, the pixel (Pa2) to the left of the pixel Pa1, and the next two pixels (Pa3,Pa4) to the right of the pixel Pa1. Similarly, in pattern B, the display error of the target pixel Pb is diffused into the pixel (Pb1) directly below the target pixel Pb, the pixel (Pb2) to the left of the pixel Pb1, and the next two pixels (Pb3,Pb4) to the right of the pixel Pb1.

The difference between pattern A and pattern B lies in weightings used to diffuse the display error to these other pixels. In pattern A, the weightings used when diffusing the display error to the pixels Pa2, Pa1, Pa3, Pa4 are 3/16, 6/16, 2/16, and 5/16, which is to say, small, large, small, large. Conversely, the weightings used when diffusing the display error to the pixels Pb2, Pb1, Pb3, Pb4 are 6/16, 2/16, 6/16, and 2/16, which is to say, large, small, large, small. In the explanation of these error diffusion patterns, the display errors are described as being diffused into pixels (these being visual representations of the image, such as the cells of a PDP) that compose the image displayed on the panel, although the display error (4 bits) is in fact diffused directly into the (12-bit) values in the digital data D2 that correspond to these pixels.

Figure 8:
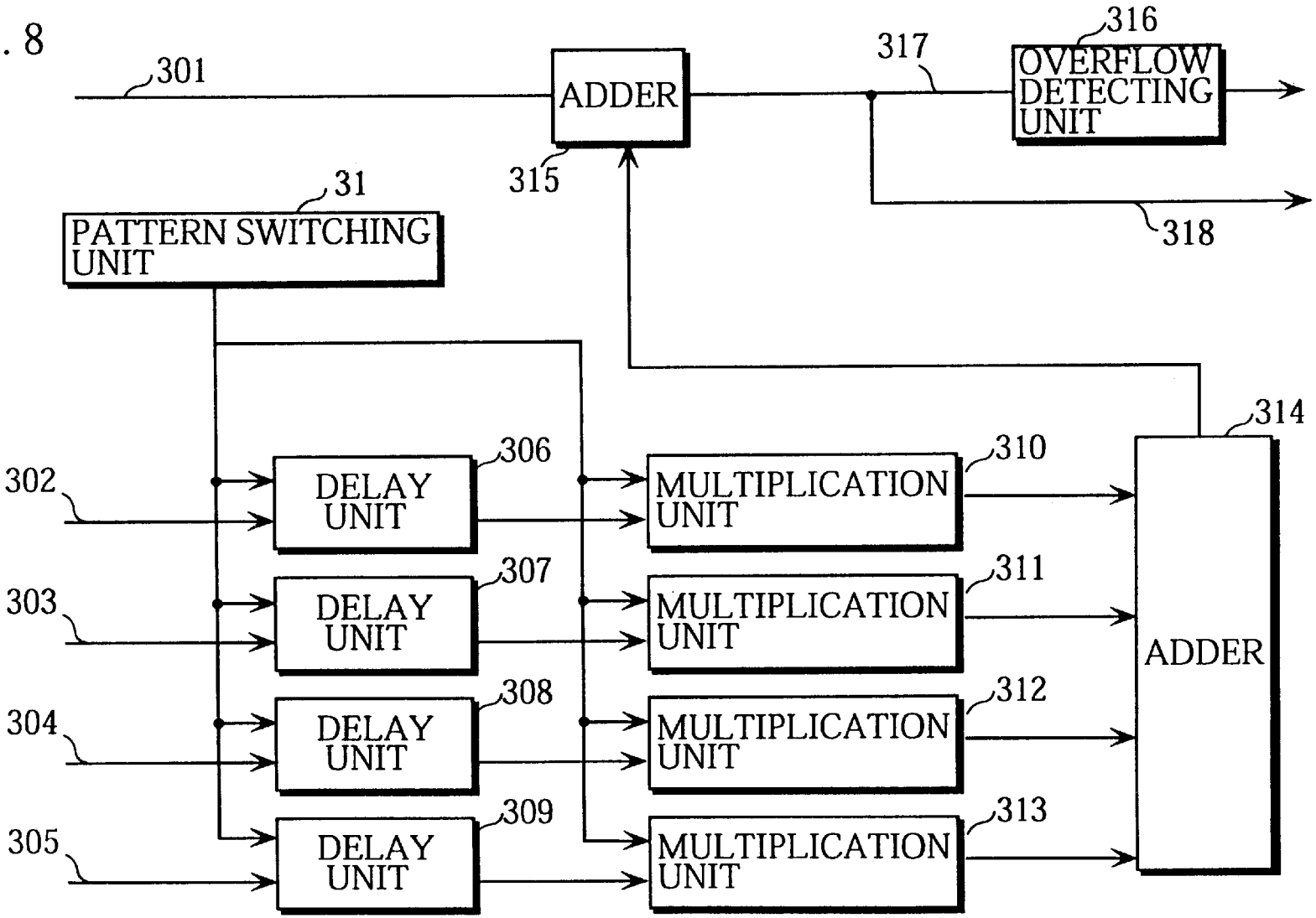
FIG. 8 shows the structure of each of the calculation units in the error diffusing unit.

FIG. 8 shows the common structure of each of the calculation units 32–35.

Each calculation unit includes the delay units 306–309, the multiplication units 310–313, the adder 314, 315, and the overflow detecting unit 316. While the calculation units 32–35 have a common structure, the delays used by the delay units in each are different, as are the coefficients used by the multiplication units.

In FIG. 8, numeral 301 show a circuit line that inputs a 12-bit digital value, while numeral 302 shows a circuit line that inputs the display error signal (i.e., the error generated by phase 1) transferred from the calculation unit 32, numeral 303 shows a circuit line that inputs the display error signal (i.e., the error generated by phase 2) transferred from the calculation unit 33, numeral 304 shows a circuit line that inputs the display error signal (i.e., the error generated by phase 3) transferred from the calculation unit 34, and numeral 305 shows a circuit line that inputs the display error signal (i.e., the error generated by phase 4) transferred from the calculation unit 35. Numeral 317 shows the output line of the adder 315, on which 12- or 13-bit data is carried depending on whether a carry is produced. Numeral 318 shows a branch line that passes the lower 4-bits of the output of the adder 315 over to other calculation units.

The delay units 306–309 are delay circuits that have delays of up to "1H". These delay values are set differently in different calculation units.

The multiplication units 310–313 use different coefficients depending on which of pattern A and pattern B is being used. This is described later in this text.

The overflow detecting unit 316 discards the lower 4 bits of the value received via the signal line 317 and outputs the remaining data. If the remaining data is a 9-bit value, the overflow detecting unit 316 converts the value into an 8-bit value before output.

The following describes the processing for error diffusion in detail. Note that while the above explanation has focused on the positional relationship between the target pixel and the pixels into which the display error of the target pixel is diffused, the following explanation will focus on the positional relationship between the target pixel and the pixels which diffuse a display error into the target pixel.

Figure 9:
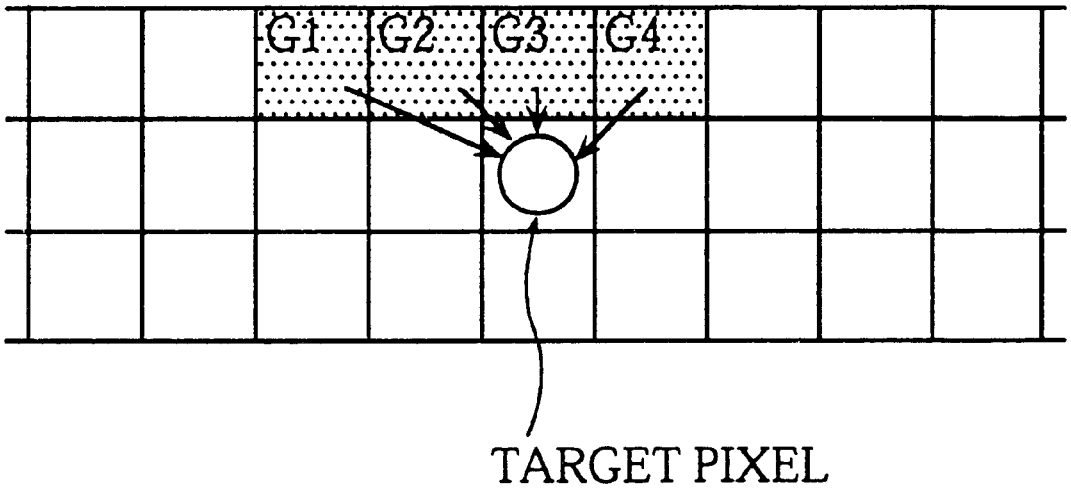
FIG. 9 shows the pixels that diffuse a display error into the target pixel.

When the target pixel is the pixel marked with the circle in FIG. 9, the pixels that will diffuse a display error into this target pixel, regardless of whether pattern A or pattern B is being used will be the pixels G1, G2, G3, and G4.

Figure 10:
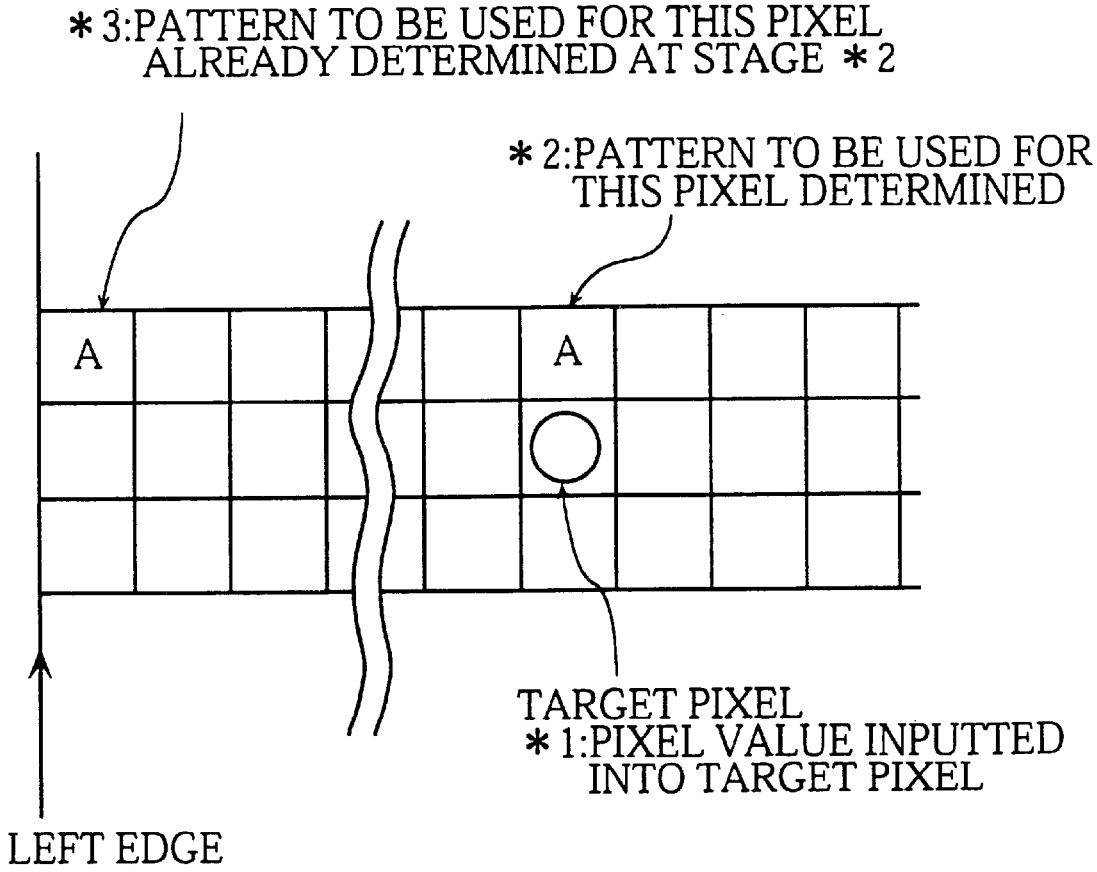
FIG. 10 shows a method for determining the arrangement of error diffusion patterns.

Since it only becomes necessary to determine the magnitudes of the errors that should be added to the target pixel after the pixel value of the target pixel has been inputted, the coefficients used by the multiplication units may be determined at this juncture. This means that the error diffusion patterns to be applied to the pixels on the line above the target pixel only need to be determined when the pixel value of the target pixel is processed. However, since the error diffusion pattern is selected so that the patterns A and B alternate in the horizontal direction, error diffusion patterns for all of the pixels on a line are effectively determined by selecting the error diffusion pattern for the leftmost pixel on the line (See FIG. 10).

Figure 11:
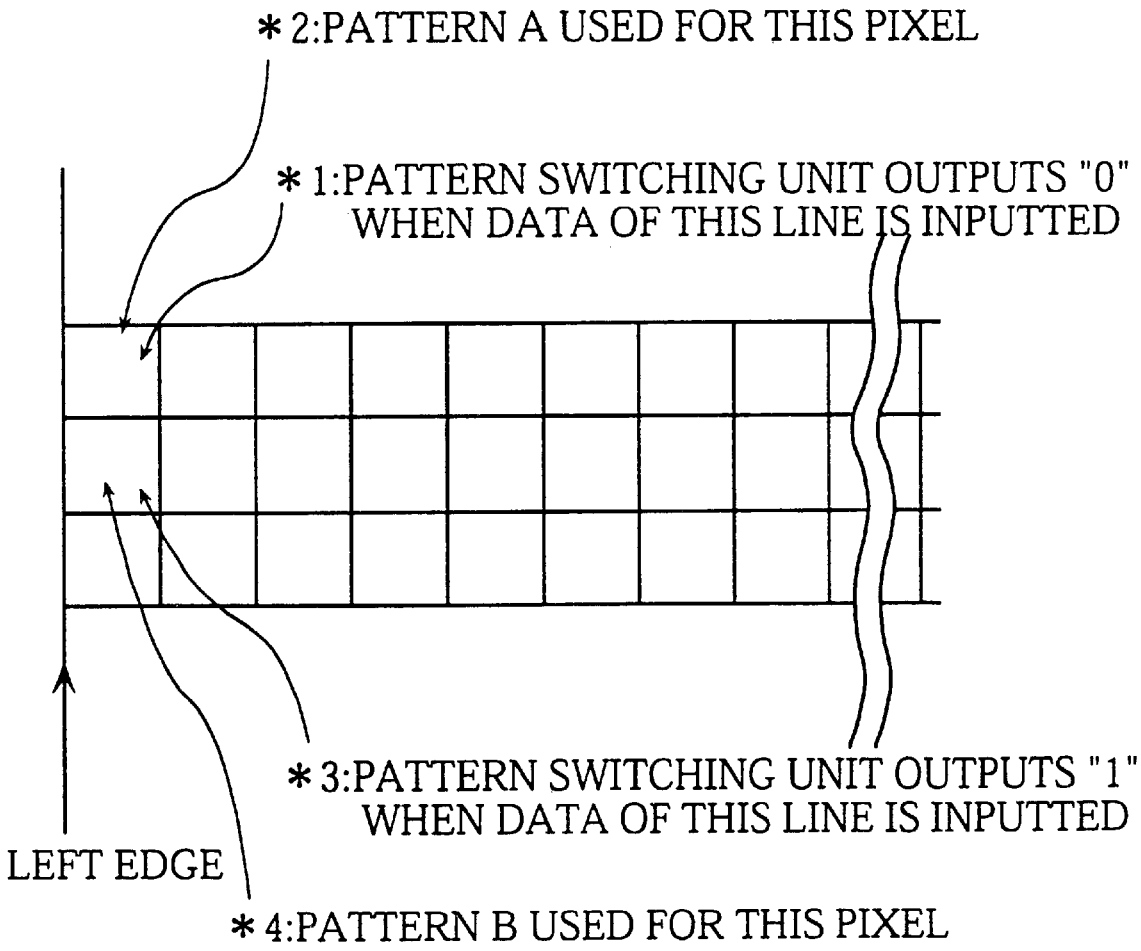
FIG. 11 shows a method for determining the arrangement of error diffusion patterns.

As shown in FIG. 11, this means that the pattern switching unit 31 outputs one of the two values "0" and "1" for each line, with the value "0" showing that pattern A is used as error diffusion pattern for the leftmost pixel on a line and the value "1" showing that pattern B is used as error diffusion pattern for the leftmost pixel on a line (note that in FIG. 11, the legends numbered *1, *2, *3, and *4 should be read in that order). In this way, the error diffusion pattern selected for each phase in each data block is unanimously determined, meaning that the circuit constants of the calculation units can be determined based on the output value of the pattern switching unit 31.

As shown in FIG. 12, the coefficients used by each of the multiplication units in the calculation units are determined according to the output of the pattern switching unit 31. In FIG. 12, the symbol "D" represents a delay circuit that delays a value by one data cycle, while the symbol "H" represents a delay circuit that delays a value by a time equivalent to one horizontal cycle.

Figure 13:
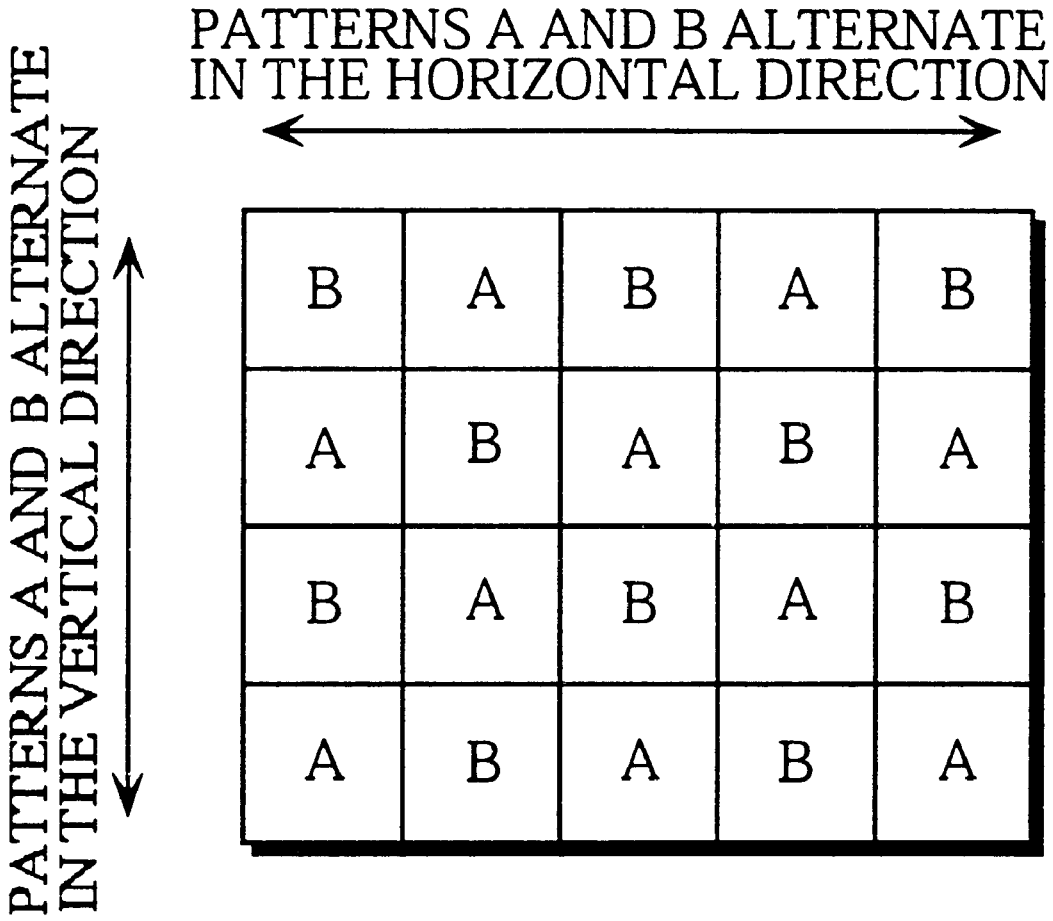
FIG. 13 shows an arrangement of the error diffusion patterns shown in FIG. 7 for each pixel.
Figure 14:
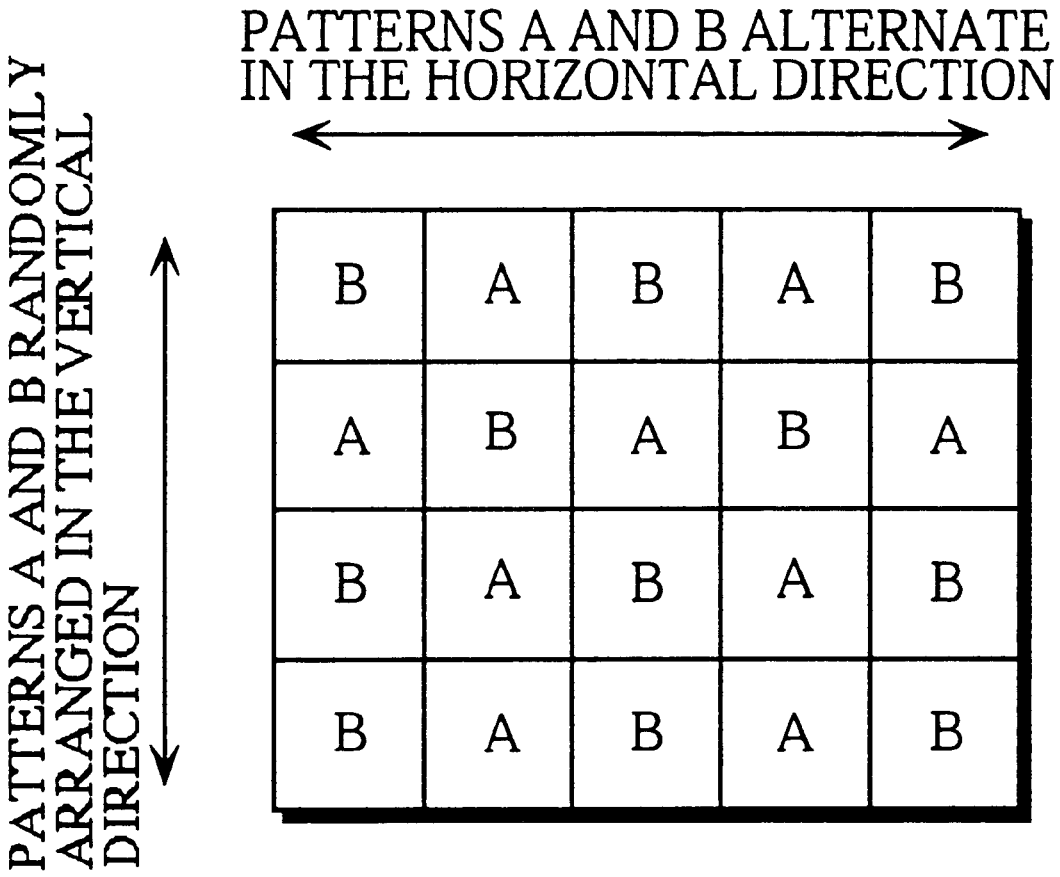
FIG. 14 shows an arrangement of the error diffusion patterns shown in FIG. 7 for each pixel.

As shown in FIG. 13, the alternation of the output values of the pattern switching unit 31 on each line results in the error diffusion patterns selected for each pixel value forming a checkerboard pattern. Alternatively, if the error diffusion pattern is randomly selected for each pixel, the error diffusion patterns alternate in the horizontal direction but are random in the vertical direction, as shown in FIG. 14.

Figure 15:
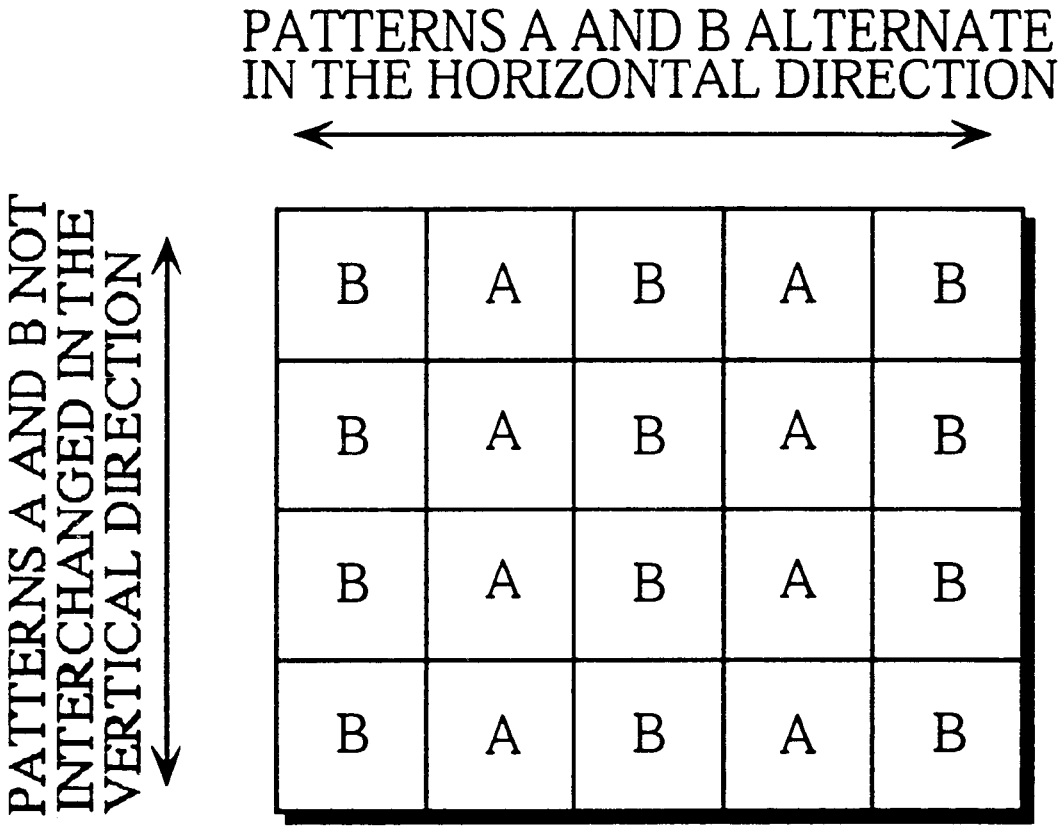
FIG. 15 shows an arrangement of the error diffusion patterns shown in FIG. 7 for each pixel.

If the output of the pattern switching unit 31 is fixed at "0" or "1", the error diffusion patterns selected for each pixel value form the pattern shown in FIG. 15. An alternating output of "0" or "1", however, with inversion for each TV field (frame) results in the patterns shown in FIG. 16.

The following describes the error diffusion processing in detail.

Figure 17:
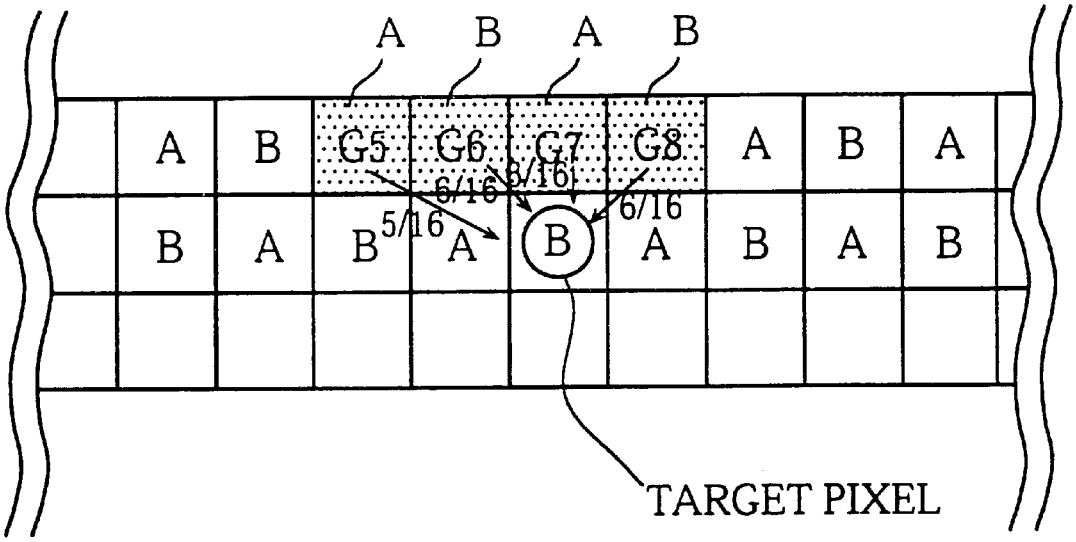
FIG. 17 shows the diffusion of errors with the present circuit construction.

This example assumes that the pattern A and pattern B are alternately used for pixels, as shown by the checkerboard pattern in FIG. 17.

Regardless of whether pattern A or pattern B is used, the pixels whose display error will be diffused into the target pixel marked with a circle will be the pixels G5–G8. As shown in FIG. 17, the error diffusion pattern for the target pixel itself is pattern B.

The following error components will be diffused into this target pixel:

5/16 of the display error of the pixel G5;

6/16 of the display error of the pixel G6;

6/16 of the display error of the pixel G7; and

6/16 of the display error of the pixel G8.

If pixel G5 is a pixel corresponding to phase 1 in a data block, the digital value of all of the pixels G5–G8 will be inputted simultaneously into the error diffusing unit 3. As a result, the digital value of the target pixel will be inputted into the error diffusing unit 3 a time "1H" after the digital value of the pixel G5, a time "1H" after the digital value of the pixel G6 a time "1H" after the digital value of the pixel G7, and a time "1H" after the digital value of the pixel G8. In this case, the delays that should be used by the delay circuits will be as shown by the column "0" in FIG. 12C.

If pixel G5 is a pixel corresponding to phase 2 in a data block, the digital value of pixel G8 will be inputted into the error diffusing unit 3 one data cycle behind the digital values of the pixels G5–G7. As a result, the digital value of the target pixel will be inputted into the error diffusing unit 3 at a time "1H" after the digital value of the pixel G5, "1H" after the digital value of the pixel G6, "1H" after the digital value of pixel G7, and "(1H−1D)" after the digital value of pixel G8. In this case, the delays used by the delay circuits will be as shown by the column "1" in FIG. 12D.

If pixel G5 is a pixel corresponding to phase 3 in a data block the digital values of pixel G5 and G6 will be inputted into the error diffusing unit 3 one data cycle ahead of the digital values of the pixels G7 and G8. As a result, the digital value of the target pixel will be inputted into the error diffusing unit 3 at a time "(1H+1D)" after the digital value of pixel G5, "(1H+1D)" after the digital value of pixel G6, "1H" after the digital value of pixel G7, and "1H" after the digital value of pixel G8. In this case, the delays that should be used by the delay circuits will be as shown by the column "0" in FIG. 12A.

If pixel G5 is a pixel corresponding to phase 4 in a data block, the digital value of pixel G5 will be inputted into the error diffusing unit 3 one data cycle ahead of the digital values of the pixels G6–G8. As a result, the digital value of the target pixel will be inputted into the error diffusing unit 3 at a time "(1H+1D)" after the digital value of pixel G5, "1H" after the digital value of pixel G6, "1H" after the digital value of pixel G7, and "1H" after the digital value of pixel G8. In this case, the delays that should be used by the delay circuits will be as shown by the column "1" in FIG. 12B.

In this way, the delays used by the delay circuits are determined in accordance with the phase of the target pixel marked with the circle in the drawings. Note that this example assumes that the relationship between the phase of the pixel G5 to the phase of the target pixel is constant.

In this way, the pixel value of the target pixel is inputted into the adder 314 at the same time as:

5/16 of the display error of the pixel G5 that has been suitably delayed;

6/16 of the display error of the pixel G5 that has been suitably delayed;

6/16 of the display error of the pixel G7 that has been suitably delayed; and

6/16 of the display error of the pixel G8 that has been suitably delayed.

Figure 7A:
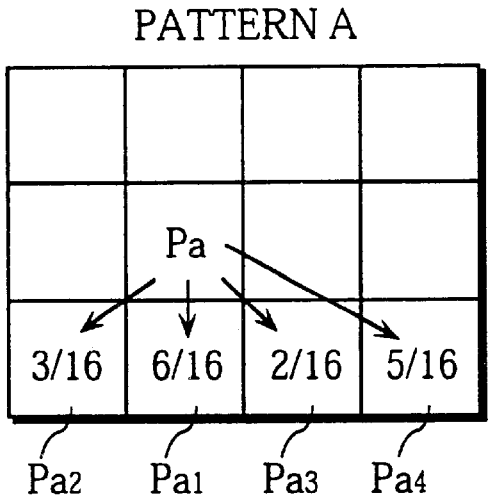
FIGS. 7A and 7B show two error diffusion patterns.
Figure 7B:
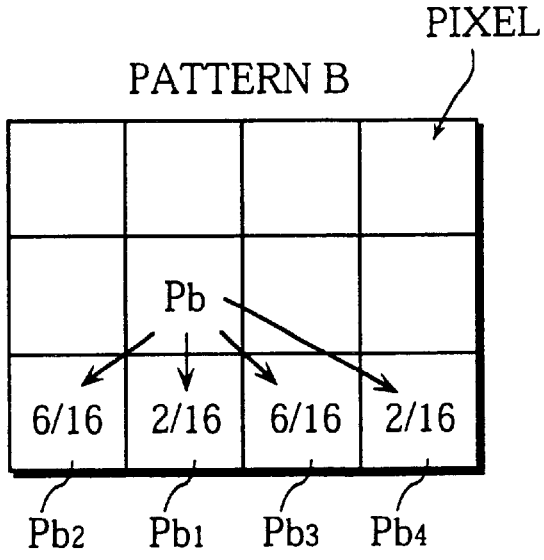

The above construction enables error diffusion to be performed when multiphase digital data is inputted. The conventional error diffusion process described above only attempts to diffuse the display error into the pixel on the right of the target pixel, so that such a system is unable to perform error diffusion to obtain signal values for digital values that are input in parallel as the four phases 1–4. The present construction does not diffuse the display error of the target pixel into the pixel to the right of the target pixel, but, as shown in FIGS. 7A and 7B, diffuses the display error into the neighboring pixels on the line below the target pixel, and so is able to manufacture an interval of around one data cycle or longer for performing the calculation processing for the error diffusion. As a result, when the inputted digital data is multiphase, the processing for error diffusion can be performed separately for the digital value of each phase in a data block.

Here, if the magnitudes of the errors diffused into each pixel were determined according to only one pattern, such as pattern A, light pixels and dark pixels would be consecutively generated in the horizontal direction, which would lower image quality.

On the other hand, if the magnitudes of the diffused errors are determined by alternating two patterns, such as patterns A and B, in the horizontal direction, the total error diffused into the line that is immediately below the target pixel will alternate between large and small values, such as in the sequence 23/16, 9/16, 23/16, 9/16 . . . that is produced when the patterns A and B are used. Pixels where the diffused error is large have a higher probability of being light, while pixels where the diffused error is small have a higher probability of being dark.

By using error diffusion patterns in this way, a succession of light pixels is not produced in the horizontal direction. Dark and light pixels alternate, so that deterioration in image quality is avoided. By changing the combinations of the weightings included in the error diffusion patterns, fluctuations in the total error weighting can be increased or decreased. A sequence where 27/16 and 5/16 alternate, a sequence where 25/16 and 7/16 alternate, and a sequence where 21/16 and 11/16 alternate are example sequences of the total weighting diffused into target pixels by the combination of error diffusion patterns.

As started above, the error diffusion patterns A and B do not need to be arranged into a regular order in the vertical direction, and so may randomly change for adjacent lines. If the output value of the pattern switching unit 31 changes randomly between lines, bright and dark spots can also be distributed in the vertical direction. By doing so, deterioration in image quality due to a cyclical distribution of bright spots over the image in the vertical direction can be avoided.

If the error diffusion patterns A and B are made to alternate in the vertical direction, which is to say, if the output value of the pattern switching unit 31 alternates between "0" and "1" for adjacent lines, a checkerboard pattern of the error diffusion patterns A and B is formed as shown in FIG. 13. Deterioration in the image due to successions of light pixels in the horizontal or vertical directions can therefore be avoided.

Figure 16:
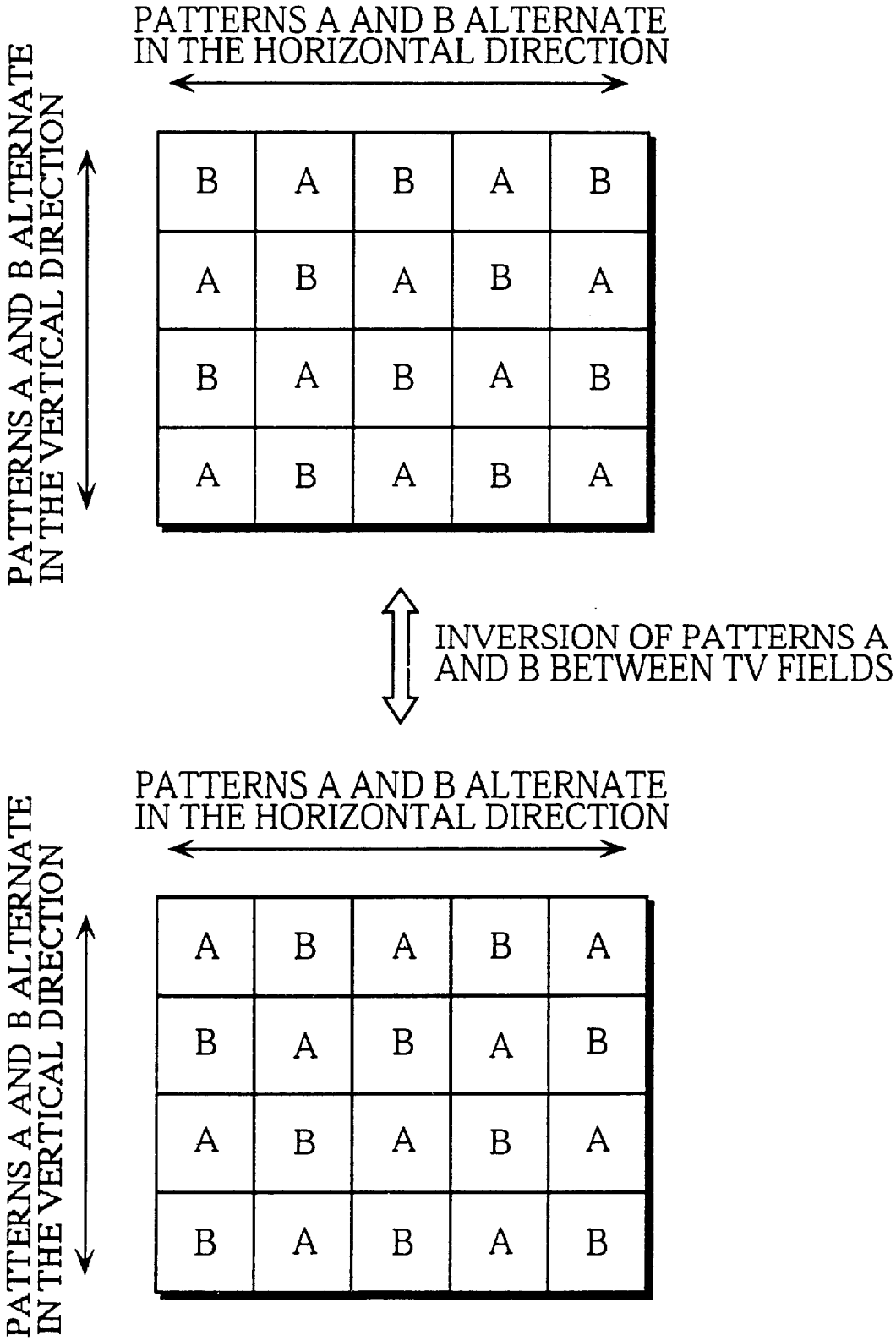
FIG. 16 shows an arrangement of the error diffusion patterns shown in FIG. 7 for each pixel.

If the checkerboard pattern of error diffusion patterns is inversed for each TV field, as shown in FIG. 16, the checkerboard pattern can be made less conspicuous than when the application of the patterns A and B is not inversed for each TV field.

Also if the error diffusion patterns are not changed in the vertical direction, as shown in FIG. 15, the pattern switching unit 31 does not need to be provided, which simplifies the construction of the circuitry required to perform the calculation processing.

Second Embodiment

The following describes a multilevel image display apparatus that uses the multilevel image display method of the second embodiment of the present invention. Note that this apparatus only differs from the multilevel image display apparatus of the first embodiment in the construction of the error diffusing unit 3, so that the explanation will focus on this difference.

Figure 18:
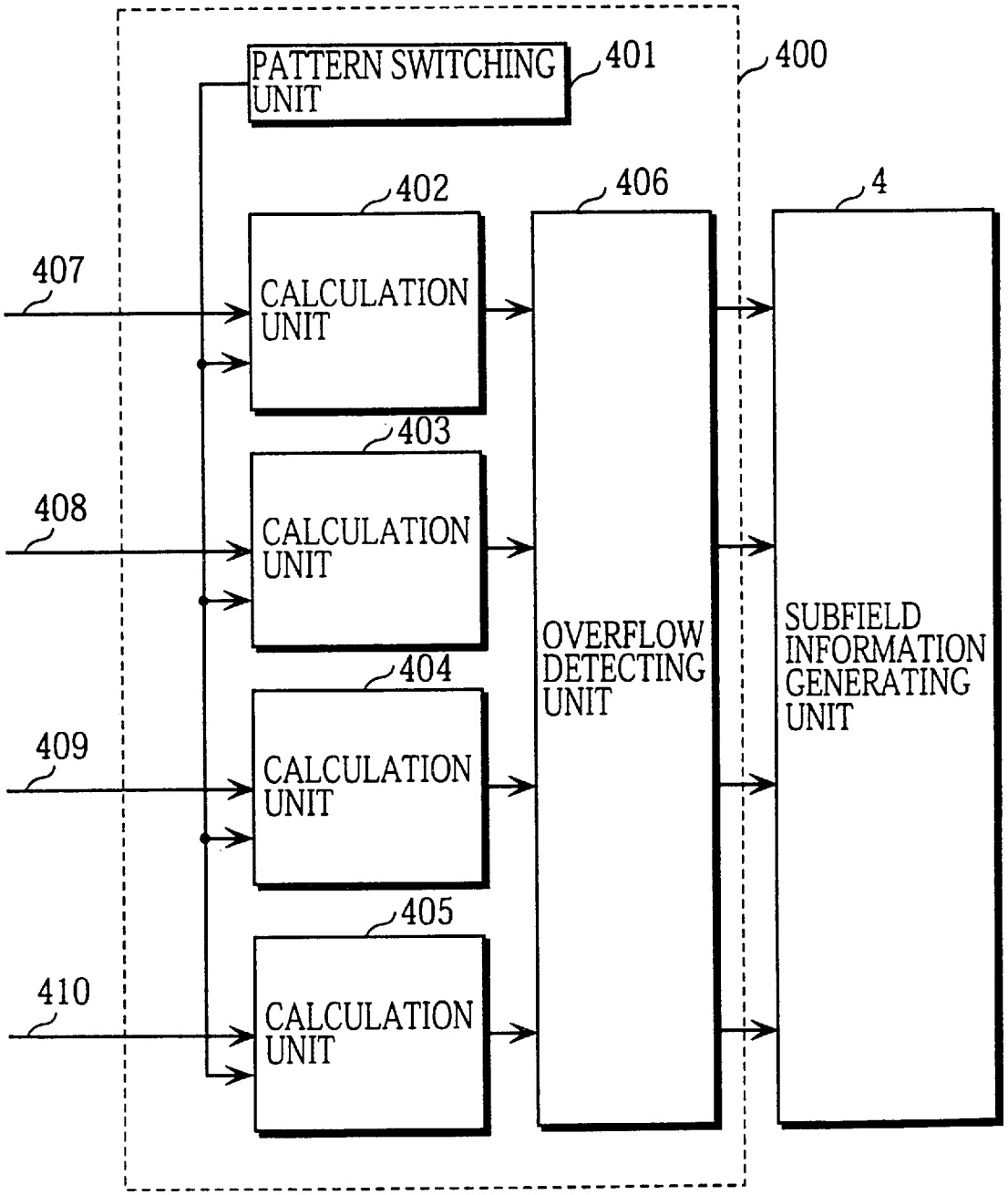
FIG. 18 shows the construction of the multilevel image display apparatus and error diffusing unit in the second embodiment of the present invention.

FIG. 18 shows the construction of the multilevel image display apparatus 400 that is driven using the multilevel image display method of the present embodiment.

As shown in FIG. 18, the error diffusing unit 400 includes a pattern switching unit 401, calculation units 402–405, and an overflow detecting unit 406. Numerals 407–410 in FIG. 18 respectively show signal lines that carry the 12-bit digital values of the phases 1–4.

The pattern switching unit 401 is a circuit for switching as appropriate between the two error diffusion patterns given below.

Figure 19A:
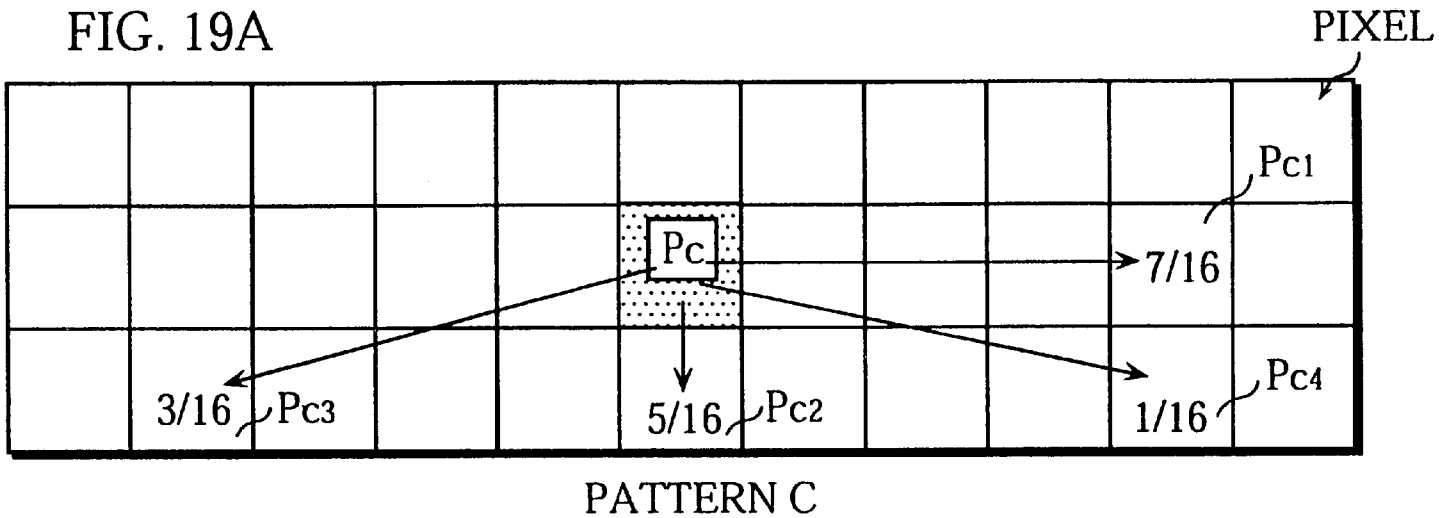
FIGS. 19A and 19B show error diffusion patterns.
Figure 19B:
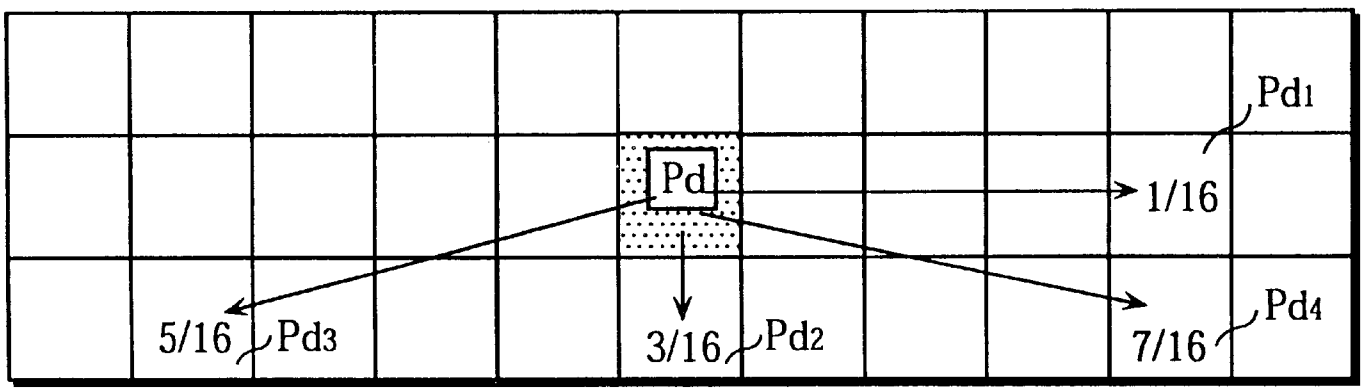

FIGS. 19A and 19B show the two error diffusion patterns mentioned above. As shown in these drawings, the error diffusion patterns C and D are both patterns that diffuse the display error of a target pixel into four pixels. These four pixels respectively are pixels Pc1, Pd1 that are located 4 pixels to the right of the target pixel, pixels Pc2, Pd2 that are located directly below the target pixel, pixels Pc3, Pd3 that are located 4 pixels to the left of the pixels Pc2, Pd2, and pixels Pc4, Pd4 that are located 4 pixels to the right of the pixels Pc2, Pd2. The difference between these patterns C and D lies in the weightings used to diffuse the display error of the target pixel. In pattern C, the weightings 7/16, 5/16, 3/16, 1/16 are used in that order for the pixels Pc1, Pc2, Pc3, and Pc4, while the pattern D, the weightings 1/16, 3/16, 5/16, 7/16 are used in that order for the pixels Pd1, Pd2, Pd3, and Pd4.

The calculation units 402–405 are circuits whose operation switches, depending on the output values of the pattern switching unit 401 (which is to say how pattern C or pattern D are used for the present line and previous line), between the patterns shown in FIGS. 20–23. The circuits shown in these drawings only differ in the coefficients used by the respective multiplication units, and are otherwise identical. Each of the calculation units 402–405 is therefore composed of four delay units 501–504, four multiplication units 505–508, and an adder 509. In the drawings, the symbol "D" represents a delay circuit that delays a value by one data cycle, while the symbol "H" represents a delay circuit that delays a value by a time equivalent to one horizontal cycle. Numeral 500 represents a signal line that carries a 12-bit digital value. Numeral 510 represents a signal line that carries the output of the adder 509, on which 12- or 13-bit data is carried depending on whether a carry is produced. Number 511 shows a branch line that passes the lower 4-bits of the output of the adder 509 over to delay units. Note that the four signal lines that reach the adder 509 via the multiplication units shown in these drawings carry signals showing the display errors that are diffused into the target pixel from nearby pixels.

Each circuit construction adds the display errors generated by the various calculation units to the 12-bit digital value of the target pixel, outputs the upper 8 bits of the calculation result to the PDP, and diffuses the lower 4 bits of the calculation result into nearby pixels as the display error of the target pixel.

Figure 20:
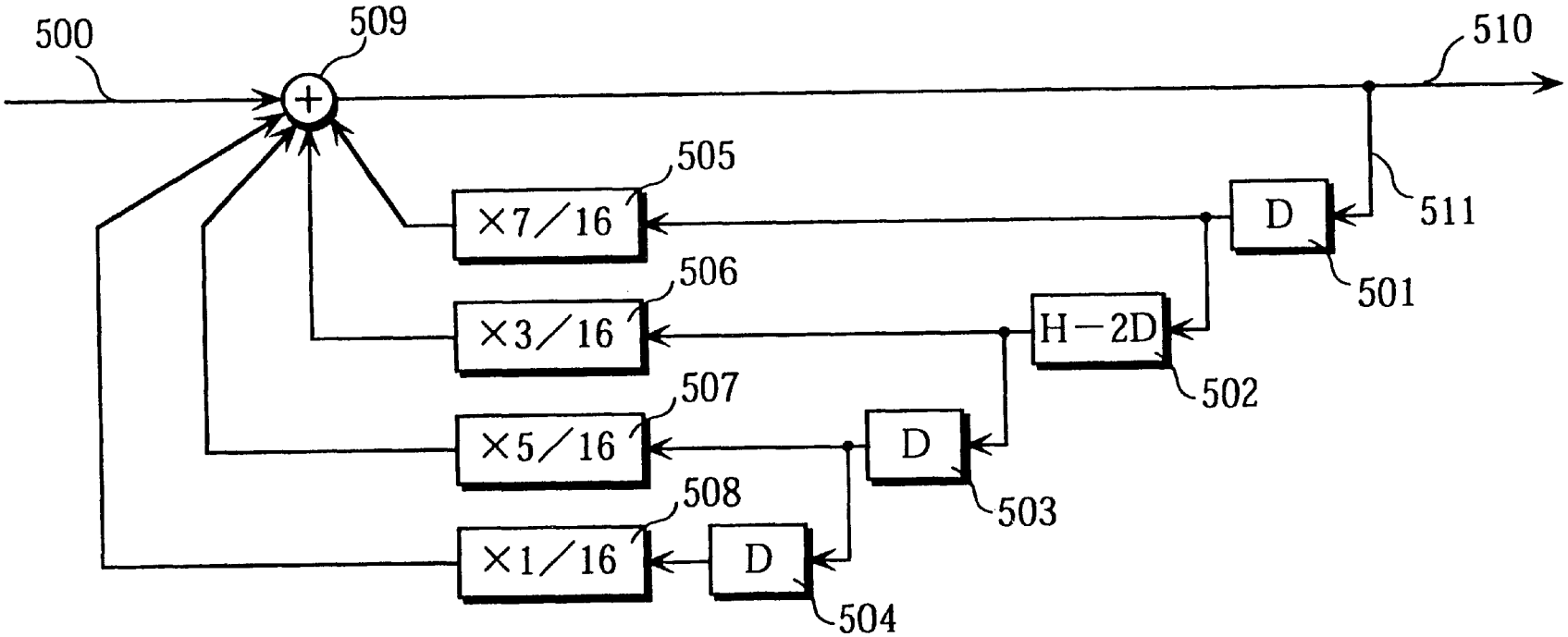
FIG. 20 shows one construction for a calculation unit.
Figure 21:
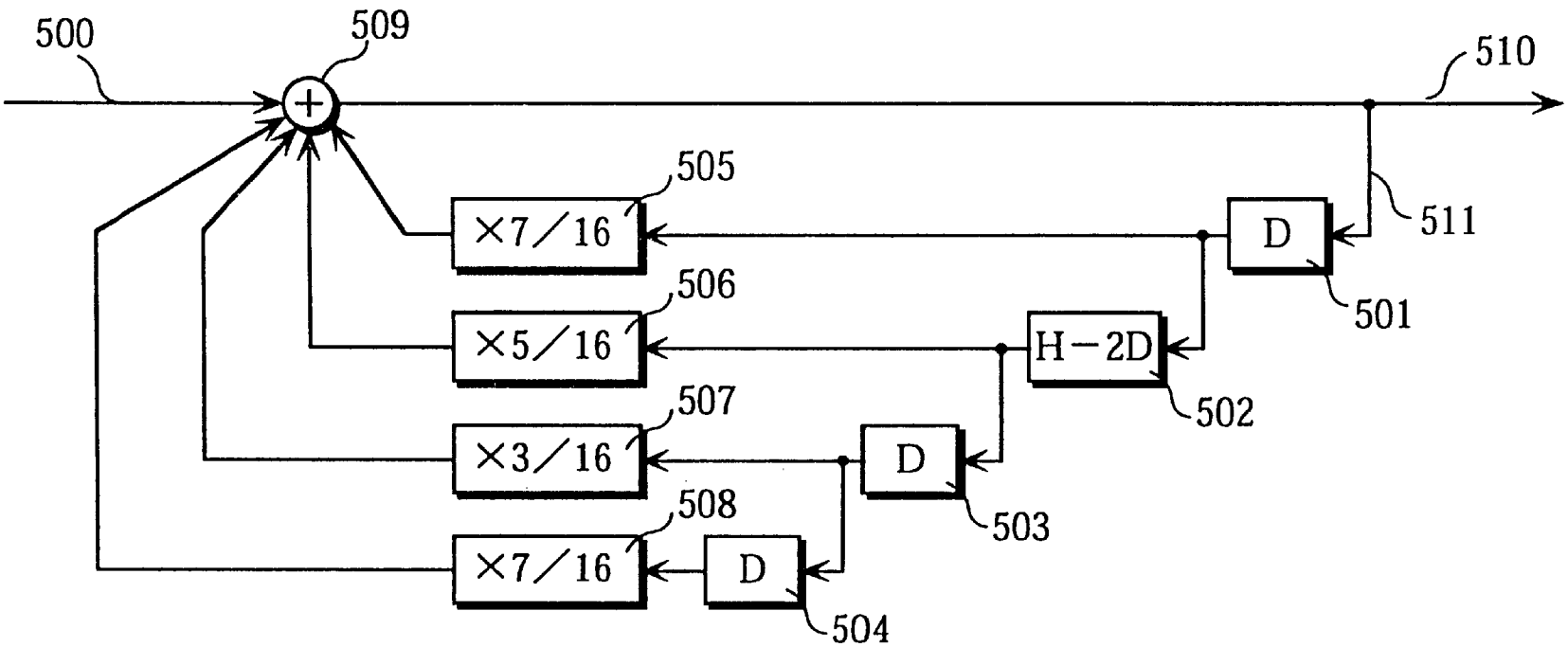
FIG. 21 shows one construction for a calculation unit.
Figure 22:
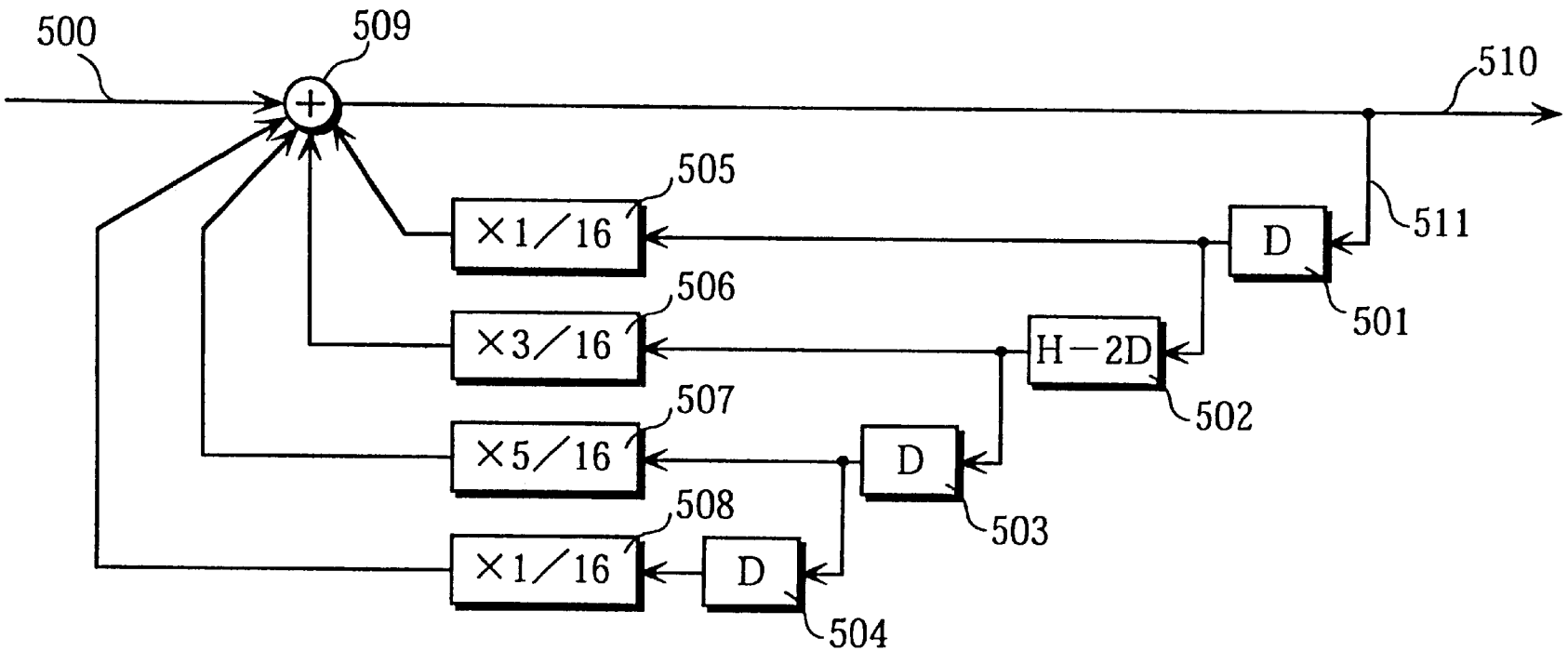
FIG. 22 shows one construction for a calculation unit.
Figure 23:
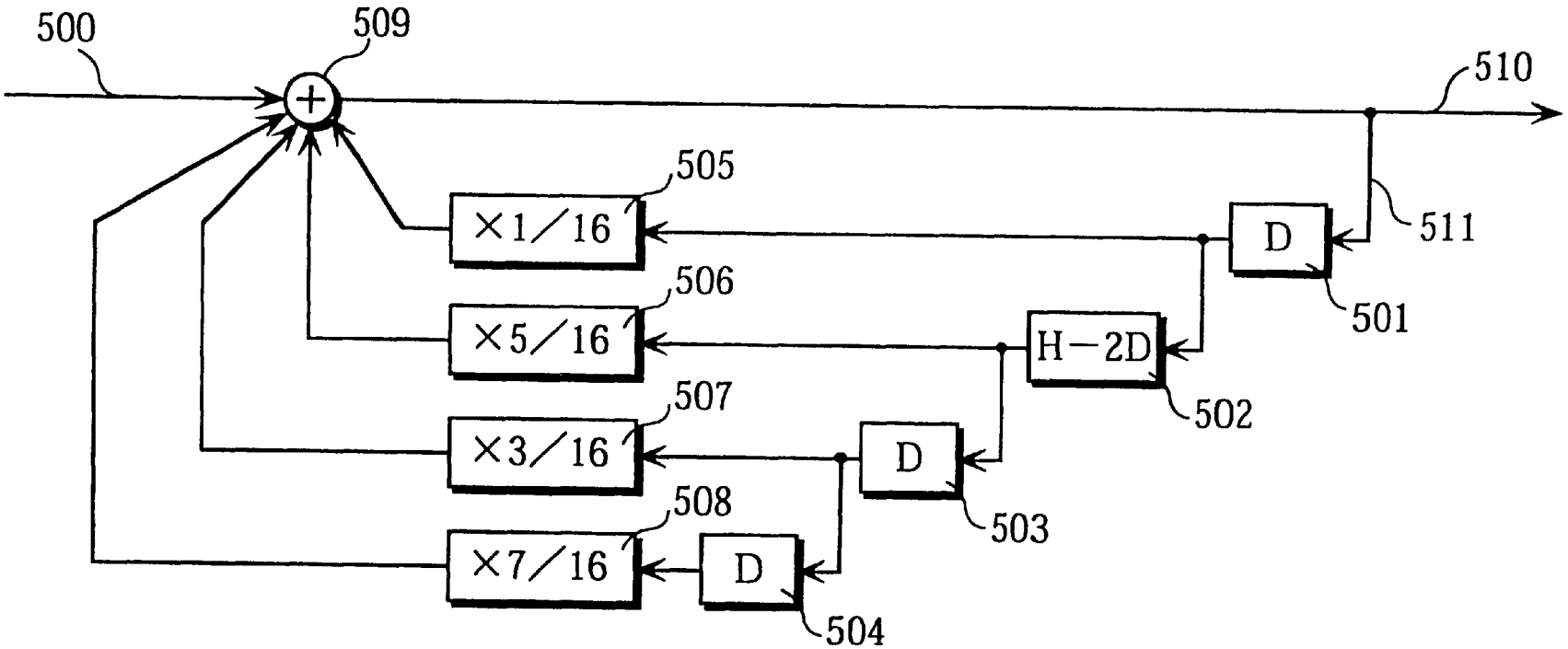
FIG. 23 shows one construction for a calculation unit.

The four calculation units 402–405 switch between the operations shown in FIGS. 20–23 as follows. When the error diffusion pattern for the target pixel is pattern C and the error diffusion pattern for the pixel immediately above the target pixel has also pattern C, the calculation unit in question operates as shown in FIG. 20. When the error diffusion pattern for the target pixel is pattern C and the error diffusion pattern for the pixel immediately above the target pixel was pattern D, the calculation unit in question operates as shown in FIG. 21. When the error diffusion pattern for the target pixel is pattern D and the error diffusion pattern for the pixel immediately above the target pixel was pattern C, the calculation unit in question operates as shown in FIG. 22. When the error diffusion pattern for the target pixel is pattern D and the error diffusion pattern for the pixel immediately above the target pixel was also pattern D, the calculation unit in question operates as shown in FIG. 23. As shown in these drawings, the circuits use different weightings (i.e., the values written inside the multiplication units 505–508) in such circumstances.

The following describes the above processing in more detail.

Figure 24:
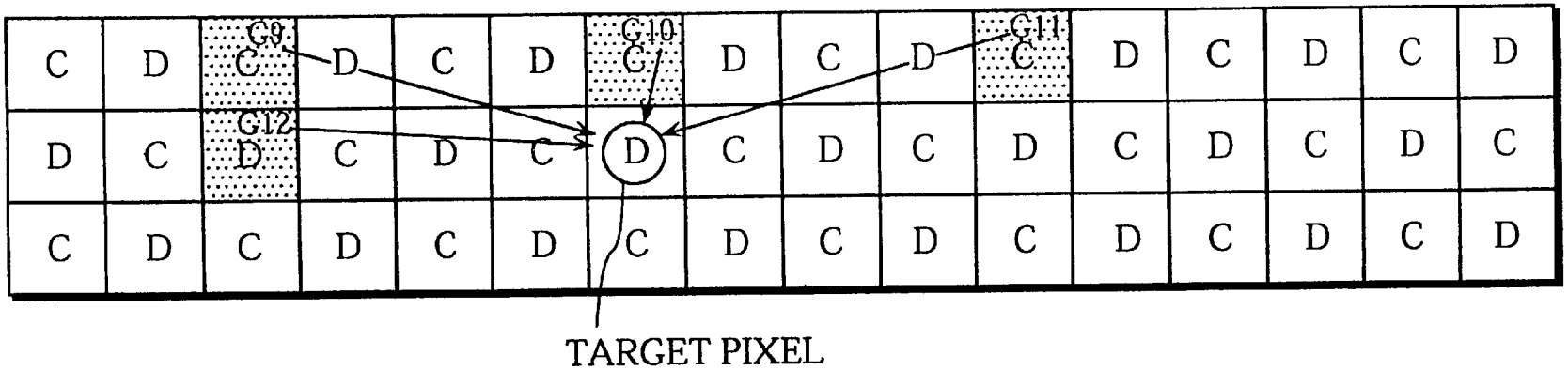
FIG. 24 shows the diffusion of errors with the present circuit construction.

This explanation supposes that patterns C and D are arranged in a checkerboard pattern as shown in FIG. 24.

In FIG. 24, the error diffusion pattern for the target pixel marked with the circle is assumed to be pattern D. In this case, pattern C was used for the pixel directly above the target pixel, so that the calculation unit operates as shown in FIG. 22.

The pixels that have a display error which is diffused into the target pixel marked with a circle are the pixels G9–G12 in FIG. 24.

In this case, the following error components are diffused into the target pixel:

1/16 of the display error of the pixel G9;

5/16 of the display error of the pixel G10;

3/16 of the display error of the pixel G11; and

1/16 of the display error of the pixel G12.

In the present example, the digital data of the target pixel is inputted into the error diffusing unit at a time "(1H+1D)" after the digital value of the pixel G9, "1H" after the digital value of the pixel G10, "(1H−1D)" after the digital value of the pixel G11, and "1D" after the digital value of the pixel G12.

The following pixel values are inputted into the adder 509 for the target pixel marked with the circle:

the error signal generated for the pixel G9 that has passed the delay units 501, 502, 503, and 504 and has been multiplied by the coefficient 1/16;

the error signal generated for the pixel G10 that has passed the delay units 501, 502, and 503 and has been multiplied by the coefficient 5/16;

the error signal generated for the pixel G10 that has passed the delay units 501 and 502 and has been multiplied by the coefficient 3/16; and the error signal generated for the pixel G11 that has passed the delay unit 501 and has been multiplied by the coefficient 1/16.

In this way, the display errors can be diffused as intended by the circuit shown in FIG. 22. The other circuits in FIGS. 20–23 function in the same way, and so will not be described.

The above processed enables error diffusion to be performed even when the inputted digital data is multiphase. The display error of the target pixel is diffused into the pixel located 4 pixels to the right, the pixel located 4 pixels to the left and 1 pixel below, the pixel located 4 pixels to the right and 1 pixel below, and the pixel located directly below. In this way, the display error of the target pixel is diffused in other pixel values that are the same phase in a different data block, so that at least one data cycle will be available before calculation involving this diffused display error and separate error diffusion processing is possible for the pixel value for each phase in a data block. Note here the present explanation and drawings focus on the case where that pixels in corresponding positions on adjacent lines have the same phase.

Switching between pattern C and pattern D can be performed for each line, for each pixel, or for each TV field. As in the first embodiment, switching between pattern C and pattern D for each pixel in the horizontal direction results in the combined weightings applied to the display errors diffused into pixels on the same line alternating between a large and a small total. This means that light and dark pixels alternate on the line, and prevents deterioration in image quality due to successive light or dark spots being produced in the image.

By having the error diffusion patterns alternate in the vertical direction as well, deterioration in image quality due to successive light or dark spots being produced in the image in the vertical direction can also be prevented.

If the error diffusion pattern is changed in the horizontal or vertical direction but is fixed for each TV field, a checkerboard pattern will be observed in the image, though this can be prevented by simply inverting the checkerboard pattern for each TV field, as described in the first embodiment.

It is also possible to randomly switch the error diffusion pattern in the vertical direction. When a moving image is displayed with the error diffusion pattern alternating between fields and in the horizontal and vertical directions, checkerboard patterns must be observed in the image depending on the speed at which the viewer's eyes track the moving image, though no such checkerboard patterns will be observed if the error diffusion pattern changes in the vertical direction.

Figure 25A:
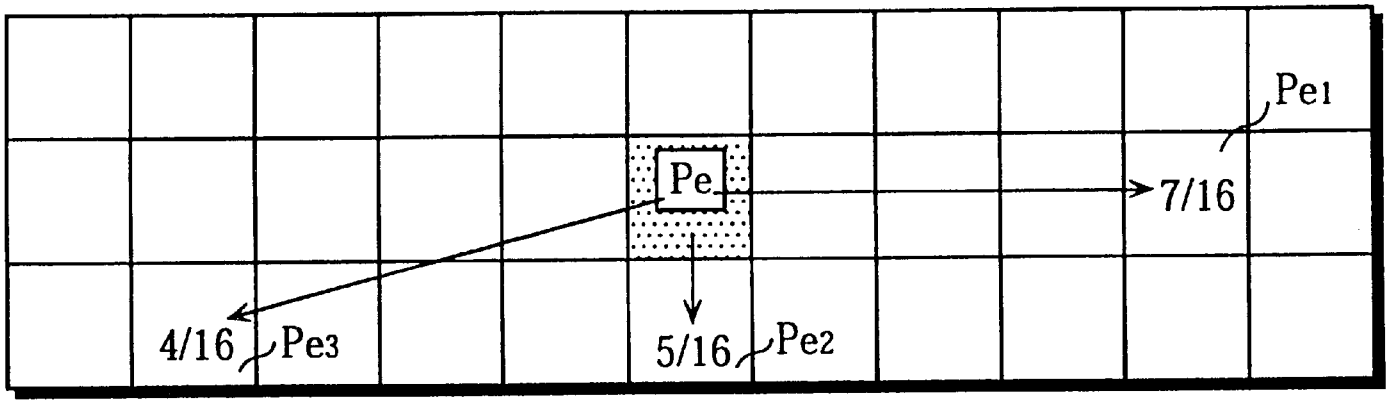
FIGS. 25A and 25B show error diffusion patterns used by the multilevel image display apparatus of the third embodiment of the present invention.
Figure 25B:
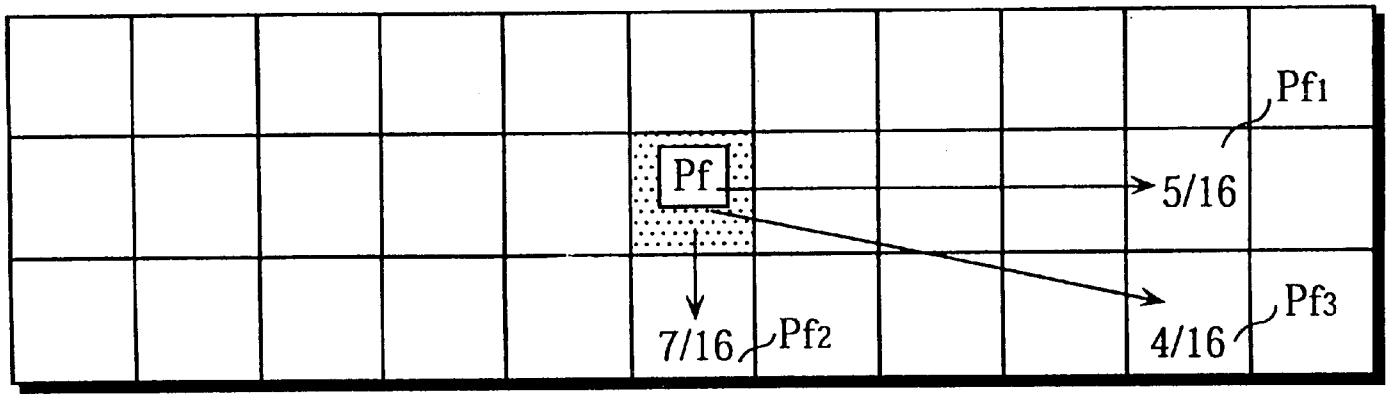

Note that the same improvements in image quality can be obtained even if the error diffusion patterns shown in FIGS. 25A and 25B are used in place of the error diffusion patterns C and D described above. Circuits which use these error diffusion patterns will have almost the same construction as the circuits described earlier, with it only being necessary to change the coefficients used in the calculations units.

The error diffusion pattern (pattern E) shown in FIG. 25A diffuses the display error of the target pixel Pe into the pixel Pe1 located 4 pixels to the right of the target pixel Pe, the pixel Pe2 located directly below the target pixel Pe, and the pixel Pe3 located below and 4 pixels to the left of the target pixel Pe. The error diffusion pattern (pattern F) shown in FIG. 25B diffuses the display error of the target pixel Pf into the pixel Pf1 located 4 pixels to the right of the target pixel Pf, the pixel Pf2 located directly below the target pixel Pf, and the pixel Pf3 located below and 4 pixels to the right of the target pixel Pf. These drawings also show the weightings (coefficients) used when diffusing the display error of the target pixel into other pixels.

Depending on the arrangement of patterns E and F, the calculation unit used to calculate a pixel value will be one of the circuits shown in FIGS. 26–29. The circuits shown in these drawings differ in only the coefficients used by the multiplication units, with the other components being identical. In other words, each circuit is fundamentally composed of four delay circuits 601–604, four multiplication units 605–608, and an adder 609.

Figure 26:
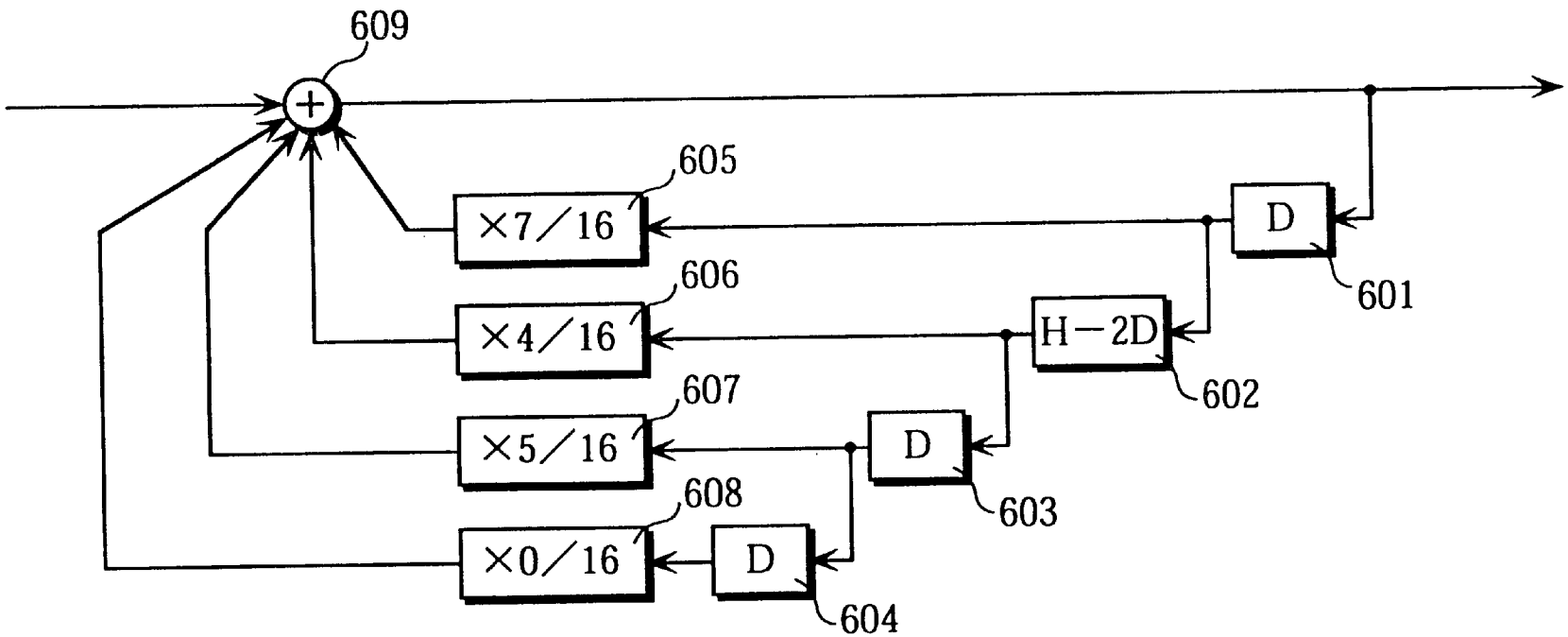
FIG. 26 shows one construction for a calculation unit.
Figure 27:
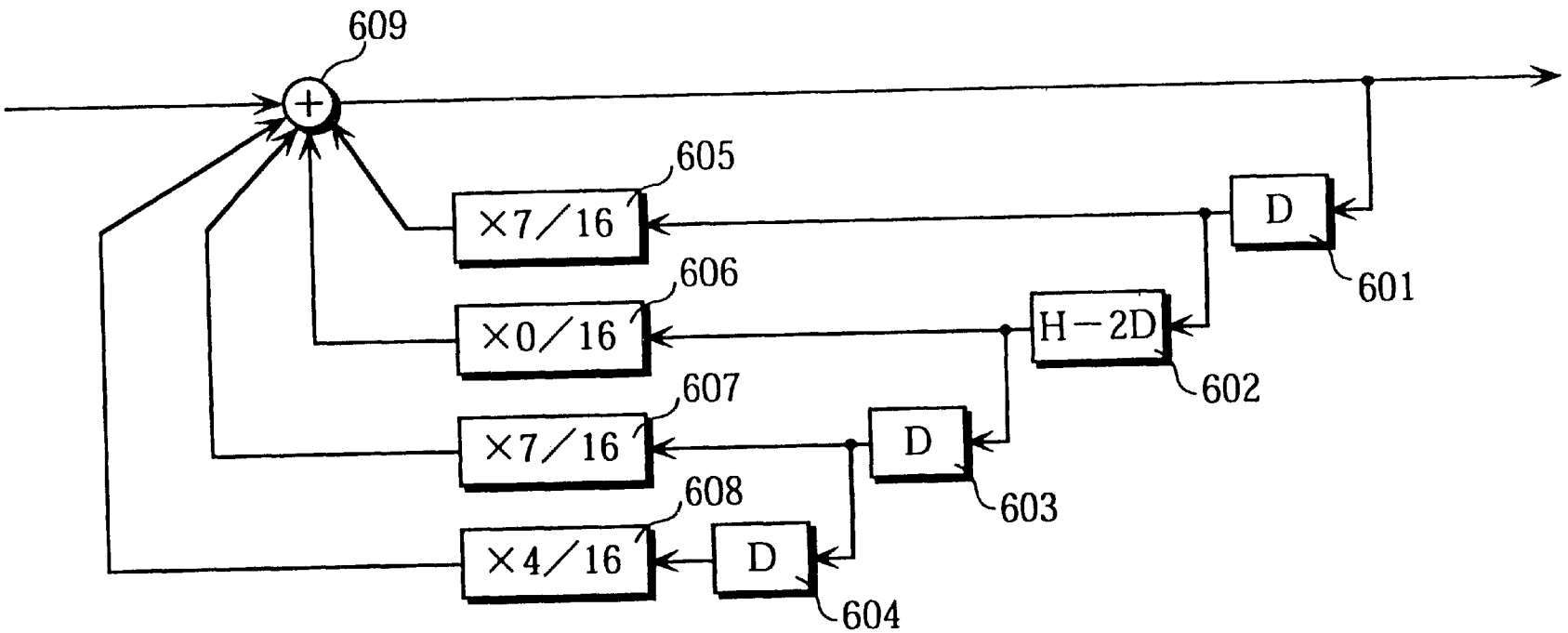
FIG. 27 shows one construction for a calculation unit.
Figure 28:
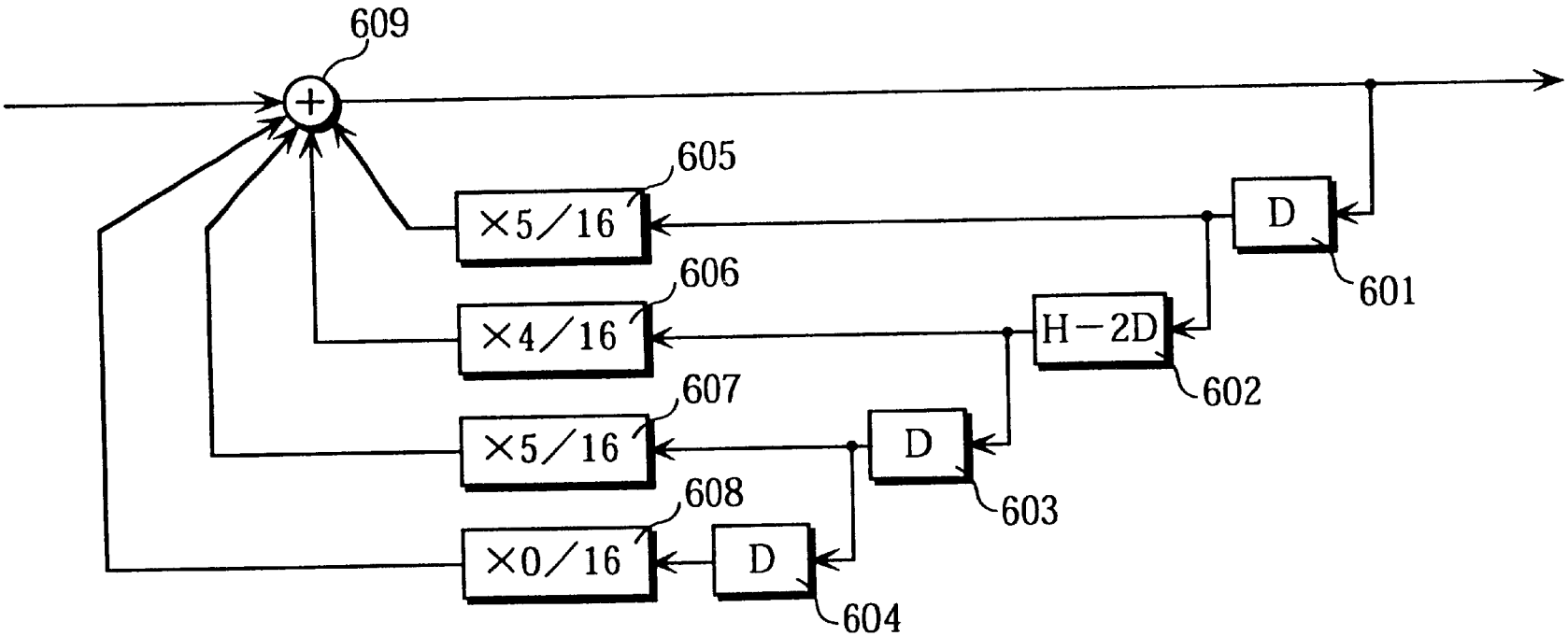
FIG. 28 shows one construction for a calculation unit.
Figure 29:
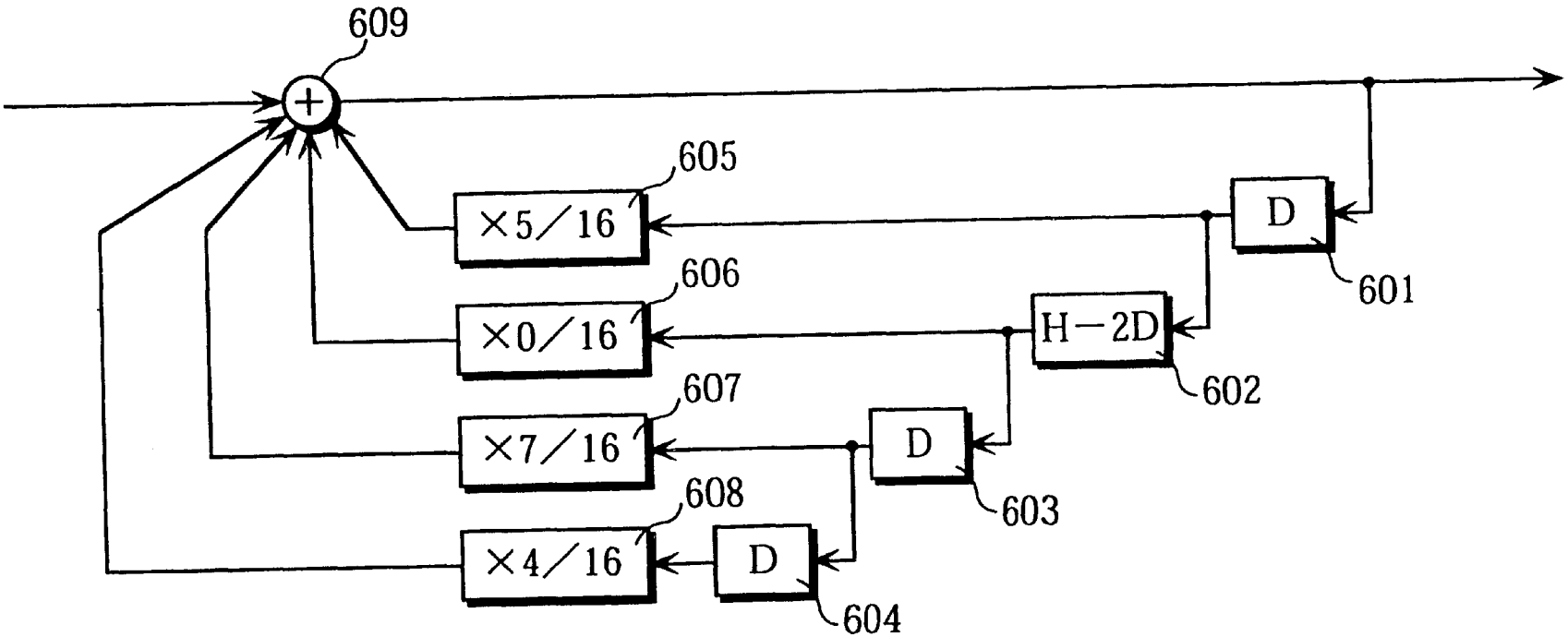
FIG. 29 shows one construction for a calculation unit.

When the error diffusion pattern for the target pixel is pattern E and the error diffusion pattern for the pixel immediately above the target pixel was also pattern E, the calculation unit in question operates as shown in FIG. 26. When the error diffusion pattern for the target pixel is pattern E and the error diffusion pattern for the pixel immediately above the target pixel was pattern F, the calculation unit in question operates as shown in FIG. 27. When the error diffusion pattern for the target pixel is pattern F and the error diffusion pattern for the pixel immediately above the target pixel was pattern E, the calculation unit in question operates as shown in FIG. 28. When the error diffusion pattern for the target pixel is pattern F and the error diffusion pattern for the pixel immediately above the target pixel was also pattern F, the calculation unit in question operates as shown in FIG. 29.

Note that FIGS. 26–29 do not show the multiplication units whose coefficients are 0/16 or the delay units located upstream from such multiplication units.

Third Embodiment

The following describes a multilevel image display apparatus that uses the multilevel image display method of the third embodiment of the present invention. Note that this multilevel image display apparatus is the same as that of the second embodiment, except for the error diffusion patterns. The following explanation will focus on this difference. Note that this embodiment describes the case where switching between error diffusion patterns is possible due to the inclusion of a pattern switching unit like that described in the second embodiment.

Figure 30A:
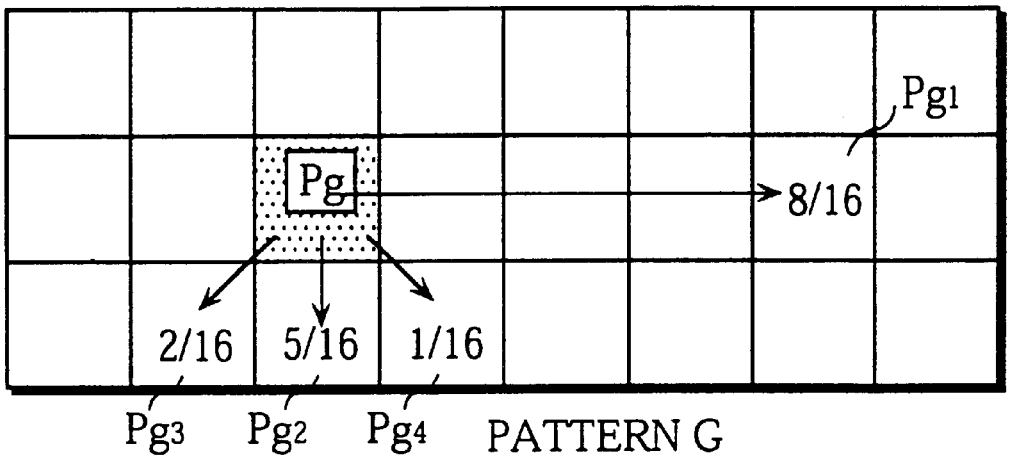
FIGS. 30A and 30B show other error diffusion patterns used by the multilevel image display apparatus of the third embodiment.
Figure 30B:
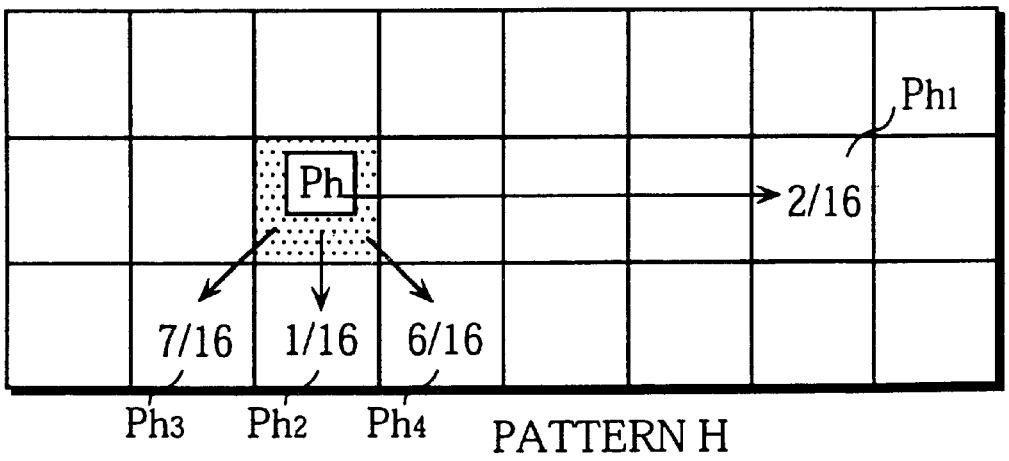

FIGS. 30A and 30B show the main error diffusion patterns that are used in the present embodiment.

The error diffusion pattern (pattern G) shown in FIG. 30A and the error diffusion pattern (pattern H) shown in FIG. 30B diffuse the display error of the respective target pixel Pg, Ph into the pixel Pg1, Ph1 located 4 pixels to the right of the target pixel, the pixel Pg2, Ph2 located below the target pixel, the pixel Pg3, Ph3 located below and to the left of the target pixel, and the pixel Pg4, Ph4 located below and to the right of the target pixel. These patterns G and H only differ in the weightings (coefficients) used to diffuse the display error into these pixels. These weightings are written inside the pixels affected by the display error of the target pixel in FIGS. 30A and 30B.

The calculation units (that correspond to calculation units 402–405 in FIG. 18 and are referred to below using these reference numerals) function as one of the four circuits shown in FIGS. 31–34, depending on the output value of the pattern switching unit. Note that while the following explanation states that the construction of the circuits switches between the constructions shown in FIGS. 31–34., this is merely for ease of explanation, so that any number of circuit constructions can be realized simply by changing the circuit constants (delay values).

The circuits in FIGS. 31–34 are all fundamentally the same, apart from the coefficients used by the multiplication units and the delay values used by the delay units. Each circuit includes four multiplication units 701–704, four delay units 705–708, and adder 709. In these drawings, numeral 700 represents a signal line that carries a 12-bit digital value. Numeral 710 represents the output line of the adder 709, on while 12- or 13-bit data is carried depending on whether a carry is produced. Numerals 711 and 712 represent signal lines that branch off the output line 710 and pass the lower 4-bits of the output of the adder 709 over to delay units. Numerals 713 is also a signal line that branches off the output line 710 and passes the lower 4-bits of the output of the adder 709 over to the calculation units. Numerals 714 and 715 represent signal lines that input 4-bit error signals that are received from other calculations units into the delay units. Note that the delay units 705, 706 delay their inputted values by the period "1H".

Figure 31:
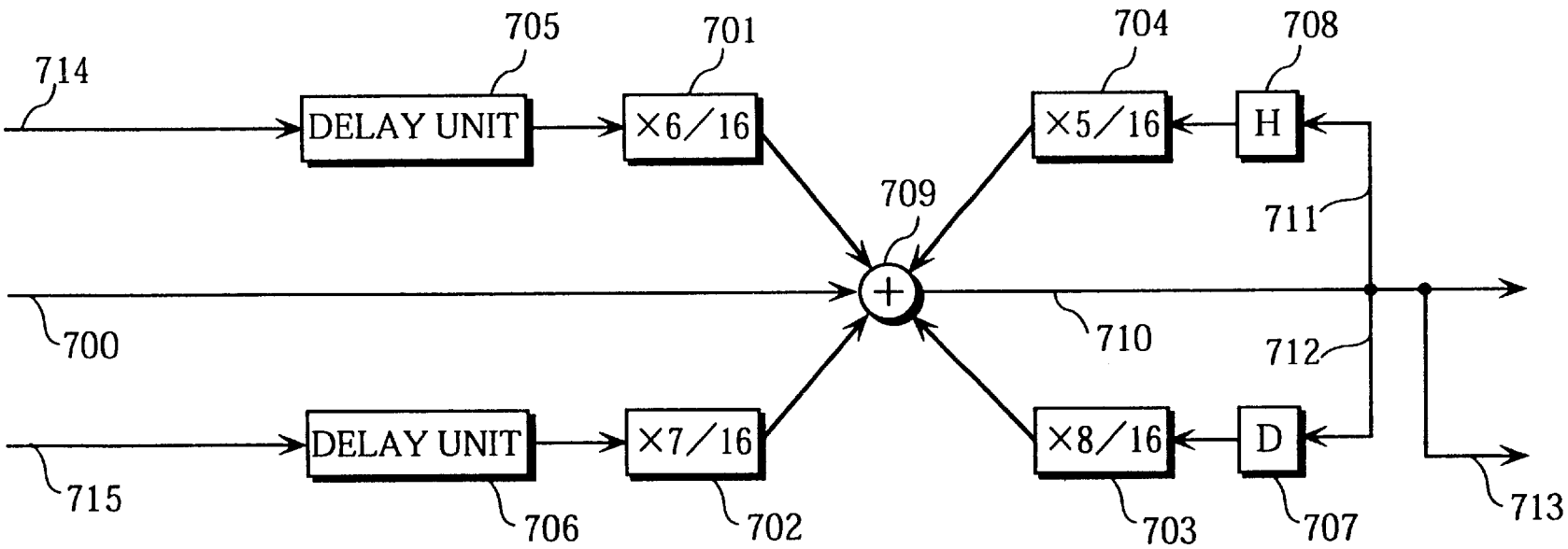
FIG. 31 shows one construction for a calculation unit.
Figure 32:
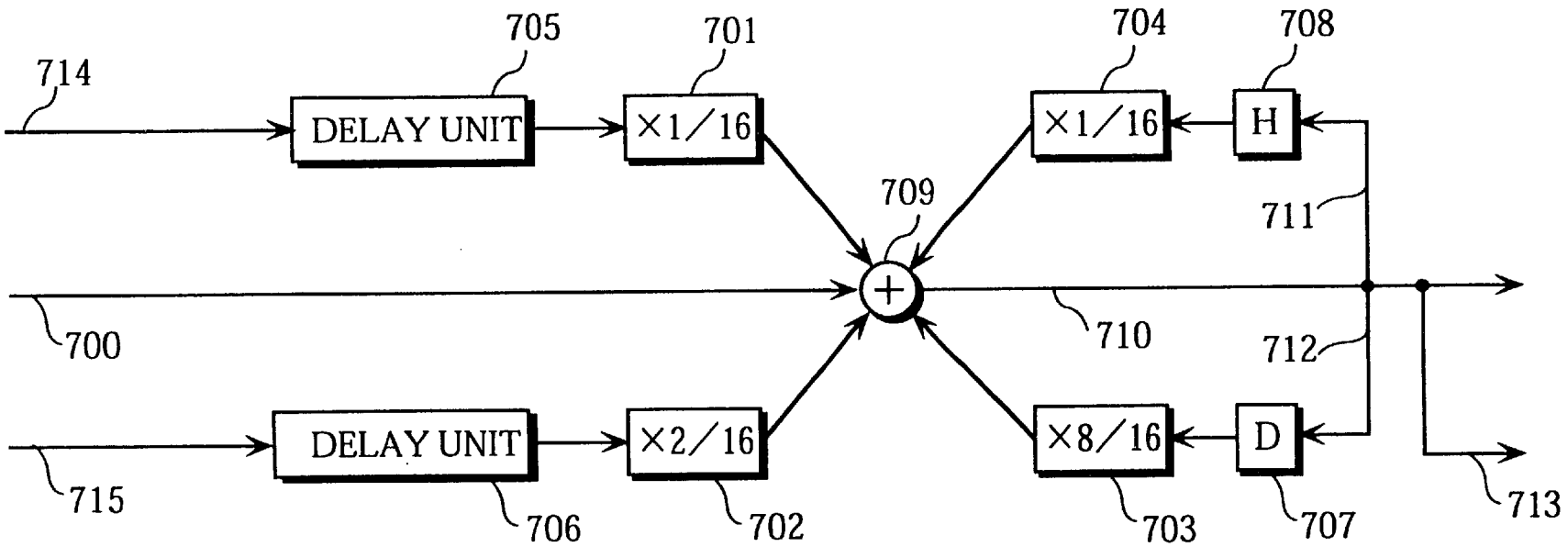
FIG. 32 shows one construction for a calculation unit.
Figure 33:
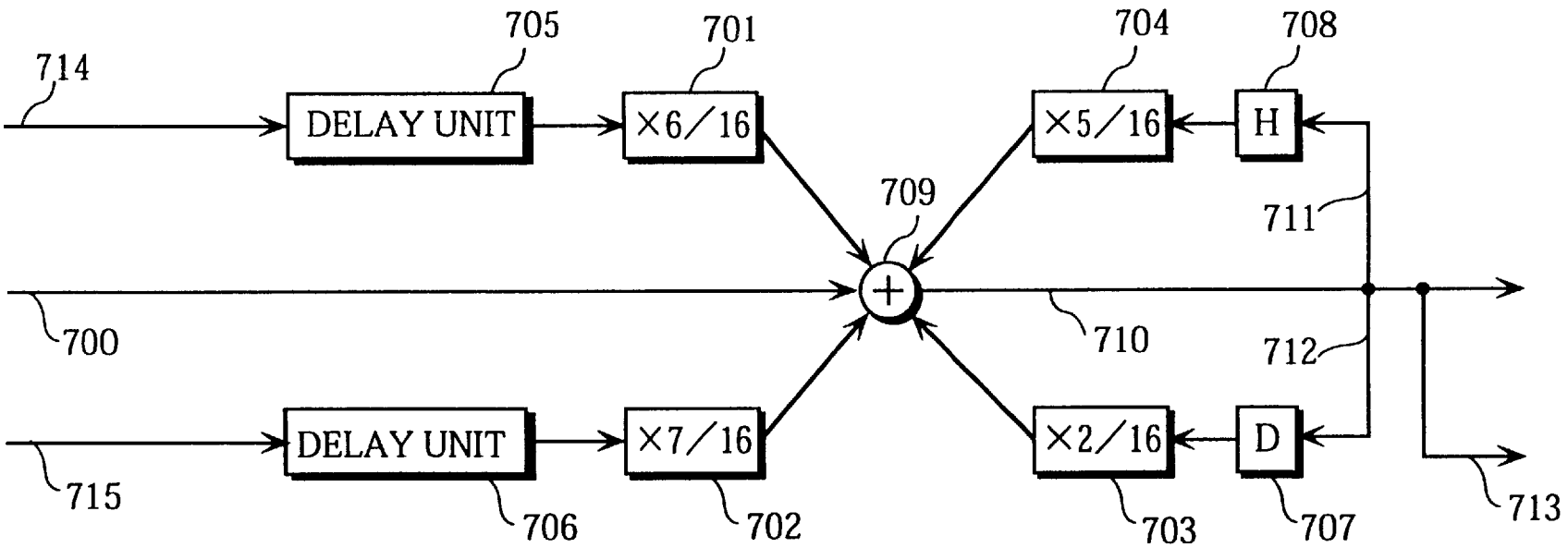
FIG. 33 shows one construction for a calculation unit.
Figure 34:
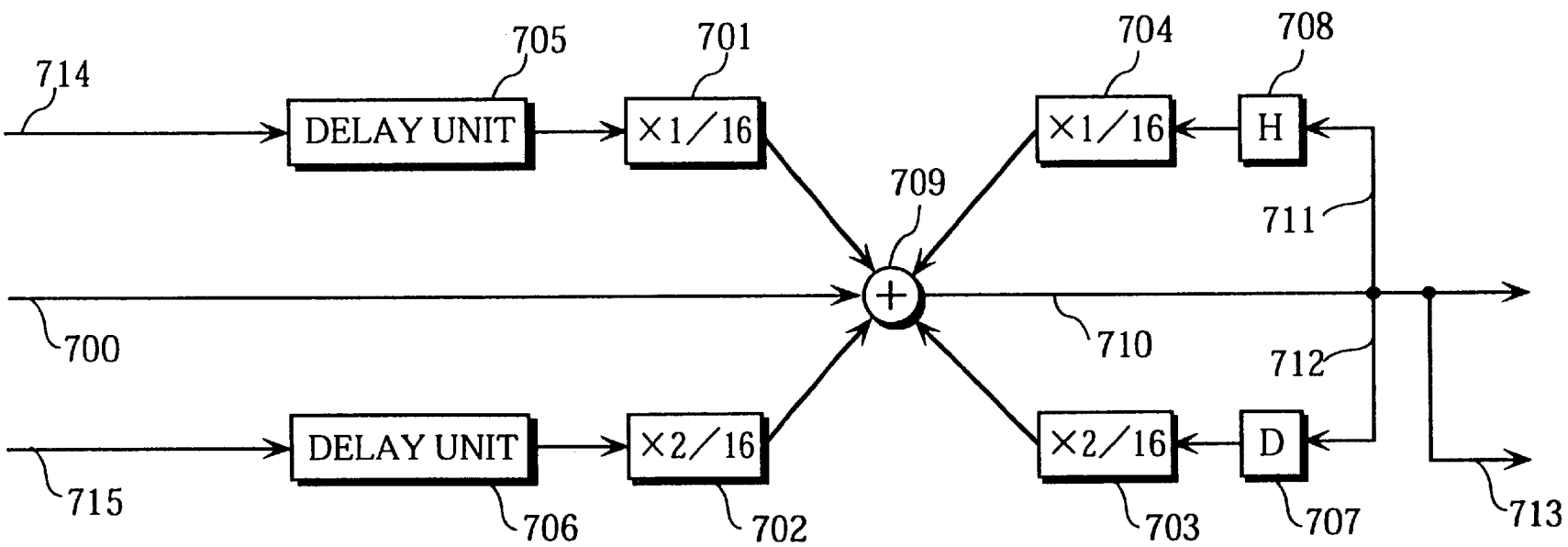
FIG. 34 shows one construction for a calculation unit.

The four calculation units 402–405 switch between the operations shown in FIGS. 31–34 as follows. When the error diffusion pattern for the target pixel is pattern G and the error diffusion pattern for the pixel immediately above the target pixel was also pattern G, the calculation unit in question operates as shown in FIGS. 31. When the error diffusion pattern for the target pixel is pattern G and the error diffusion pattern for the pixel immediately above the target pixel was pattern H, the calculation unit in question operates as shown in FIG. 32. When the error diffusion pattern for the target pixel is pattern H and the error diffusion pattern for the pixel immediately above the target pixel was pattern G, the calculation unit in question operates as shown in FIG. 33. When the error diffusion pattern for the target pixel is pattern H and the error diffusion pattern for the pixel immediately above the target pixel was also pattern H, the calculation unit in question operates as shown in FIG. 34.

Figure 35:
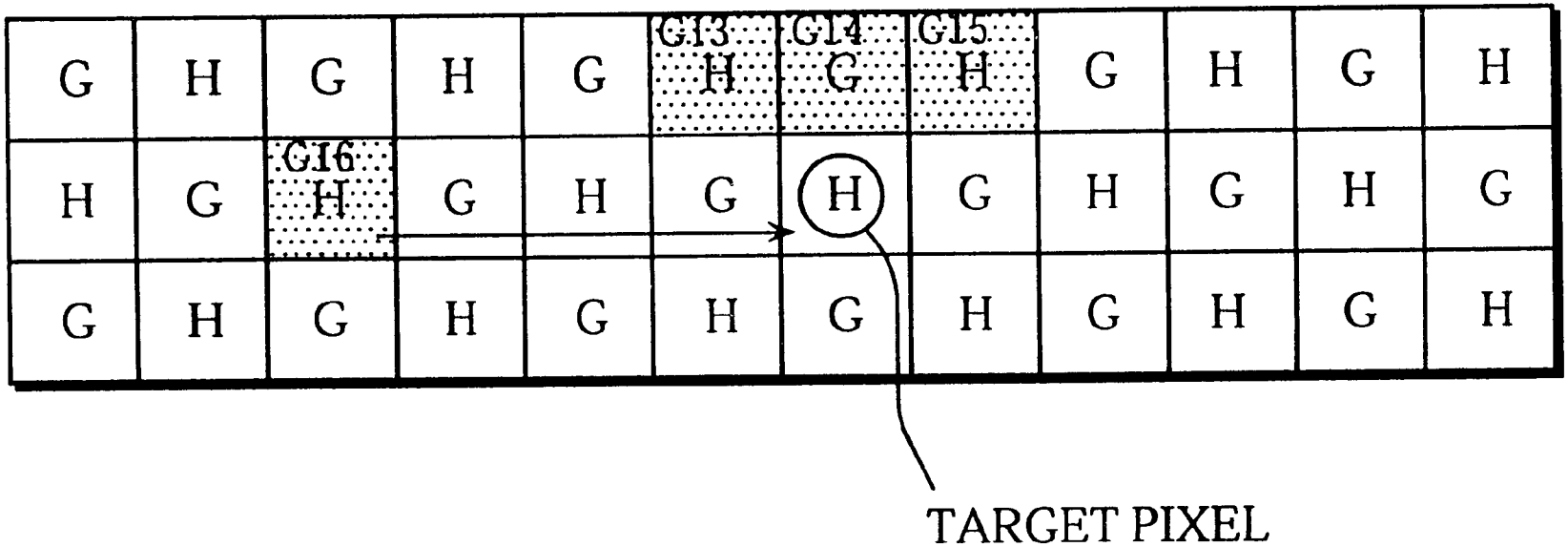
FIG. 35 shows the diffusion of errors with the present circuit construction.

The following describes the above processing in more detail for when the error diffusion patterns G and H are arranged in a checkerboard pattern as shown in FIG. 35.

In FIG. 35, the error diffusion pattern for the target pixel marked with the circle is pattern H, while pattern G was used for the pixel directly above this target pixel. As a result, the calculation unit operates as shown in FIG. 33.

In FIG. 35, the pixels that have a display error which is diffused into the target pixel marked with a circle are the pixels G13–G16. In this case, the following error components are diffused into the target pixel:

6/16 of the display error of the pixel G13;

5/16 of the display error of the pixel G14;

7/16 of the display error of the pixel G15; and

1/16 of the display error of the pixel G16.

If the pixel G13 is a pixel corresponding to phase 1 or to phase 2, the digital values of pixels G14 and G15 will be inputted into the error diffusing unit at the same time as the digital value of pixel G13.

In this case, the digital value of the target pixel is inputted into the error diffusing unit a time "1H" after the digital value of the pixel G13, a time "1H" after the digital value of the pixel G14, a time "1H" after the digital value of the pixel G15, and a time "1D" after the digital value of the pixel G16.

If the pixel G13 is a pixel corresponding to phase 3, the digital data of pixel G15 will be inputted into the error diffusing unit one data cycle later than the pixels G13 and G14. In this case, the digital value of the target pixel is inputted into the error diffusing unit a time "1H" after the digital value of the pixel G13, a time "1H" after the digital value of the pixel G14, a time "(1H–1D)" after the digital value of the pixel G15, and a time "1D" after the digital value of the pixel G16.

If the pixel G13 is a pixel corresponding to phase 4, the digital value of the target pixel is inputted into the error diffusing unit a time "(1H+1D)" after the digital value of the pixel G13, a time "1H" after the digital value of the pixel G14, a time "1H" after the digital value of the pixel G15, and a time "1D" after the digital value of the pixel G16.

As described above, the operation of the delay circuits changes according to the phase of the target pixel.

The following pixel values are inputted into the adder 709 for the target pixel marked with the circle:

the error signal generated for the pixel G13 that has passed the delay unit 705 and has been multiplied by the coefficient 6/16;

the error signal generated for the pixel G14 that has passed the delay unit 708 and has been multiplied by the coefficient 5/16;

the error signal generated for the pixel G15 that has passed the delay unit 706 and has been multiplied by the coefficient 7/16; and the error signal generated for the pixel G16 that has passed the delay unit 707 and has been multiplied by the coefficient 2/16.

In this way, the display errors of the intended magnitude can be diffused by the circuit shown in FIG. 33. The other circuits in FIGS. 31–34 function in the same way, and so will not be described.

This embodiment is similar to the second embodiment in that the display error of a target pixel is diffused into a pixel located 4 pixels to the right, though the present embodiment differs in that it diffuses the display error into the pixels on the following line that are spatially very close to the target pixel, rather than into pixels separated from the target pixel as in the second embodiment.

If the display error of a target pixel is diffused into neighboring pixels on the following line, the display error will be diffused into pixels that have a high degree of correlation with the target pixel. Compared to the second embodiment where the display error of the target pixel is diffused into pixels at some spatial difference from (i.e., with less correlation with) the target pixel, error diffusion in the present embodiment causes less deterioration in image quality, and by doing so achieves a similar high quality of images as conventional error diffusion methods.

Note that the error diffusion patterns G and H may be alternately used in the vertical direction, in the horizontal direction, or between different fields, as was described in the second embodiment.

Fourth Embodiment

The following describes a multilevel image display apparatus that uses the multilevel image display method of the fourth embodiment of the present invention. Note that this multilevel image display apparatus is the same as that of the second embodiment, except for the error diffusion patterns. The following explanation will focus on this difference. Note that this embodiment describes the case where switching between error diffusion patterns is possible due to the inclusion of a pattern switching unit like that described in the second embodiment.

FIGS. 36A–36D show the error diffusion patterns that are used in the present embodiment.

Figure 36A:
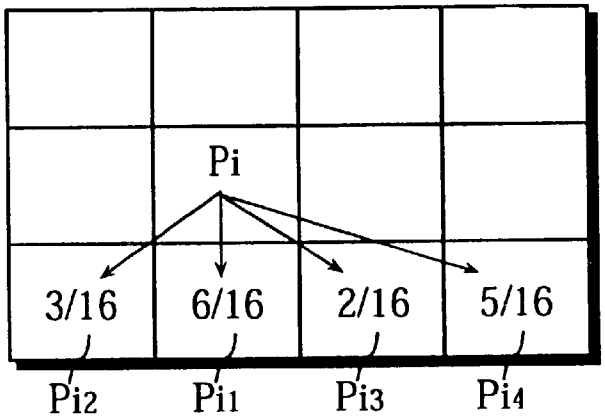
FIG. 36 shows the error diffusion patterns used by the multilevel image display apparatus of the fourth apparatus of the present invention.
Figure 36B:
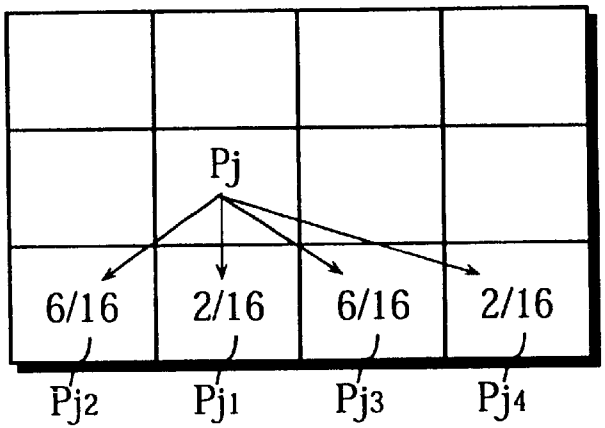
Figure 36C:
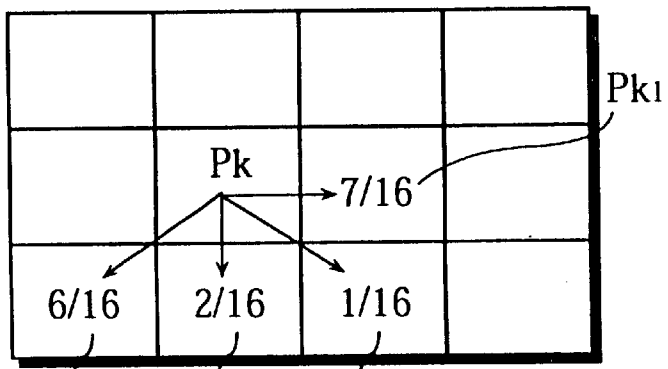
Figure 36D:
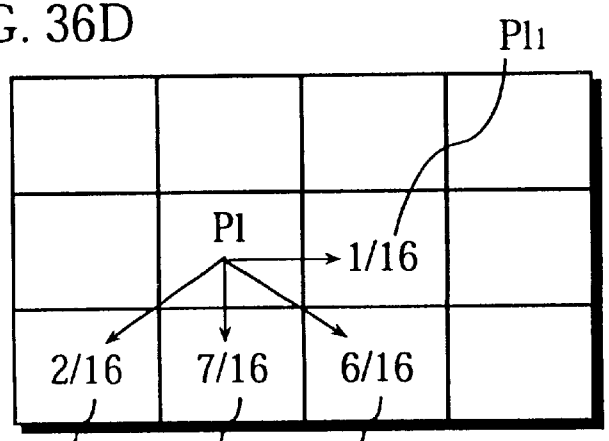

The error diffusion pattern (pattern I) shown in FIG. 36A and the error diffusion pattern (pattern J) shown in FIG. 36B are respectively similar to the patterns A and B described in the first embodiment. The error diffusion pattern (pattern K) shown in FIG. 36C and the error diffusion pattern (pattern L) shown in FIG. 36D respectively diffuse the display error of the target pixel into the pixel Pk1, Pl1 on the right of the target pixel, the pixel Pk2, Pl2 directly below the target pixel, and the pixels Pk3, Pk4, Pl3, Pl4 on the left and right sides of these pixels Pk2, Pk3.

Patterns K and L are only used when the target pixel is phase 4 in a data block. This processing for these patterns diffuses the display error of the target pixel into the pixel on the right of the target pixel as in the conventional processing. Such processing is possible since there is one data cycle between phase 4 in a data block and phase 1 in the next data block. Here, pattern K is used for phase 4 of a data block when pattern I has been used for phase 1, and pattern L is used for phase 4 when of a data block when pattern J has been used for phase 1.

The combinations of signals that are inputted into each calculation unit (these calculation units correspond to the calculation units 402–405 in FIG. 18) are shown in FIG. 37. As shown in the drawing, the calculation unit 402 receives a 12-bit digital value for phase 1 and display errors outputted from the other calculation units, the calculation unit 403 receives a 12-bit digital value for phase 2 and display errors outputted from the other calculation units, the calculation unit 404 receives a 12-bit digital value for phase 3 and display errors outputted from the other calculation units, and the calculation unit 405 receives a 12-bit digital value for phase 4 and display errors outputted from the other calculation units.

Figure 38:
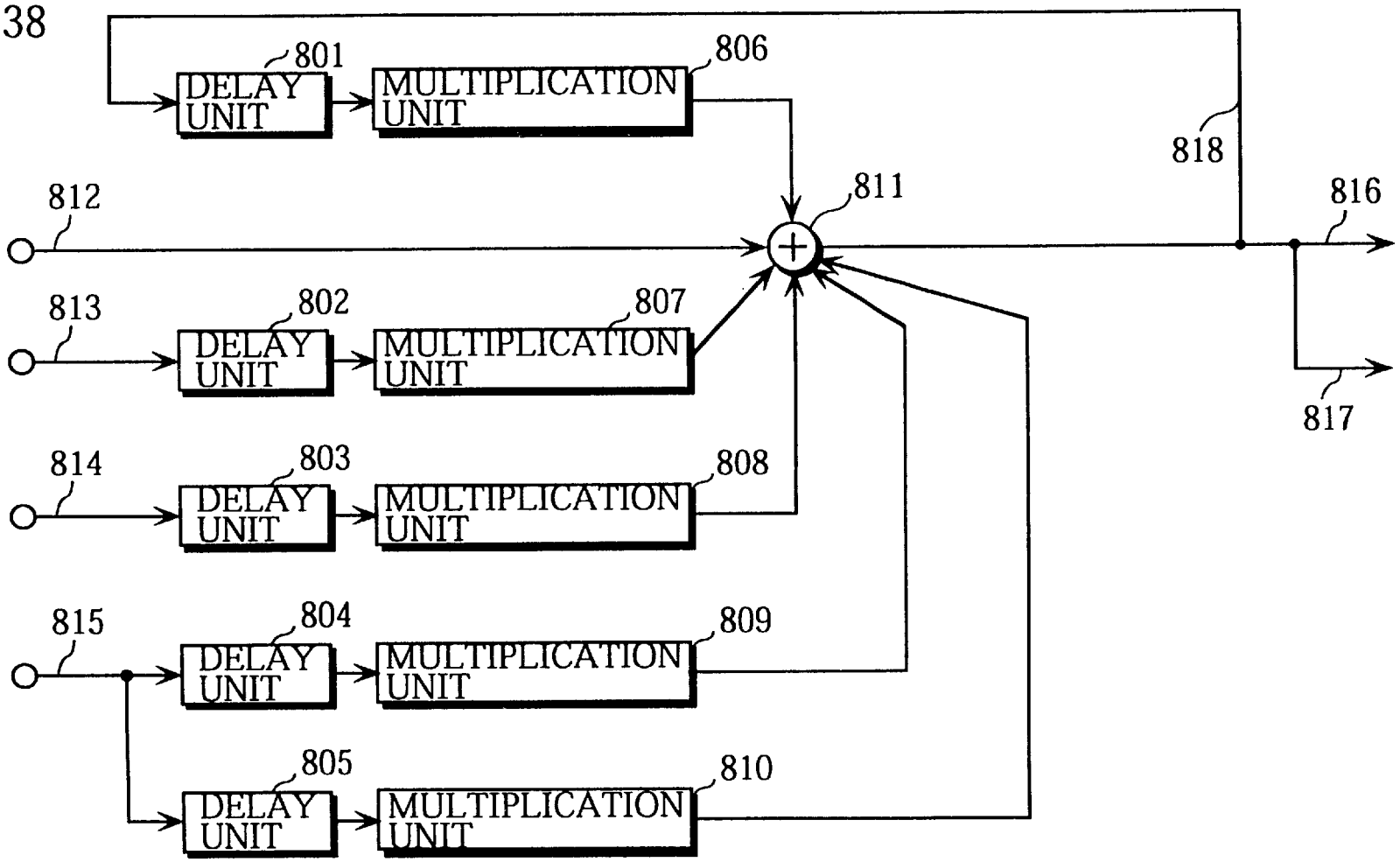
FIG. 38 shows the structure of each calculation unit.

FIG. 38 shows the common structure of the calculation units for performing the necessary calculation for the error diffusion. As shown in FIG. 38, each calculation unit includes five delay units 801–805, five multiplication units 806–810, and an adder 811. Numeral 812 in FIG. 38 represents a signal line that carries a 12-bit digital value, and numerals 813–815 represent signal lines that carry 4-bit values outputted by the other calculation units. Numeral 816 represents the output line of the adder 811, on which 12- or 13-bit data is carried depending on whether a carry is produced. Numerals 817 and 818 represent signal lines that branch off the output line 816 and carry the lower 4 bits of the output of the adder 811 to the delay unit 801 or to the other calculation units.

The signals inputted into the various calculation units are as follows. In the calculation unit 402, the signal line 812 inputs the digital value for the pixel that is phase 1, the signal line 813 inputs the display error produced by the calculation unit 403, the signal line 814 inputs the display error produced by the calculation unit 404, and the signal line 815 inputs the display error produced by the calculation unit 405. In the calculation unit 403, the signal line 812 inputs the digital value for the pixel that is phase 2, the signal line 813 inputs the display error produced by the calculation unit 402, the signal line 814 inputs the display error produced by the calculation unit 404, and the signal line 815 inputs the display error produced by the calculation unit 405. In the calculation unit 404, the signal line 812 inputs the digital value for the pixel that is phase 3, the signal line 813 inputs the display error produced by the calculation unit 402, the signal line 814 inputs the display error produced by the calculation unit 403, and the signal line 815 inputs the display error produced by the calculation unit 405. In the calculation unit 405, the signal line 812 inputs the digital value for the pixel that is phase 4, the signal line 813 inputs the display error produced by the calculation unit 402, the signal line 814 inputs the display error produced by the calculation unit 403, and the signal line 815 inputs the display error produced by the calculation unit 404.

The values used by the delay units and multiplication units in each calculation unit are shown in FIGS. 39–42. These drawings illustrate the specific operation example described below.

Figure 43:
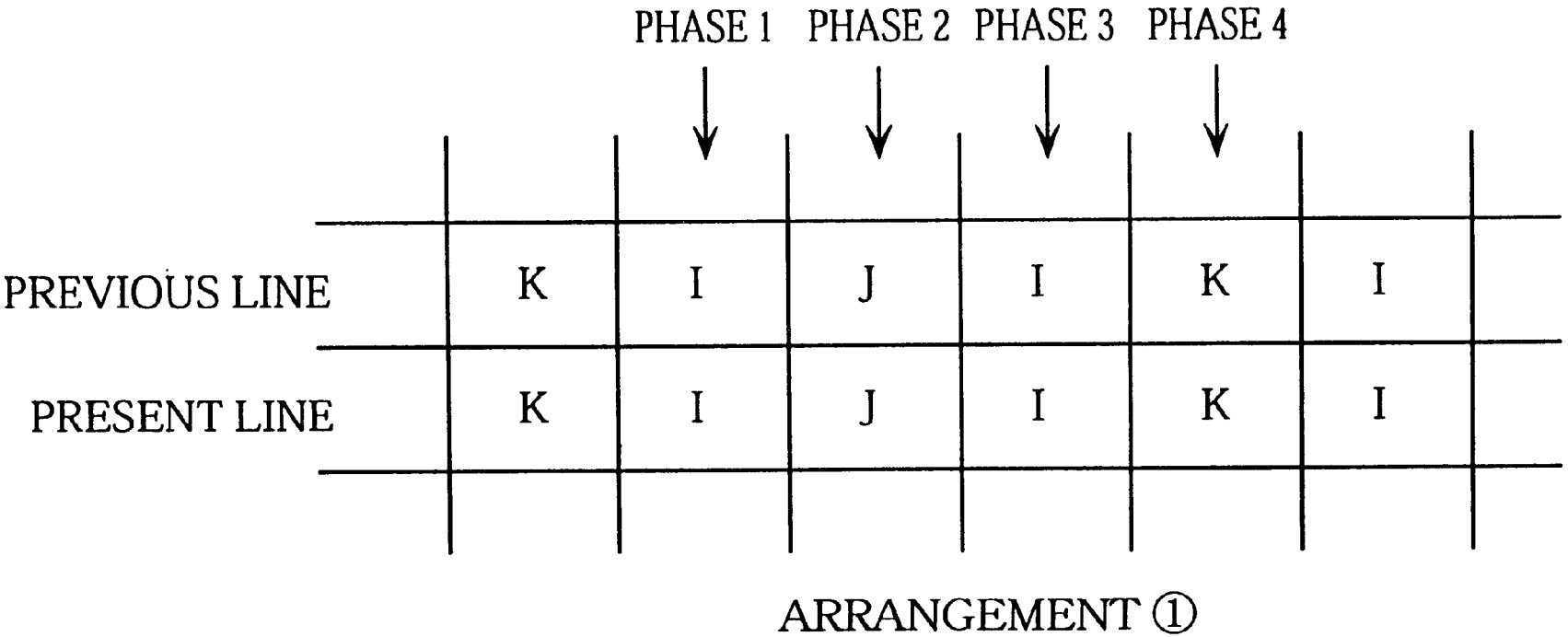
FIG. 43 shows an arrangement of the error diffusion patterns.

The present example assumes that the error diffusion patterns are arranged for pixels between the present line and the previous line as shown in FIG. 43.

As shown in FIG. 43, if the error diffusion pattern corresponding to phase 1 on the present line is the pattern I and the error diffusion pattern on the previous line is also the pattern I, the values set in the multiplication units and delay units in the calculation unit 402 will be as shown in frame ① in FIG. 39. In the same way, if the error diffusion pattern corresponding to phase 2 on the present line is the pattern J and the error diffusion pattern on the previous line is also the pattern J, the values set in the multiplication units and delay units in the calculation unit 403 will be as shown in the frame ① in FIG. 40. In the same way, the constants used by the circuits in the calculation units 404 and 405 will be as shown in the frames marked ① in FIGS. 41 and 42.

Figure 44:
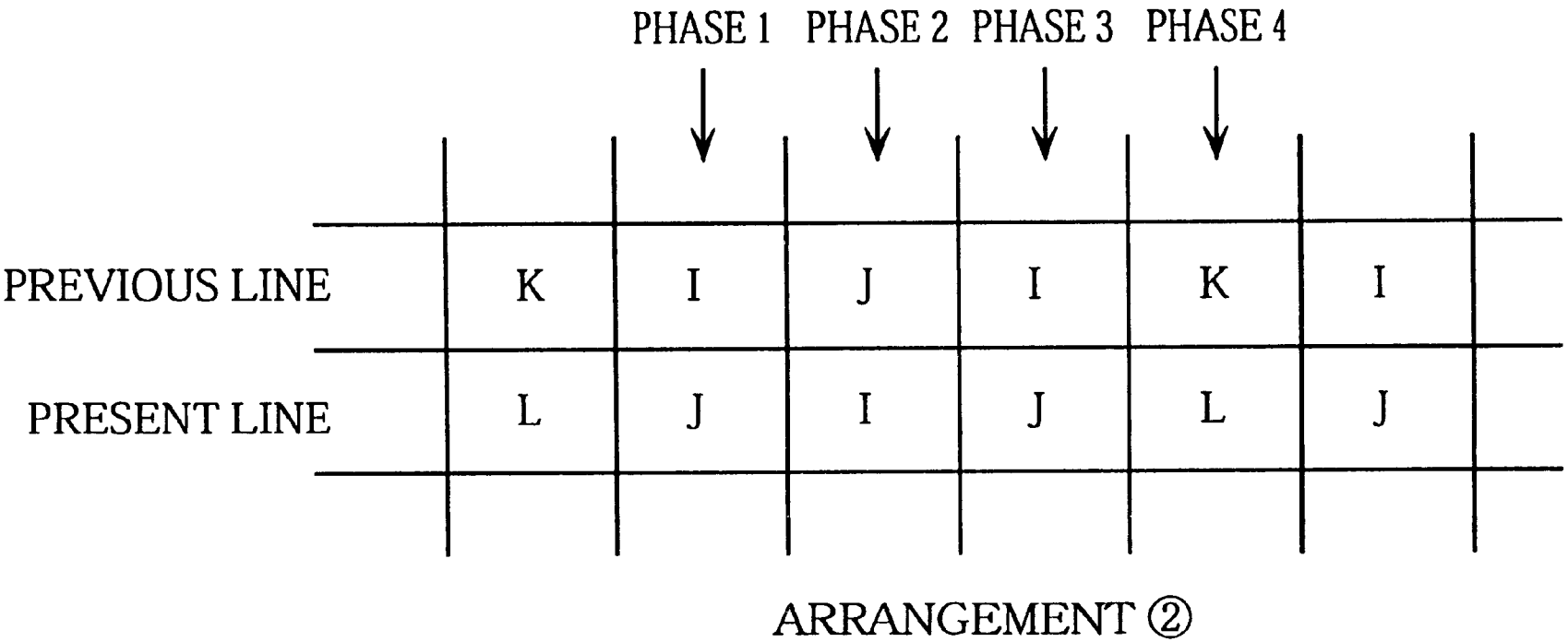
FIG. 44 shows an arrangement of the error diffusion patterns.

FIG. 44 shows a different arrangement of error diffusion patterns for pixels on the present line and the previous line.

As shown in FIG. 44, if the error diffusion pattern corresponding to phase 1 on the present line is the pattern J and the error diffusion pattern on the previous line is the pattern I, the values set in the multiplication units and delay units in the calculation unit 402 will be as shown in the frame ② in FIG. 39. In the same way, if the error diffusion pattern corresponding to phase 2 on the present line is the pattern J and the error diffusion pattern on the previous line is the pattern I, the values set in the multiplication units and delay units in the calculation unit 403 will be as shown in the frame ② in FIG. 40. In the same way, the constants used by the circuits in the calculation units 404 and 405 will be as shown in the frames marked ② in FIGS. 41 and 42. Note that the parts marked "unnecessary" in FIGS. 39–42 indicate that no calculation is necessary for the multiplication unit in question.

The following describes the operation of the present embodiment in detail.

Figure 45:
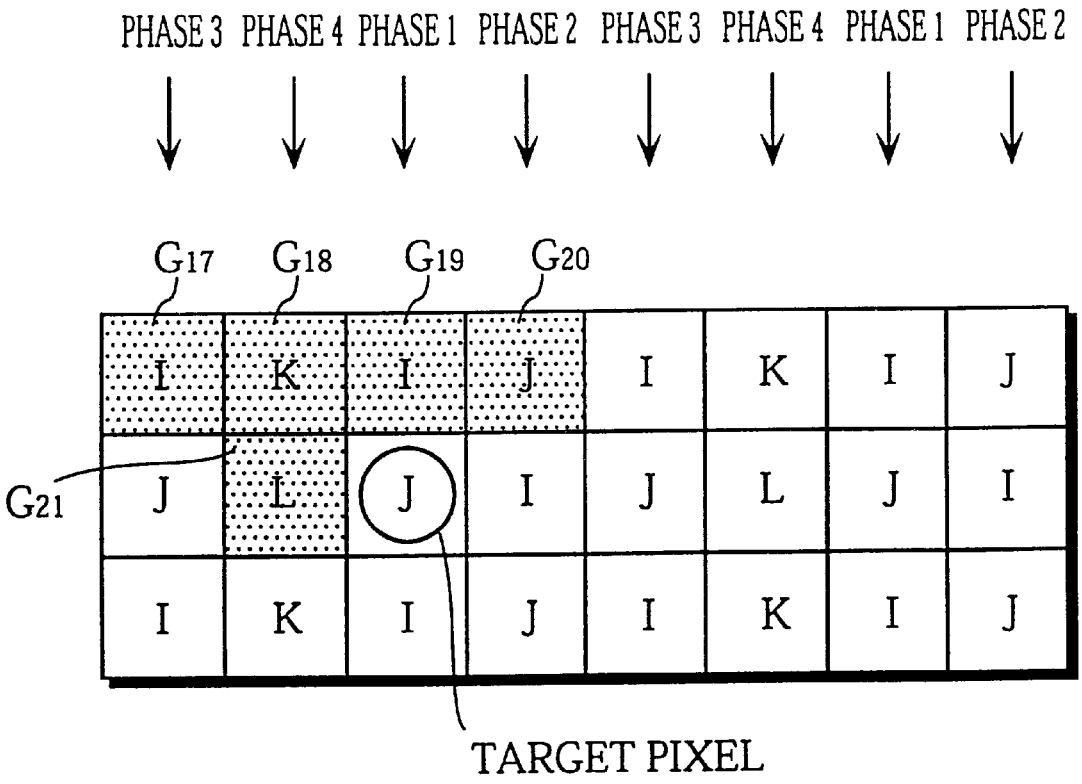
FIG. 45 shows the diffusion of errors with the present circuit construction.

The following example supposes that the error diffusion patterns I, J, K, and L are arranged as shown in FIG. 45. As shown in the drawing, pattern J is the error diffusion pattern for the target pixel (corresponding to phase 1 in a data block) marked with a circle, while pattern I is the error diffusion pattern for the pixel directly above the target pixel. In this case, the following error components are diffused into the target pixel:

5/16 of the total display error of the pixel G17;

1/16 of the total display error of the pixel G18;

6/16 of the total display error of the pixel G19;

6/16 of the total display error of the pixel G20; and

1/16 of the total display error of the pixel G21.

The following digital value of the target pixel marked with the circle is inputted into the error diffusing unit a time "(1H+1D)" after the digital value of the pixel G17, a time "(1H+1D)" after the digital value of the pixel G18, a time "1H" after the digital value of the pixel G19, a time "1H" after the digital value of the pixel G20, and a time "1D" after the digital value of the pixel G21.

This means that the following values are inputted into the adder at the same time as the digital value of the target pixel marked with the circle:

- the error signal generated for the pixel G17 that has passed the delay unit 803 in FIG. 38 and has been multiplied by the coefficient 5/16;
- the error signal generated for the pixel G18 that has passed the delay unit 804 in FIG. 38 and has been multiplied by the coefficient 1/16;
- the error signal generated for the pixel G19 that has passed the delay unit 801 in FIG. 38 and has been multiplied by the coefficient 6/16;
- the error signal generated for the pixel G20 that has passed the delay unit 802 in FIG. 38 and has been multiplied by the coefficient 6/16; and the error signal generated for the pixel G21 that has passed the delay unit 805 in FIG. 38 and has been multiplied by the coefficient 1/16.

In the present example, the delay values used by the delay units in the calculation unit in question are as shown by the column corresponding to the column headed "Target pixel is J, Line above is I" in FIG. 30.

In this way, the display errors of the intended magnitude can be diffused by the circuit shown in FIG. 38. The circuit construction is the same when other circuit constants (values of the multiplication units and delay units) are used, so that no further explanation will be given.

It should be obvious that the above construction can attain the same effect as the first-third embodiments in performing error diffusion processing for digital data that is multiphase. However, the present embodiment also has the following characteristic.

When the display error of the target pixel is diffused only into pixels on the line below the target pixel, as in the first embodiment, the display error is diffused into a fan-shaped area extending below the target pixel from left to right. However, the present embodiment also diffuses the display error of every phase 4 target pixel into a pixel located on the right of the target pixel, so that the display error is diffused into a wider fan-shaped area that extends around the target pixel from the pixel below and to the left to the pixel on the right. Such diffusion over a wider angle results in a visual averaging of pixel values (i.e., colors) over a wider area, so that the intended colors can be displayed using a smoother gradation. Since diffusion of the display error in the horizontal direction adds the display error to a neighboring pixels with the highest correlation in the original image, an image of a similar high quality as conventional error diffusion can be obtained.

Fifth Embodiment

The following describes a multilevel image display apparatus that uses the multilevel image display method that is the fifth embodiment of the present embodiment. Note that this multilevel image display apparatus only differs from the multilevel image display apparatuses described in the previous embodiments in the calculation method used for the error diffusion, so that the explanation will focus on this point. To simplify the present embodiment, the following explanation describes the case where the same error diffusion patterns are used as in the second embodiment.

It is common in conventional processing to convert the display error into a positive value before diffusing it into surrounding pixels. This is because this allows (1) the upper 8 bits of the 12-bit result of adding the 12-bit digital value and display errors diffused from nearby pixels to be outputted to the display apparatus (PDP) and (2) the lower 4 bits (a value between 0 and 15 in base 10) to be used without amendment as the display error to be diffused into nearby pixels.

In the present embodiment, however, the display error that is diffused into nearby pixels can be either positive or negative (a value between "−8" and "+7").

The principles behind the present embodiment are as follows.

To express negative values in binary, it is conventional to use a two's complement. Here, the most significant bit (MSB) is used as the sign bit and the remaining bits express an absolute value. When the sign bit is zero, the value is positive, while when the sign bit is one, the value is negative. To express a negative value using a binary number with a two's complement, all of the bits are inversed, one is added to the least significant bit (LSB), and bits with the value one are inserted to the left of the MSB. As one example, the base 10 value "−6" is expressed using a binary number with a two's complement by first inverting all of the bits of "6" ("110" in binary) to give "001". One is then added to the LSB to give "010", and then one sign bit (when the result is expressed as a four-bit value) is added to the MSB side to give "1010". In the same way, the base 10 value "−8" becomes "1000", the base 10 value "−7" becomes "1001", and the base 10 value "−1" becomes "1111". Note that while a 4-bit calculation that adds "0001" to "1111" ("−1" in base 10) gives the value "10000", all bits from the $5^{th}$ bit upwards are discarded, so that the value "0000" ("0" in base 10) is given.

The following describes the important points when performing calculations using values with a two's complement. As one example, the base 10 value "+5" can be expressed in binary by the four bits "0101" and by the eight bits "00000101". On the other hand, the base 10 value "−5" can be expressed in binary by the four bits "1011" and by the eight bits "11111011". As shown by this example, positive binary numbers can be extended by merely adding bits with the value zero to the left of the MSB. Negative values, however, are extended by adding bits with the value zero to the left of the MSB. When performing calculations such as additions, it is necessary to express both values using the same number of bits, so that when one value needs to be extended, this extending should be performed as described above.

Figure 46:
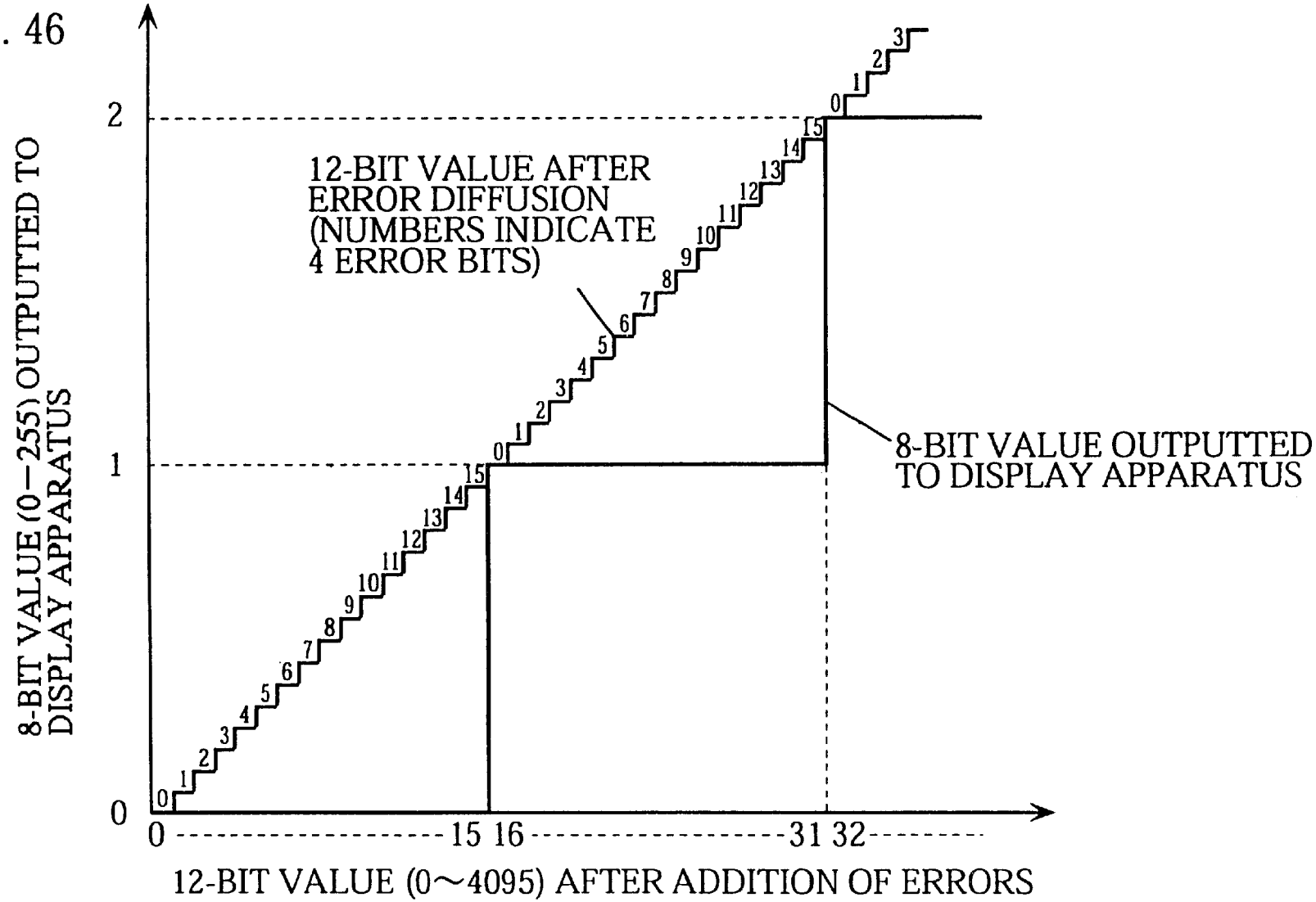
FIG. 46 shows the rounding up of a 4-bit display error that is conventionally performed in the calculation processing for error diffusion.

FIG. 46 shows the case when only positive values are used as the display errors. Here, when the 12-bit total of the digital value and the errors diffused from nearby pixels is between "0" and "15" (when expressed in base 10), the value "0" (in base 10) is outputted to the PDP. Similarly, when the 12-bit total is between "16" and "31" (in base 10), the value "1" (in base 10) is outputted to the PDP. In this way, each increase of "16" in the 12-bit total results in the value outputted to the PDP being increased by "1" (in base 10) up to a maximum of "255" (in base 10). Since the display error is the value produced by multiplying the value outputted to the PDP by sixteen and subtracting the result from the the 12-bit total of the digital value and the errors diffused from nearly pixels, the display error diffused into the nearby pixels is the lowest 4 bits of this 12-bit total.

As one example, when the 12-bit total of the digital value and the errors diffused from nearby pixels is "18" (in base 10), the value "1" (in base 10) is outputted to the PDP, so that the display error is given as 18−(1×16)=2.

As can be seen, this value "2" ("0010" in binary) is the lowest 4 bits of the value "18" ("000000010010").

Figure 47:
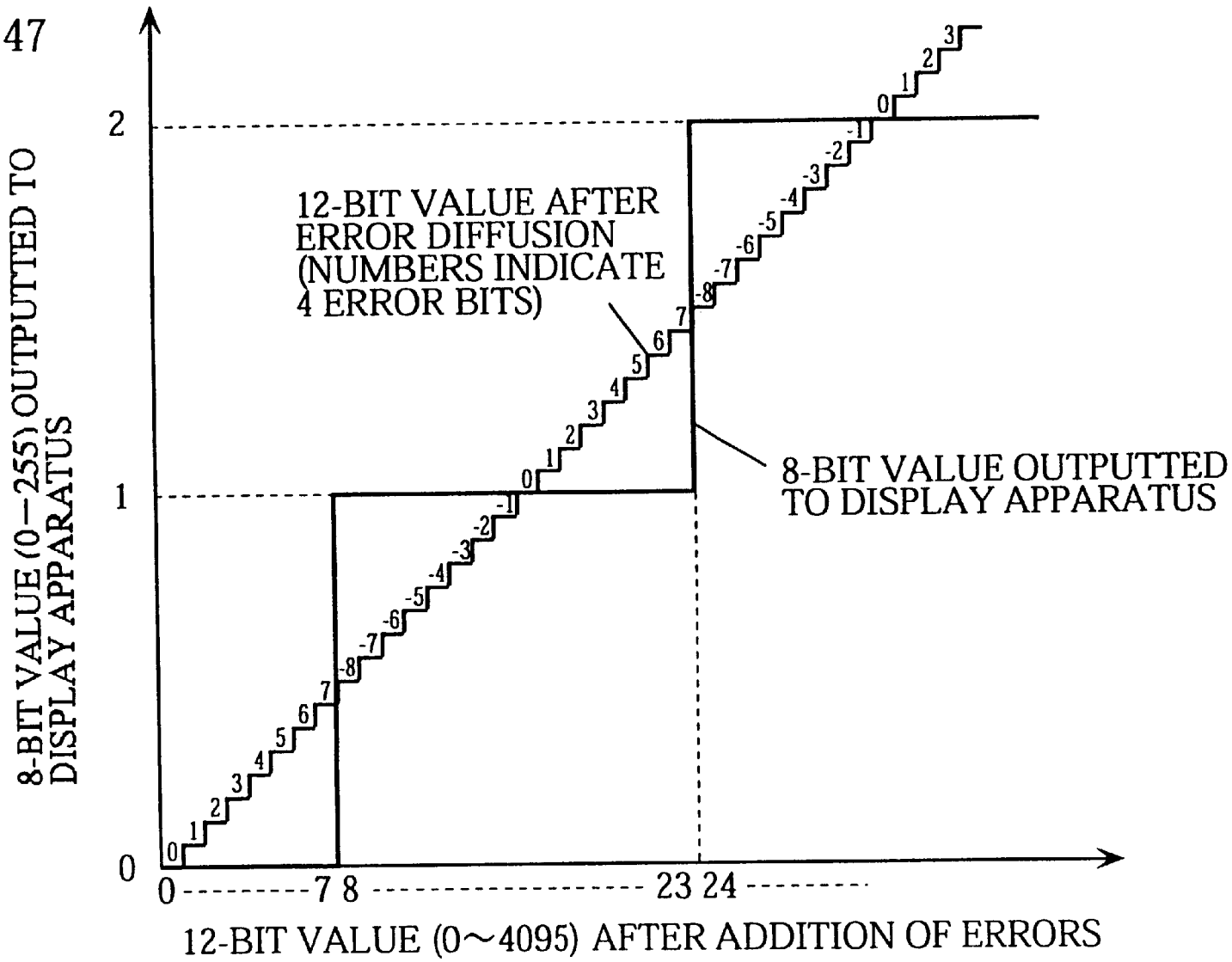
FIG. 47 shows the rounding up of a 4-bit display error in the fifth embodiment of the present invention.

FIG. 47 shows the case for the present embodiment where both positive and negative values are used as the display errors. Here, when the 12-bit total of the digital value and the errors diffused from nearby pixels is between "0" and "7" (in base 10), the value "0" (in base 10) is outputted to the PDP. When the 12-bit total is between "8" and "23" (in base 10), the value "1" (in base 10) is outputted to the PDP. Thereafter, each increase of "16" in the 12-bit total results in the value outputted to the PDP being increased by "1" (in base 10) up to a maximum of "255" (in base 10). Since the display error is the value produced by multiplying the value outputted to the PDP by sixteen and subtracting the result from the 12-bit total of the digital value of the target pixel and the errors diffused from nearby pixels, the display error diffused into the nearby pixels is a value between "−8" and "+7" (in base 10).

As one example, when the 12-bit total of the digital value of the target pixel and the errors diffused from nearby pixels is "8" (in base 10), the value "1" (in base 10) is outputted to the PDP, so that the display error is given as 8−(1×16)=−8.

As shown in FIG. 47, the display error "−8" (in base 10) is given when the 12-bit total of the digital value of the target pixel and the errors diffused from nearby pixels is a value in the sequence 8, 24, 40, . . . For such values, the lowest 4 bits are "1000" (in binary), which corresponds to the value "−8" (in base 10) when binary numbers are expressed with a two's complement. In the same way, the display error "−7" (in base 10) is given when the 12-bit total of the digital value of the target pixel and the errors diffused from nearby pixels is a value in the sequence 9, 25, 41, . . . For such values, the lowest 4 bits are "1001" (in binary), which corresponds to the value "−7" (in base 10) when binary numbers are expressed with a two's complement. This is also the case for the other possible values of the diffused display error.

For the reason given above, the present embodiment uses the lowest 4 bits of the 12-bit total of the digital value of the target pixel and the errors diffused from nearby pixels as the display error without amendment. However, it is necessary to add "8" (in base 10) to this 12-bit total before outputting the upper 8 bits to the PDP.

Figure 48:
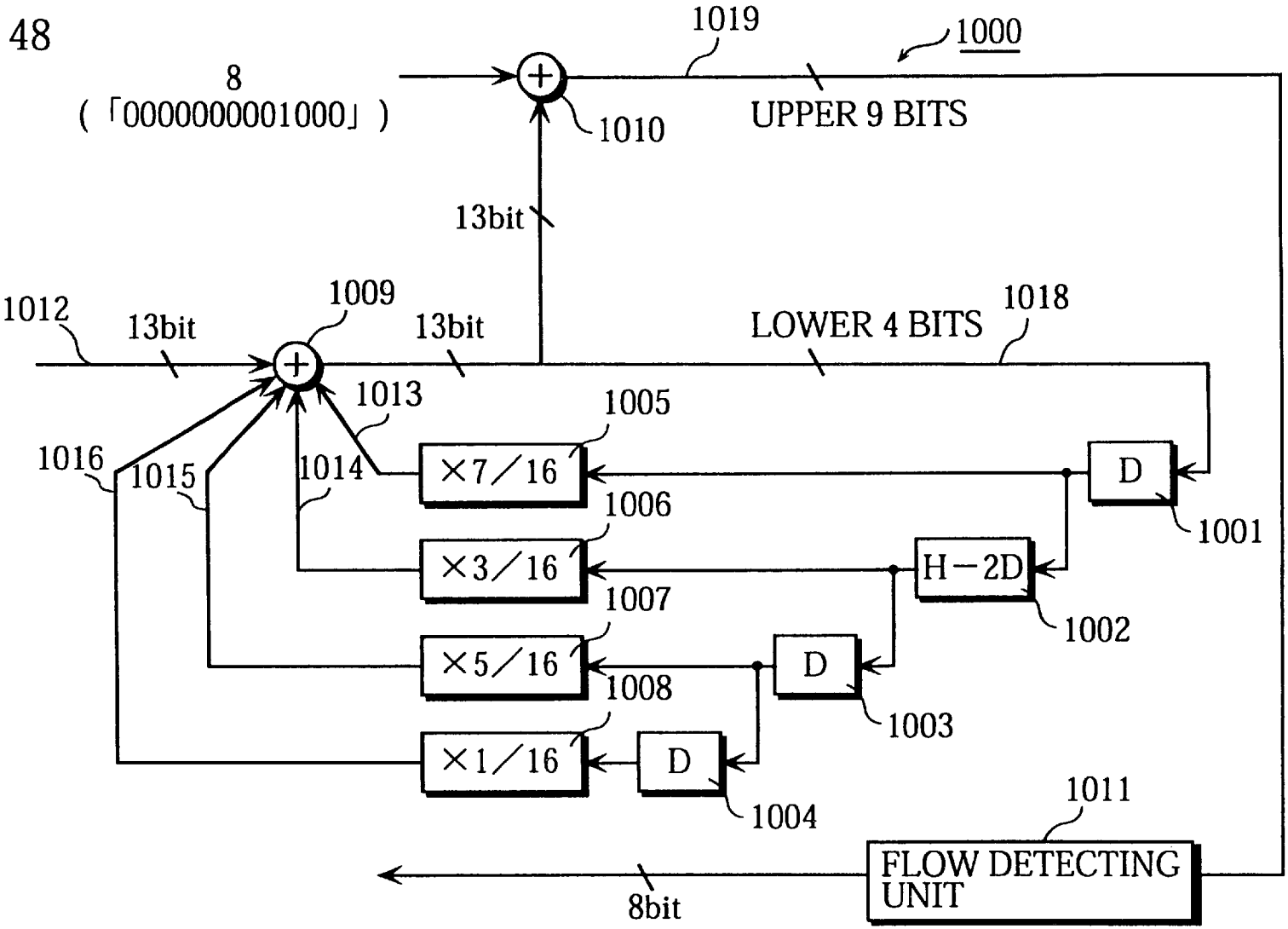
FIG. 48 shows the construction of each calculation unit in the error diffusing unit of the present embodiment.
Figure 49:
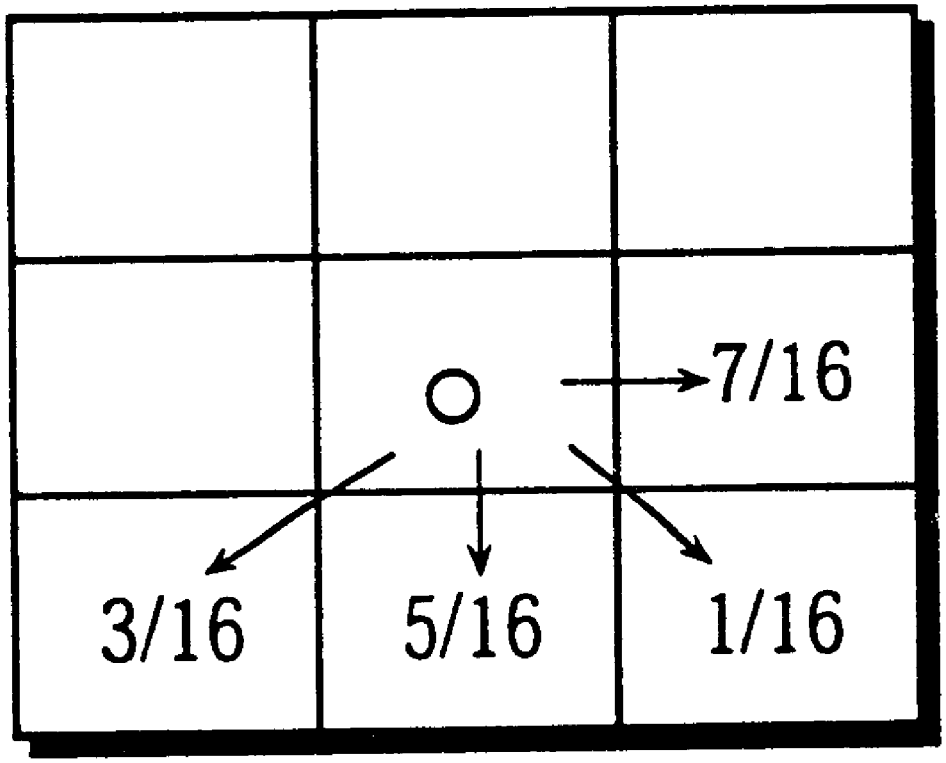
FIG. 49 shows a conventional error diffusion pattern.
Figure 50:
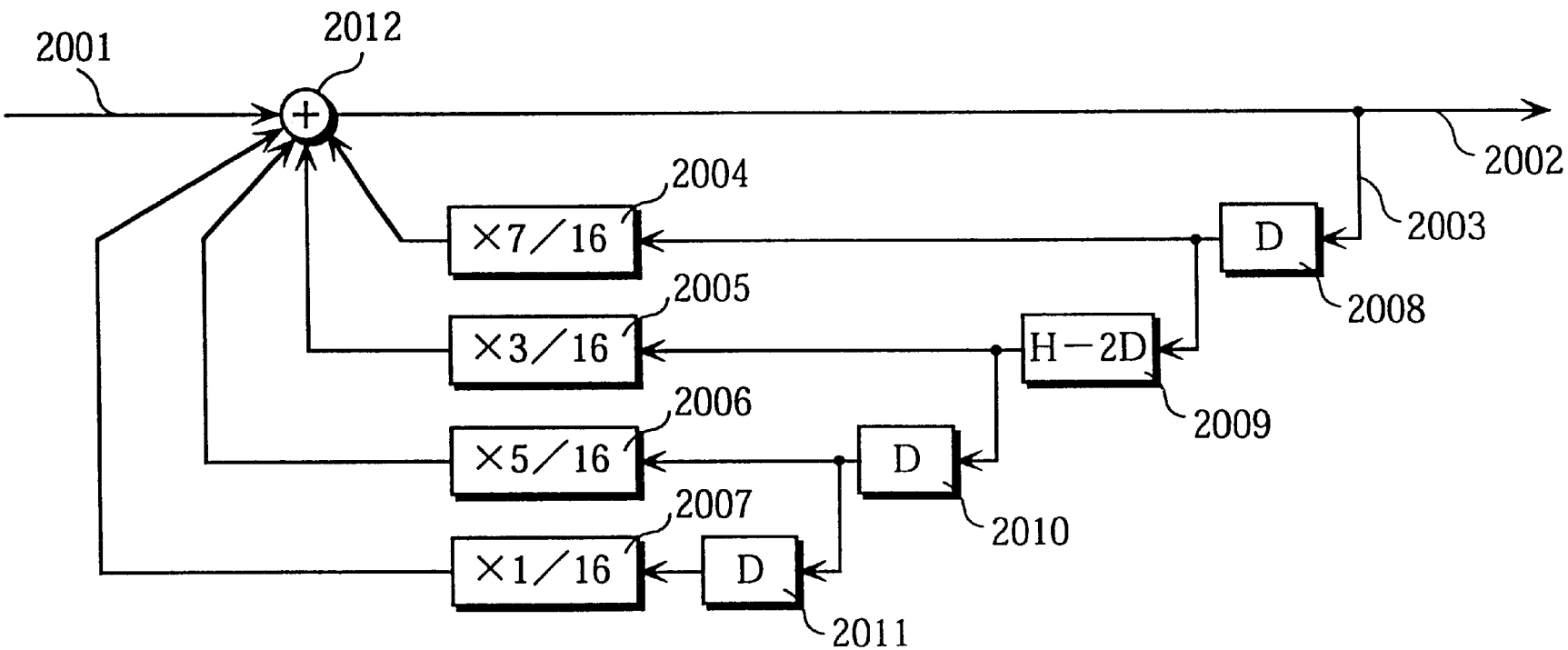
FIG. 50 shows the construction of a circuit for performing the calculations for conventional error diffusion.

FIG. 48 shows the construction of the calculation unit 1000 in the error diffusing unit that performs this processing.

The calculation unit 1000 includes four delay units 1001–1004, four multiplication units 1005–1009, two adders 1009, 1010, and a flow detecting unit 1011. Note that the patterns for diffusing display errors are the same as those shown in FIG. 19, and that the multiplication units have predetermined coefficients. While the above explanation refers to the signal lines the extend from components as "output lines", the following explanation refers only to "output signals" to simplify the description.

The following describes the operation of the calculation unit 1000 in detail.

First the sign bit "0" is added to the left of the MSB of the 12-bit digital value to give a 13-bit input signal 1012 to which the adder 1009 adds the errors 1013–1016 that have been diffused from nearby pixels. Each of the signals (i.e., the display errors that are diffused into the target pixel from nearby pixels) that are inputted into the adder 1009 via the multiplication units 1005–1008 are 4 bits long at most, so that these values need to be extended to become 13-bit values. When such values are negative, which is to say, the MSB of such values is one, this extending is achieved by filling all of the upper bits with ones, while when such values are positive, which is to say, the MSB of such values is zero, such extending is achieved by filling all of the upper bits with zeros.

The lowest 4 bits 1018 out of the 13 bits outputted by the adder 1009 are diffused into nearby pixels as the display error. The base 10 value "8" ("0000000001000" in binary) is added to the 13-bit signal 1017, and the upper 9-bits 1019 of the result are taken. The MSB of this signal 1019 is the sign bit. Since a sign bit with the value "1" denotes a negative value, all of the bits are converted into zeros by the flow detecting unit 1011. If the sign bit is "0" and the second highest bit is "1", the value will be at least "255", so that the value is set at "255". The sign bit is then removed and the remaining 8 bits are outputted to the PDP.

As a result of the above error diffusion processing, the absolute value of the display errors is smaller than when only positive values are used. This means that the values outputted to the PDP will be closer to the actual values that should be displayed, so that image quality is improved.

Here, assume that the maximum display error of 15 (in base 10) occurs for all four pixels that diffuse a display error into the target pixel. If in this case, the relative magnitudes of the display errors added to the target pixel are large, the total of the diffused display errors will be $$15*7/16+15*5/16+15*7/16+15*3/16=20.$$

Note that all fractions are discarded from the results of this and the following calculations. If the lowest four bits of the digital value for the target pixel are "0" (in base 10), the result 20+0=16+4 will be given, so that the pixel value is raised by "1" and a display error of "+4" is diffused into the nearby pixels. If, however, the lowest four bits of the digital value for the target pixel are "15" (in base 10), the result 20+15=16×2+3 will be given, so that the pixel value is raised by "2" and a display error of "+3" is diffused into the nearby pixels.

Assume, on the other hand, that the minimum display error of "0" (in base 10) occurs for all four pixels that diffuse a display error into the target pixel. In this case, the magnitudes of the display errors added to the target pixel are all zero. If the lowest four bits of the digital value for the target pixel are also "0" (in base 10), the result 0+0=0+0 will be given. This means that the pixel value is not raised and that the display error "0" is diffused into the nearby pixels.

On the other hand, if the lowest four bits of the digital value for the target pixel are "15" (in base 10), the result 0+15=0+15 will be given. This means that the pixel value is not raised and that the display error "15" is diffused into the nearby pixels.

This completes the explanation of when only positive values are used.

The following is the operation of the present embodiment that uses both negative and positive values. Here, assume that the maximum display error of "7" (in base 10) occurs for all four pixels that diffuse a display error into the target pixel. If in this case, the relative magnitudes of the display errors added to the target pixel are large, the total of the diffused display errors will be $$7*7/16+7*5/16+7*7/16+7*3/16=9$$

If the lowest four bits of the digital value for the target pixel are "0" (in base 10), the result 9+0=16−7 will be given, so that the pixel value is raised by "1" and a display error of "−7" is diffused into the nearby pixels. Note that since the range for display errors is "−8" to "+7", the pixel value is raised or lowered to keep that display error within this range. If, however, the lowest four bits of the digital value for the target pixel are "15" (in base 10), the result 9+15=(16×2)−8 will be given, so that the pixel value is raised by "2" and a display error of "−8" is diffused into the nearby pixels.

Assume, on the other hand, that the lowest display error of "−8" (in base 10) occurs for all four pixels that diffuse a display error into the target pixel. In this case, the total of the magnitudes of the display errors added to the target pixel are as follows $$-8*7/16-8*5/16-8*7/16-8*3/16=-11.$$

If the lowest four bits of the digital value for the target pixel are also "0" (in base 10), the result −11+0=−16+5 will be given. This means that the pixel value is lowered by "1" and that the display error "+5" is diffused into the nearby pixels.

On the other hand, if the lowest four bits of the digital value for the target pixel are "15" (in base 10), the result −11+15=0+4 will be given. This means that the pixel value is not raised and that the display error "+3" is diffused into the nearby pixels.

As can be seen from the above, while conventional techniques that only use positive values as display errors can only change the pixel value in one of three ways by adding "0", "1", or "2", the technique of the present embodiment that also uses negative values as display errors can change the pixel value in one of four ways by adding "−1", "0", "1", or "2". Since there is a wider range for adjusting the original data, values that are more consistent with the original image can be outputted to a PDP. When display errors expressed using only positive values are diffused using relatively large coefficients, the pixel value of the target pixel is raised and a positive display error is diffused into nearby pixels, so that the presence of a single bright pixel raises the pixel values of a number of other pixels. In the present embodiment, however, a negative display error will be diffused into nearby pixels when the diffusion of a large display error has caused a pixel value to be raised, so that the influence of a single bright pixel on nearby pixels is suppressed, which stops the nearby pixels from becoming too bright. This means that an image which is faithful to the original digital data can be displayed.

When only positive display errors are used, pixel values will definitely be raised in areas of certain images where display errors are large, so that depending on the error diffusion patterns used, undesired patterns can often be observed in the displayed image. As one example, when the error diffusion patterns are arranged as shown in FIG. 15, there are cases where a striped pattern will be observed in the displayed image. With the present embodiment, however, the absolute magnitudes of the display errors are small, so that the total of the diffused display errors will not become large. This prevents undesired patterns from appearing in the displayed image due to the error diffusion patterns.

As described above, the present embodiment of the invention is able to prevent exceptionally bright pixels from overlay affecting the surrounding pixels, in addition to the effect of being able to diffuse display errors into nearby pixels in the same way as when only positive values are used for a 12-bit input image signal. This means that the effects of the error diffusion are not decreased and there is no deterioration in image quality. If negative values are additionally used to express display errors as in this embodiment, an increase in image quality can be obtained.

It should be noted that the present embodiment may detect whether each pixel in a displayed image corresponds to a moving part or a still part of an image, and then use a different arrangement of error diffusion patterns in the moving parts of the image to that used in the still parts. As one example, the error diffusion patterns may be arranged randomly in the vertical direction in the moving parts of the input image and in an alternating arrangement in the still parts of the input image. By doing so, checkerboard patterns can be prevented from appearing in the moving parts of the image as the viewer's eyes track the moving parts of the image, while the generation of noise in the still part due to a random alternation of error diffusion patterns will be avoided due to the regular arrangement of the error diffusion patterns.

The above embodiments perform the following processing for pixels located at the left or right edges of the PDP screen. In short, the processing uses a virtual screen that is larger than the real PDP screen. Since the pixels in parts of the virtual screen that extend beyond the real screen are black (i.e., the value of the input image signal is zero), no errors are produced. This means that a plurality of pixels may diffuse a display error into pixels located at the left edge of the screen and that pixels located at the right edge of the screen may diffuse a display error into a plurality of pixels. Note that while it is necessary to add virtual image data with the pixel value "0" to the start and end of each line data sequence, the input image signal in fact contains more data than the amount of data outputted to the PDP for one line, so that there is no need to deliberately add data to this signal. By the way, the processing for these pixels at the left and right edges of each line on the PDP screen can be performed according to the same method as in conventional error diffusion processing.

Note that while the above embodiments describe the case where the multiphase input signal has 4 phases, the present invention is not limited to this number, so that the present invention can be used with any multiphase input signal with 2 or more phases.

Also, the above embodiments describe the case where a PDP is used as the display apparatus, although it should be obvious that the present invention can be applied to other display apparatuses, such as an LCD (liquid crystal display) panel.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A multilevel image display method for a multilevel image display apparatus, comprising:

a grouping process for grouping together, as one data block, m pieces of digital data corresponding to m pixels, which are adjacent in a scanning direction, (m being an integer no less than two), the data block having phase 1, phase 2, . . . and phase m in the stated order in the scanning direction, an error calculation process for extracting the digital values separately for each phase of the data block;

designating a target pixel for each phase of the data block, and calculating in parallel for each phase of the data block, a display error from a digital value that corresponds to a respective target pixel;

an error diffusion process for diffusing each display error calculated in the error calculation process into digital values corresponding to pixels included in at least one data block that follows the data block including the target pixel; and a display process for converting the resulting digital values corresponding to each pixel in the data block into multilevel values that are used when displaying an image, and displaying an image based on the converted multilevel data.

2. A multilevel image display method according to claim 1, wherein the error diffusion process diffuses the calculated display error into digital values corresponding to pixels that lie on scanning lines which are below a scanning line that includes the target pixel.

3. A multilevel image display method according to claim 1, wherein the error diffusion process diffuses the calculated display error into digital values of pixels in data blocks that come after the data block including the target pixel, said pixels having a same position (hereafter, "phase") in a data block as the target pixel.

4. A multilevel image display method according to claim 1, wherein when error diffusion process diffuses the calculated display error into digital values of pixels on a same scanning line as the target pixel, the display error is diffused into pixels that have a same phase within a data block as the target pixel, and when the error diffusion process diffuses the calculated display error into digital values of pixels on a lower scanning line, the display error is diffused into pixels that are adjacent to the target pixel.

5. A multilevel image display method according to claim 1, wherein when a digital value corresponding to a pixel that is adjacent to the target pixel on a same scanning line will be processed at least one data cycle after the digital value of the target pixel, the error diffusion process diffuses the calculated display error into the digital value corresponding to the pixel that is adjacent to the target pixel on the same scanning line, and in all other cases, the error diffusion process diffuses the calculated display error into other pixels whose digital values will be processed at least one data cycle after the digital value of the target pixel.

6. A multilevel image display method according to claim 5, wherein the display errors calculated by the error calculation process include positive and negative values.

7. A multilevel image display method according to claim 4, wherein the display errors calculated by the error calculation process include positive and negative values.

8. A multilevel image display method according to claim 3, wherein the display errors calculated by the error calculation process include positive and negative values.

9. A multilevel image display method according to claim 2, wherein the display errors calculated by the error calculation process include positive and negative values.

10. A multilevel image display method according to claim 1, wherein the error diffusion process selects one out of a plurality of patterns that are prepared in advance, each pattern diffusing the display error calculated for a target pixel into digital values of other pixels.

11. A multilevel image display method according to claim 10, wherein the error diffusion process uses four patterns, the four patterns including:

two patterns which diffuse the calculated display error into digital values corresponding to four consecutive pixels that are near the target pixel on a scanning line that is immediately below a scanning line including the target pixel, one of said two patterns diffusing the calculated display error into the digital values with weightings that are in a small, large, small, large arrangement along a scanning direction and another of said two patterns diffusing the calculated display error into digital values with weightings that are in a large, small, large, small arrangement along the scanning direction; and two patterns which diffuse the calculated display error into (1) a digital value of one pixel that is adjacent to the target pixel on a same scanning line as the target pixel, and (2) digital values of three consecutive pixels that are near the target pixel on a scanning line that is immediately below the scanning line including the target pixel, one of said tow patterns diffusing the calculated display error into the four digital values with weightings that are in a small, large, large, small arrangement for a given order of the four digital values and another of said two patterns diffusing the calculated display error into the four digital values with weightings that are in a large, small, small, large arrangement that is opposite to the given order.

12. A multilevel image display method according to claim 11, wherein the large weightings in the arrangements for diffusing the calculated display error are 1.5 to 3 times as large as the small weightings in the arrangements.

13. A multilevel image display method according to claim 11, wherein the two patterns which diffuse the calculated display error into digital values corresponding to four consecutive pixels that are near the target pixel on a scanning line that is immediately below the scanning line including the target pixel respectively use (1) 3/16, 6/16, 2/16, 5/16 and (2) 6/16, 2/16, 6/16, 2/16 as the arrangements of weightings, and the other two patterns are (i) a pattern that diffuses 7/16 of the calculated display error into the digital value of the pixel on the same scanning line as the target pixel and 6/16, 2/16 and 1/16 of the calculated display error respectively into the digital values of the pixels on the scanning line that is immediately below the scanning line including the target pixel and (ii) a pattern that diffuses 1/16 of the calculated display error into the digital value of the pixel on the same scanning line as the target pixel and 2/16, 7/16 and 6/16 of the calculated display error respectively into the digital values of the pixels on the scanning line that is immediately below the scanning line including the target pixel.

14. A multilevel image display method according to claim 10, wherein the error diffusion process uses two patterns which diffuse the calculated display error into digital values corresponding to four consecutive pixels that are near the target pixel on a scanning line that is immediately below a scanning line including the target pixel, one of said two patterns diffusing the calculated display error into the pixels with weightings that are in a small, large, small, large arrangement along a scanning direction and another of said two patterns diffusing the calculated display error into the pixels with weightings that are in a large, small, large, small arrangement along the scanning direction.

15. A multilevel image display method according to claim 11, wherein the large weightings in the arrangements for diffusing the calculated display error are 1.5 to 3 times as large as the small weightings in the arrangements.

16. A multilevel image display method according to claim 14, wherein the two patterns respectively use (1) 3/16, 6/16, 2/16, 5/16 and (2) 6/16, 2/16, 6/16, 2/16 as the arrangements of weightings along the scanning direction.

17. A multilevel image display method according to claim 10, wherein the error diffusion process uses two patterns, a first of the two patterns diffusing the calculated display error into digital values of three pixels composed of a first pixel at a position that is on a same scanning line as the target pixel but is separated from the target pixel by several pixels in a first direction, a second pixel that is adjacent to the target pixel and lies on a scanning line that is immediately below the scanning line including the target pixel, and a third pixel that lies on a same scanning line as the second pixel and is separated from the target pixel by several pixels in the first direction, and a second of the two patterns diffusing the calculated display error into digital values of three pixels composed of a fourth pixel at a position that is on a same scanning line as the target pixel but is separated from the target pixel by several pixels in the first direction, a fifth pixel that is adjacent to the target pixel and lies in a scanning line that is immediately below the scanning line including the target pixel, and a sixth pixel that lies on a same scanning line as the fifth pixel and is separated from the target pixel by several pixels in a different direction from the first direction.

18. A multilevel image display method according to claim 17, wherein the calculated display error is diffused into the digital values of the first to sixth pixels with an approximately equal weighting.

19. A multilevel image display method according to claim 17, wherein the first pattern diffuses the calculated display error with a weighting of 5/16 into the digital value of the first pixel, with a weighting of 7/16 into the digital value of the second pixel, and with a weighting of 4/16 into the digital value of the third pixel, and the second pattern diffuses the calculated display error with a weighting of 7/16 into the digital value of the fourth pixel, with a weighting of 5/16 into the digital value of the fifth pixel, and with a weighting of 4/16 into the digital value of the sixth pixel.

20. A multilevel image display method according to claim 10, wherein the error diffusion process uses two patterns, both patterns diffusing the calculated display error into digital values of four pixels composed of a first pixel at a position that is on a same scanning line as the target pixel but is separated from the target pixel by several pixels in a first direction, a second pixel that is adjacent to the target pixel and lies on a scanning line that is immediately below the scanning line including the target pixel, a third pixel that lies on a same scanning line as the second pixel and is separated from the target pixel by several pixels in the first direction, and a fourth pixel that lies on a same scanning line as the second pixel and is separated from the target pixel by several pixels in a second direction that differs from the first direction, the two patterns including different weightings for diffusing the calculated display errors into the digital data of the four pixels.

21. A multilevel image display method according to claim 20, wherein the two patterns diffuse 5/16 to 7/16 of the calculated display error into the digital value of the first pixel, 1/16 to 3/16 of the calculated display error into the digital value of the third pixel, and a remaining part of calculated display error divided almost equally into the digital values of the second and fourth pixels.

22. A multilevel image display method according to claim 20, wherein a first of the two patterns diffuses 7/16 of the calculated display error into the digital value of the first pixel, 1/16 of the calculated display error into the digital value of the third pixel, 5/16 of the calculated display error into the digital value of the second pixel, and 3/16 of the calculated display error into the digital value of the fourth pixel, and a second of the two patterns diffuses 1/16 of the calculated display error into the digital value of the first pixel, 7/16 of the calculated display error into the digital value of the third pixel, 3/16 of the calculated display error into the digital value of the second pixel, and 5/16 of the calculated display error into the digital value of the fourth pixel.

23. A multilevel image display method according to claim 10, wherein the error diffusion process uses two patterns, both patterns diffusing the calculated display error into digital values of four pixels composed of a first pixel at a position that is on a same scanning line as the target pixel but is separated from the target pixel by several pixels in a first direction, and three consecutive pixels that are near the target pixel and lie on a scanning line that is immediately below the scanning line including the target pixel, the two patterns including different weightings for diffusing the calculated display errors into the four pixels.

24. A multilevel image display method according to claim 23, wherein the two patterns diffuse 5/16 to 8/16 of the calculated display error into the digital value of the pixel that is on the same scanning line as the target pixel, 5/16 to 8/16 of the calculated display error into the digital value of one of the three consecutive pixels that lie on a scanning line that is immediately below the scanning line including the target pixel, and a remaining part of the calculated display error divided almost equally into a remaining two pixels in the three consecutive pixels.

25. A multilevel image display method according to claim 23, wherein a first of the two patterns diffuses 8/16 of the calculated display error into the digital value of the pixel that is on the same scanning line as the target pixel and 2/16, 5/16 and 1/16 of the calculated display error in order along a scanning direction respectively into the digital values of the three consecutive pixels that lie on a scanning line that is immediately below the scanning line including the target pixel, and a second of the two patterns diffuses 2/16 of the calculated display error into the digital value of the pixel that is on the same scanning line as the target pixel and 7/16, 1/16 and 6/16 of the calculated display error in order along the scanning direction respectively into the digital values of the three consecutive pixels that lie on a scanning line that is immediately below the scanning line including the target pixel.

26. A multilevel image display method according to claim 10, wherein in diffusing calculated display errors, the error diffusion process selects different patterns for target pixels that are adjacent along a scanning direction according to an arrangement that repeats in cycles of n (where n is an integer such that $n \geqq 1$) target pixels, the arrangement ensuring that no two target pixels that are adjacent in the scanning direction are processed using a same pattern.

27. A multilevel image display method according to claim 26, wherein the error diffusion process switches between patterns so that a total weighting of display errors to be added to digital values corresponding to pixels that are adjacent along the scanning direction is alternately large and small.

28. A multilevel image display method according to claim 25, wherein the error diffusion process selects a pattern for each target pixel so that different patterns are used for target pixels that are adjacent in a direction perpendicular to the scanning direction.

29. A multilevel image display method according to claim 26, wherein the error diffusion process switches between patterns so that a total weighting of display errors to be added to digital values corresponding to pixels that are adjacent perpendicular to the scanning direction is alternately large and small.

30. A multilevel image display method according to claim 28, wherein the error diffusion process selects a pattern for each target pixel so that different patterns are used for a same target pixel in consecutive TV fields.

31. A multilevel image display method according to claim 30, wherein the error diffusion process switches between patterns so that a total weighting of display errors to be added to a digital value corresponding to a same target pixel in consecutive TV fields is alternately large and small.

32. A multilevel image display method according to claim 28, wherein the error diffusion process switches between patterns at random for consecutive scanning lines.

33. A multilevel image display method according to claim 30, wherein the error diffusion process switches between patterns at random for consecutive scanning lines in each TV field and for corresponding scanning lines in consecutive TV fields.

34. A multilevel image display method according to claim 10, wherein the error diffusion process uses a motion detection means and is controlled so that a selecting of patterns is controlled in accordance with whether motion has been detected by the motion detection means.

35. A multilevel image display method according to claim 34, wherein in parts of an input image that are judged by the motion detection means to not include motion, the error diffusion process switches between patterns so that (1) a same pattern is not used for target pixels that are adjacent in the scanning direction, (2) a same pattern is not used for target pixels that are adjacent in a direction perpendicular to the scanning direction, and (3) a same pattern is not used for a same target pixel in consecutive TV fields.

36. A multilevel image display method according to claim 34, wherein in parts of an input image that are judged by the motion detection means to include motion, the error diffusion process switches between patterns so that (1) an arrangement of patterns is cyclically used for pixels that are adjacent in the scanning direction, the arrangement ensuring that a same pattern in not used for pixels that are adjacent in the scanning direction, (2) patterns are selected randomly for pixels that are adjacent in a direction perpendicular to the scanning direction, and (3) patterns are selected randomly for a same pixel in consecutive TV fields.

37. A multilevel image display apparatus that displays a multilevel image according to the multilevel image display method of claim 1.

38. A multilevel image display apparatus that displays a multilevel image according to the multilevel image display method of claim 2.

39. A multilevel image display apparatus that displays a multilevel image according to the multilevel image display method of claim 3.

40. A multilevel image display apparatus that displays a multilevel image according to the multilevel image display method of claim 4.

41. A multilevel image display apparatus that displays a multilevel image according to the multilevel image display method of claim 5.

* * * * *